US010905241B1

(12) United States Patent
Stravitz et al.

(10) Patent No.: US 10,905,241 B1
(45) **Date of Patent: *Feb. 2, 2021**

(54) FURNITURE WITH ANTI-TIPPING MECHANISM AND METHOD FOR INSTALLING FURNITURE

(71) Applicant: Dooli Products, LLC, New York, NY (US)

(72) Inventors: David M. Stravitz, New York, NY (US); Steven G. Marton, New York, NY (US)

(73) Assignee: Dooli Products, LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/992,397

(22) Filed: Aug. 13, 2020

Related U.S. Application Data

(63) Continuation of application No. 16/986,932, filed on Aug. 6, 2020, now Pat. No. 10,813,456, which is a (Continued)

(51) Int. Cl.
*A47B 97/00* (2006.01)
*A47B 91/12* (2006.01)

(52) U.S. Cl.
CPC ..... *A47B 97/00* (2013.01); *A47B 91/12* (2013.01); *A47B 2097/008* (2013.01)

(58) Field of Classification Search
CPC ... A47B 97/00; A47B 2097/008; A47B 91/12; F16M 13/02

(Continued)

(56) References Cited

U.S. PATENT DOCUMENTS

D22,730 S 8/1893 Shoudy
D46,792 S 12/1914 Purcell (Continued)

FOREIGN PATENT DOCUMENTS

FR 2620303 A1 3/1989
FR 2979210 A1 3/2013
WO 0024293 A1 5/2000

OTHER PUBLICATIONS

No, Dressers Don't Need to Be Anchored to a Wall, by John Brownlee, Jul. 13, 206, downloaded Jan. 26, 2020.

(Continued)

*Primary Examiner* — Todd M Epps
(74) *Attorney, Agent, or Firm* — Brian Roffe

(57) ABSTRACT

A piece of furniture and an anti-tipping mechanism include a frame having a front and a rear, at least one drawer slidable through the front of the frame into and partly out of the frame, and one or more L-shaped boots each having a first elongate planar portion and a second planar portion shorter than the first planar portion with the second planar portion having a position at an angle to the first planar portion. The second planar portion is attached to a rear surface of the frame to be alongside and in contact therewith. The first planar portion is situated below the front and rear of the frame and extends forward of the front of the frame when the second planar portion is attached to the rear surface of the frame to aid in preventing tipping of the piece of furniture.

20 Claims, 67 Drawing Sheets

Related U.S. Application Data continuation-in-part of application No. 16/799,909, filed on Feb. 25, 2020, now Pat. No. 10,758,046, which is a continuation-in-part of application No. 16/799,941, filed on Feb. 25, 2020, now Pat. No. 10,786,080.

(60) Provisional application No. 62/949,664, filed on Dec. 18, 2019, provisional application No. 62/944,425, filed on Dec. 6, 2019.

(58) Field of Classification Search
USPC ..... 248/680, 500, 501, 505, 506; 312/333, 312/330.1, 351.1
See application file for complete search history.

(56) References Cited

U.S. PATENT DOCUMENTS

| | | | | |
|---|---|---|---|---|
| 1,233,775 | A | 7/1917 | Hagar | |
| 1,376,203 | A | 4/1921 | Payne | |
| 1,730,391 | A | 10/1929 | Stobba | |
| 2,104,214 | A | 1/1938 | Vezina | |
| D182,833 | S | 5/1958 | Lubbert et al. | |
| 4,120,549 | A | 10/1978 | Bureau | |
| 4,214,323 | A | 7/1980 | Thomas | |
| 4,669,695 | A | 6/1987 | Chou | |
| D305,485 | S | 1/1990 | Zalesak | |
| 4,890,813 | A | 1/1990 | Johnson et al. | |
| 5,013,103 | A | 5/1991 | Addison | |
| 5,076,525 | A | 12/1991 | Whipple | |
| 5,174,543 | A | 12/1992 | Corson et al. | |
| 5,192,123 | A * | 3/1993 | Wallin | A47B 96/00 248/500 |
| 5,352,031 | A | 10/1994 | Nahrgang | |
| 5,431,365 | A | 7/1995 | Hopkins | |
| 5,599,000 | A | 2/1997 | Bennett | |
| 5,794,903 | A | 8/1998 | Peterson, II | |
| 6,068,355 | A | 5/2000 | Thorp | |
| 6,220,562 | B1 | 4/2001 | Konkle | |
| D467,096 | S | 12/2002 | DiCostanzo | |
| 6,508,525 | B2 | 1/2003 | Picogna | |
| 6,533,238 | B2 * | 3/2003 | Barnes | A47L 15/427 248/502 |
| D512,903 | S | 12/2005 | Gallien | |
| 7,185,872 | B2 | 3/2007 | Lowenstein, Jr. | |
| 7,775,498 | B2 * | 8/2010 | Phillips | F24C 15/083 248/550 |
| 9,163,842 | B2 * | 10/2015 | Adams | F24C 15/083 |
| 9,578,965 | B2 * | 2/2017 | Hamaba | G03G 21/1685 |
| 9,955,785 | B2 | 5/2018 | Kato | |
| 10,113,687 | B2 * | 10/2018 | Wise | F16M 13/02 |
| 10,321,762 | B2 | 6/2019 | Muskopf | |
| 10,758,046 | B1 * | 9/2020 | Stravitz | A47B 97/00 |
| 10,786,080 | B1 * | 9/2020 | Stravitz | A47B 97/00 |
| 10,812,456 | B2 * | 10/2020 | Pollet | H04L 63/0442 |
| 2002/0010886 | A1 | 1/2002 | Tanaka et al. | |
| 2003/0010886 | A1 * | 1/2003 | Barnes | D06F 39/12 248/680 |
| 2003/0221593 | A1 | 12/2003 | Usagani | |
| 2006/0207989 | A1 | 9/2006 | Ritchie et al. | |
| 2007/0039640 | A1 | 2/2007 | Zheng | |
| 2011/0043088 | A1 | 2/2011 | McConnell et al. | |
| 2013/0087675 | A1 | 4/2013 | Miller | |
| 2014/0263925 | A1 | 9/2014 | Essrig | |
| 2017/0021958 | A1 | 1/2017 | Shelton | |
| 2018/0168344 | A1 | 6/2018 | Arrillaga Albeniz | |
| 2019/0150617 | A1 | 5/2019 | Lager et al. | |
| 2019/0365098 | A1 | 12/2019 | Johannesson | |

OTHER PUBLICATIONS

DE20116637 Zerver; Abstract and figure (2001).
CN209474157 Chang et al.; Abstract and figure (2019).
English translation FR 2620303, 1989.

* cited by examiner

FURNITURE WITH ANTI-TIPPING MECHANISM AND METHOD FOR INSTALLING FURNITURE

FIELD OF THE INVENTION

The present invention relates generally to anti-tipping mechanisms for furniture that prevent the furniture from tipping over when, for example, a child is climbing on a drawer of the furniture or reaching the top to have it tip forward. The anti-tipping mechanisms may be completely separate from the furniture or involve specific construction of the furniture. The present invention also relates to a piece of furniture including or incorporating an anti-tipping mechanism, and a method for placing or installing a piece of furniture to provide anti-tipping properties.

BACKGROUND OF THE INVENTION

Furniture tipping accidents and deaths are on the rise. The majority many of toddler furniture pieces, typically dressers, are anywhere from about 16 inches to about 24 inches deep and often toddlers can grab the top of the dresser, grab the top drawer of the dresser and even climb into the bottom drawer of the dresser before the parent is aware of this. Top drawers of these dressers often have heavy contents in them further making the dresser more easy to tip over, which when it occurs, often results in the toddler getting severely hurt, sometimes even rushed to the hospital and even more worrisome, a tragic death.

Many products on the market currently offer the ability to attach the upper back of a piece of furniture, e.g., a dresser, to the wall or other vertical support behind the dresser with a webbing strap or cable so the tipping issue is caught and restricted before the entire dresser falls forward. Yet, this can also allow the topmost dresser drawer to fall forward and still cause accidents. Proper fastening of the dresser to the wall poses yet another issue insofar as it is possible that the screws on the wall or the screws on the dresser are ripped apart when the tipping force is too much, especially if the webbing strap or cable is not attached properly in a safe or secure manner and location. After all, most dresser backs are very cheaply made with the backs often ⅛" thin pressboard or plywood and the frame is typically ⅝"-¾" and made of plywood or even less secure presswood typically used today.

Also, it is possible that the wall mounting was installed without the use of appropriate hardware such as mollies or lead plugs. If that were so, it would take little force for the tipping force exerted by the child or toddler to "rip" a wall-mounting bracket right off the wall thus allowing the dresser to continue its fall. Furthermore, if the frame is presswood, it would not take much force to "rip off" the mounting screws securing the webbing or cable to the frame or back.

OBJECTS AND SUMMARY OF THE INVENTION

It is an object of at least one embodiment of the present invention to provide new and improved mechanisms for integrating or incorporating into pieces of furniture to prevent the furniture from tipping over.

It is another object of at least one embodiment of the present invention to provide a new and improved design configuration to reduce the likelihood of furniture from tipping over. It is another object of at least one embodiment of the present invention to provide a mechanism to significantly resist a baby or toddler from forcefully engaging an upper region of a dresser while approaching the dresser with an adequate stance to effect the possibility of causing danger to the baby or toddler.

It is yet another object of at least one embodiment of the present invention to provide a dresser that resists tipping when a top drawer of the dresser is open.

It is still another object of at least one embodiment of the present invention to provide a dresser that resists tipping when the toddler physically engages an open bottom drawer of the dresser or reaching the upper region of the dresser and pulling (tipping) it forward.

Another object of at least one embodiment of the present invention is to provide a dresser that resists tipping even when the toddler climbs on or into a bottom drawer region of the dresser.

A piece of furniture and an anti-tipping mechanism include a frame having a front and a rear, at least one drawer slidable through the front of the frame into and partly out of the frame, and a first L-shaped boot having a first elongate planar portion and a second planar portion shorter than the first planar portion with the second planar portion having a position at an angle to the first planar portion. First attachment means attach the second planar portion to a rear surface of the frame such that the second planar portion is alongside and in contact with the rear surface of the frame. The first planar portion is situated below the front and rear of the frame and has a size to extend forward of the front of the frame when the second planar portion is attached by the first attachment means to the rear surface of the frame to aid in preventing tipping of the piece of furniture.

The second planar portion may be fixed at an angle to the first planar portion, or hingedly connected thereto. The first attachment means may include at least one screw or bolt which fits through a respective aperture in the second planar portion. Part of the first planar portion that extends forward of the front of the frame may have contoured edges or be straight.

The first planar portion can have a variable height from a largest height at a forward end and a smallest height at or proximate an edge adjacent the second planar portion. More specifically, the first planar portion may have a uniformly varying height from the forward end and to the edge adjacent the second planar portion. In the latter case, the frame can include an upper board that provides an uppermost, exposed surface of the furniture, and which uppermost surface (or the board in its entirety) slopes downward from the rear of the frame to the front of the frame at an angle which is the same as an angle of change in height of the first planar portion. As such, when the first boot is under the frame, the upper board is parallel to a bottom surface of the first planar portion, i.e., parallel to the horizontal surface on which the piece of furniture is situated. Also, any drawers may be configured to open at the same angle. Another way to view this possibility is that the plane of the uppermost surface of the frame, and which is being considered the uppermost, exposed surface of the furniture, is at a non-parallel angle to the plane defined by the lowermost support surface of the frame, which may be provided by the bottom surfaces of the legs when present or the bottom surfaces of side panels when present. In most furniture pieces, the uppermost surface is parallel to the lowermost surface but since the frame of the invention will be tilted by the angled L-shaped boot, this tilting is compensated for by angling the upper board or at least the uppermost surface provided by the upper board.

When the frame includes a front leg at the front of the frame and a rear leg at a rear of the frame spaced apart from one another to provide a space between a front surface of the rear leg and a rear surface of the front leg, the first planar portion is below the front leg and the rear leg, possibly in contact with the lower/bottom surfaces of the front and rear legs.

When the frame includes a front left leg and a front right leg at the front of the frame spaced apart from one another and a rear left leg and a rear right leg at the rear of the frame spaced apart from one another, the front left leg is spaced apart from the rear left leg to provide a space between a front surface of the rear left leg and a rear surface of the front left leg, and the front right leg is spaced apart from the rear right leg to provide a space between a front surface of the rear right leg and a rear surface of the front right leg. The first planar portion of the first boot may be configured to extend below the front left leg and the rear left leg, and the first planar portion of the second boot may be configured to extend below the front right leg and the rear right leg. The second planar portion of the first and second boots is attached by the first and second attachment means to a rear surface of the rear left leg and a rear surface of the rear right leg, respectively.

For some pieces of furniture, a second L-shaped boot is provided just like the first L-shaped boot. The second planar portion of this second boot is attached to an additional, different rear surface of the frame such that the second planar portion is alongside and in contact with the additional rear surface of the frame.

A method for preventing tipping of a piece of furniture having at least one drawer slidable into and partly out of a frame of the piece of furniture includes placing a first L-shaped boot having a first elongate planar portion and a second planar portion shorter than the first planar portion under the frame such that the first planar portion is below both a front and rear of the frame and a portion of the first planar portion extends forward of the front of the frame. The second planar portion is attached to a rear surface of the frame such that the second planar portion is at an angle to the first planar portion and is alongside and in contact with the rear surface of the frame. These steps may be performed in any order. Tipping of the furniture arising from pressure exerted on the at least one drawer when partly out of the frame is hindered.

Attaching the second planar portion to a rear surface of the frame may entail inserting screws through respective apertures in the second planar portion into the frame. Placing the first L-shaped boot under the frame may entail placing the first L-shaped boot under a front leg at a front of the frame and a rear leg at a rear of the frame spaced apart from one another. Alternatively, for a different, wider construction of the L-shaped boot, placing the L-shaped boot under the frame may entail placing the first L-shaped boot under a front left leg and a front right leg at a front of the frame spaced apart from one another and a rear left leg and a rear right leg at a rear of the frame spaced apart from one another.

Preferably, for furniture with two sides and possibly two legs on each side, the method entails placing a second L-shaped boot having a first elongate planar portion and a second planar portion shorter than the first planar portion under the frame at a different location than the first L-shaped boot is placed such that the first planar portion of the second L-shaped boot is below both the front and rear of the frame and a portion of the first planar portion of the second L-shaped boot extends forward of the front of the frame. The second planar portion of the second L-shaped boot is attached to a different rear surface of the frame at a different location than the second planar portion of the first L-shaped boot is attached to the rear surface of the frame such that the second planar portion of the second L-shaped boot is at an angle to the first planar portion of the second L-shaped boot and is alongside and in contact with the different rear surface of the frame.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

One of the inventors' ideas to address the tipping problem of furniture in the presence of toddlers and children is that it is advantageous, instead of addressing attachment of a dresser or other piece of furniture to the wall against which it is placed, to address stability and retention of support legs of the furniture by attaching extensions or boots at least partly under and to the support legs to provide superior anti-tipping characteristics (for toddlers, parents, even TV stands). The extensions (having a form similar in appearance to a boot) provide a 16-18 inch deep dresser the ability to function as if it were 24-28 inches (depending on the length of the extensions). Various boots or extensions are disclosed below.

In the embodiments disclosed herein, a dresser including a plurality of drawers is often used as an example of a piece of furniture for which the anti-tipping mechanism may be used, and in which an anti-tipping mechanism may be integrated or incorporated. The anti-tipping mechanisms of the invention can be used on other types of furniture in addition to dressers and are not limited to use with only dressers. Also, the dressers may include one or more drawers in any of the sections therein.

Figure 1:
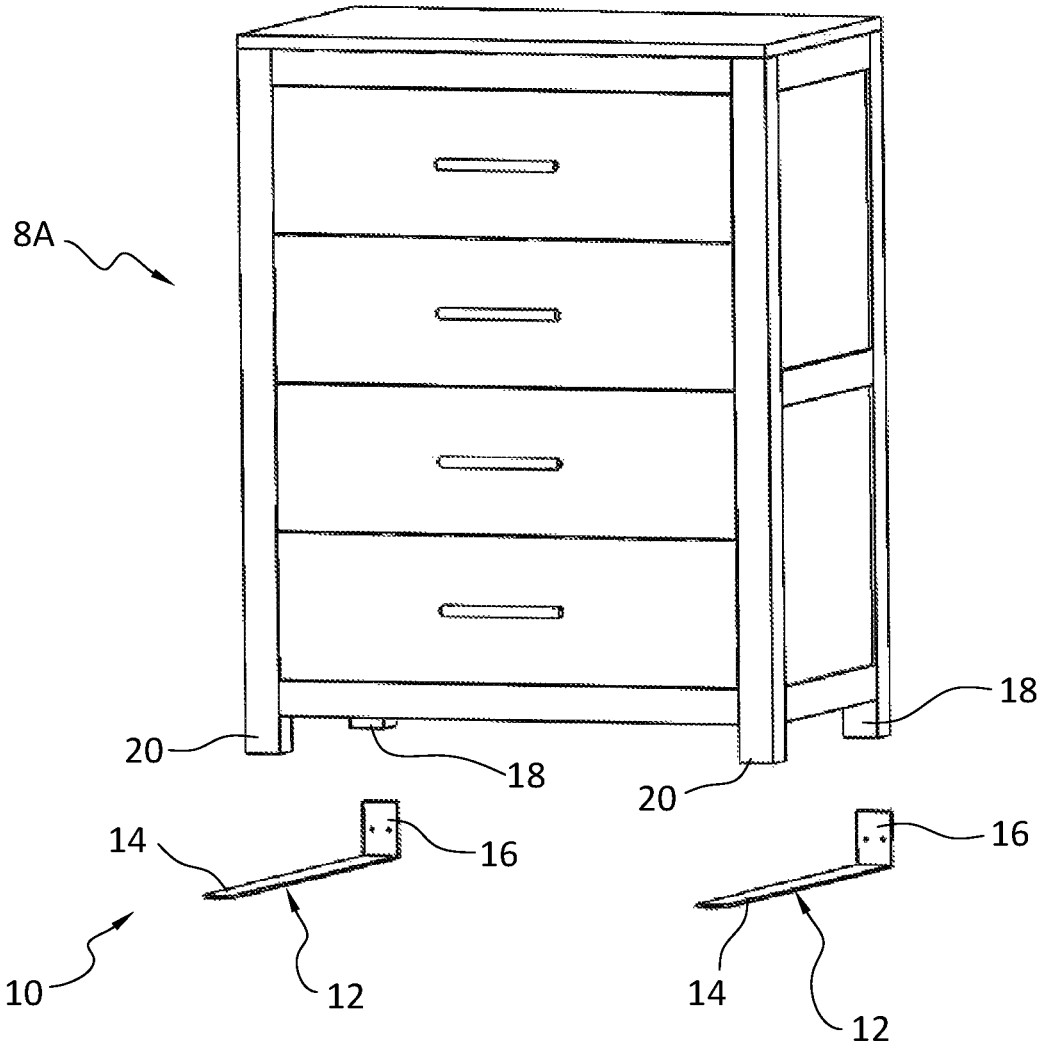
FIG. 1 is a perspective view of a dresser including a first embodiment of an anti-tipping mechanism in accordance with the invention shown detached from the dresser.
Figure 2:
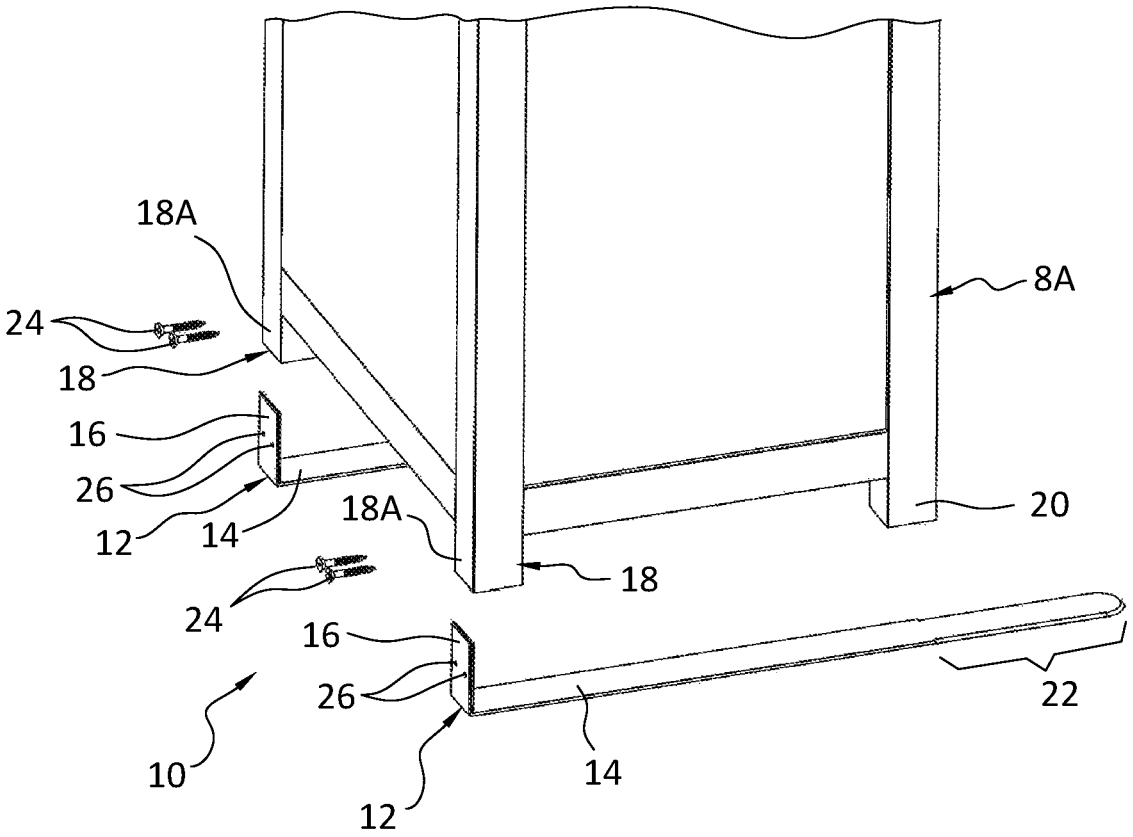
FIG. 2 is a rear perspective view of the dresser shown in FIG. 1 with the anti-tipping mechanism shown detached from the dresser.
Figure 3:
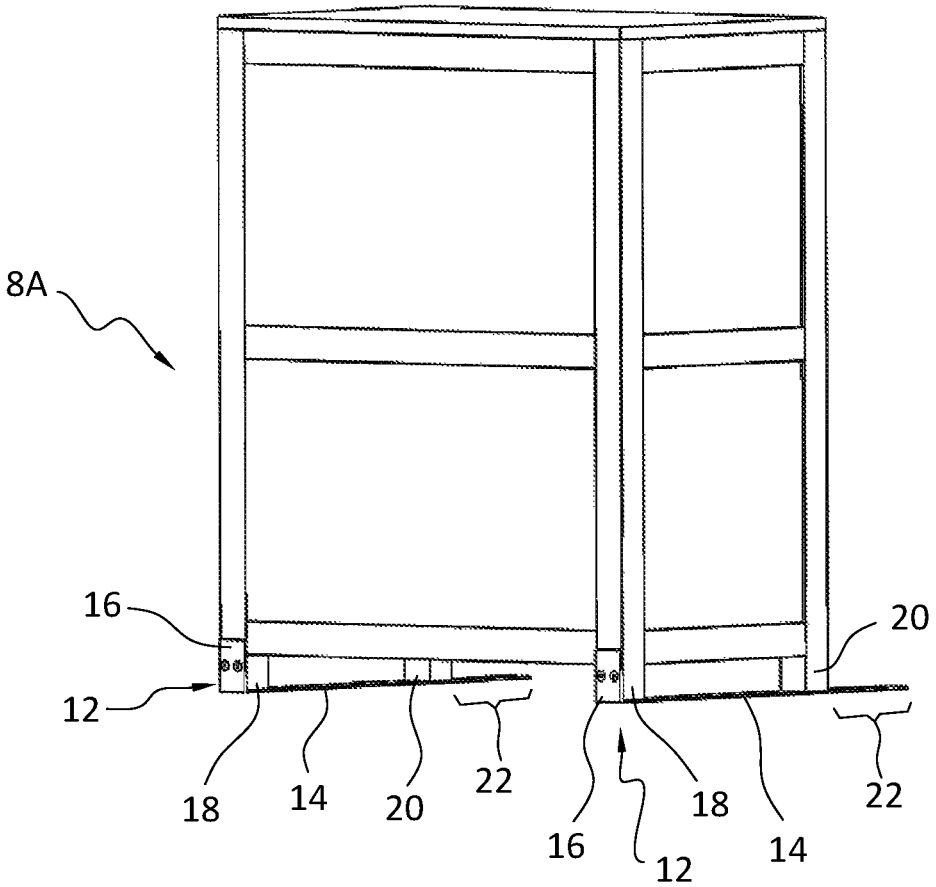
FIG. 3 is a rear view of the dresser shown in FIG. 1 with the anti-tipping mechanism attached to the dresser.

FIGS. 1-3 show a dresser 8A including a first embodiment of an anti-tipping mechanism in accordance with the invention designated generally as 10. Anti-tipping mechanism 10 includes a fixed angled L-shaped extension or boot 12 that has a first planar portion 14 and a second planar portion 16 at a fixed angle relative to the first planar portion 14. The planar portions 14, 16 may be rigid and permanently attached to one another so that the angle between them is not variable. The planar portions 14, 16 may be solid or hollow or have any construction that enables them to support the dresser 8A without being damaged. Also, the planar portions 14, 16 may be made of a sturdy, supportive material such as a type of metal such as stainless steel or electroplated carbon, etc. with 14 or 16 gauge as examples, or unbreakable plastic such as polycarbonate (for clear parts) or rigid nylon or Delrin (Acetal) for solid colors. Ideally, the plastic parts would have typical wall thicknesses ranging from about ⅛ inches to about 3/16 inches.

The first planar portion 14 is elongate and dimensioned relative to the dresser 8A (FIG. 1) it is to be used with so that when the second planar portion 16 attached to a rear surface 18A of a rear leg 18 of the dresser 8A, the first planar portion 14 extends a distance beyond the front leg 20 (this distance being represented as 22, see FIGS. 2 and 3). As such, it is envisioned to make a plurality of different L-shaped boots 12 to fit different sizes of dressers 8A. The legs 18, 20 are not required for a piece of furniture and may be provided by portions of a frame of the piece of furniture, i.e., leg portions of the frame, in which case, there may be a solid wall on the right and left sides of the frame with the L-shaped boot 12 being attached to the rear surface of the frame.

The angle between the first and second planar portions 14, 16 is dependent on the angle between the rear surface 18A of the rear leg 18 and the often horizontal surface on which the dresser 8A is to be placed. As shown, the fixed angle is about 90°, i.e., the second planar portion 16 is perpendicular to the first planar portion 14 which is to rest on the horizontal surface. The reason for this in the illustrated embodiment is because the bottom surface of the rear leg 18 is designed to lie flat against the horizontal surface when the dresser 8A is placed on the horizontal surface (of the L-shaped boot 12 were not present) and the rear surface 18A of the rear leg 18 is perpendicular to the bottom surface of the rear leg 18.

The angle however is determined by the shape of the rear leg 18 and specifically, the angle between the bottom surface of the rear leg 18 and the rear surface 18A of the rear leg 18 since it is desired that the surface of the second planar portion 16 be alongside and in contact with the rear surface 18A of the rear peg 18 after installation and during use. Another embodiment described below (FIGS. 4-6) provides for variability of the anti-tipping mechanism to addressed different angles.

The second planar portion 16 is attached to the rear surface 18A of the rear leg 18 to be in contact therewith by any suitable attachment means which provide a secure attachment of the L-shaped boot 12 to the rear leg 18. The anti-tipping mechanism 10 therefore comprises the boot 12 and the attachment means to attach the boot 12 to a piece of furniture.

As shown in FIG. 2, the attachment means comprise screws 24 which fit through apertures 26 in the second planar portion 16. One skilled in the art would appreciate that different attachment means may be used providing either a temporary or permanent attachment, e.g., nails or bolts. The attachment means should be selected to avoid separation of the rear leg 18 from the second planar portion 16 when a tipping force is exerted as this would frustrate the purpose of the L-shaped boots 12. Attachment means therefore may be construed as structure that provides for a secure attachment of one component to another component when a force is exerted on the other component. If bolts are used, a threaded insert may be pre-drilled and inserted in the rear of the rear leg 18. A screw, on the other hand, may be screwed into a starting hole formed in the rear leg 18.

In an exemplifying, non-limiting use, the L-shaped boot 12 may be attached to each rear leg 18 of the dresser 8A (see FIG. 3). The specific size L-shaped boot 12 is selected so that the first planar portion 14 thereof extends forward of the front leg 20. The longer the extension 22 of the first planar portion 14 forward of the front leg 20, the greater the resistance of the dresser 8A to tipping. In an attempt to tip the dresser 8A, there would be a downward force exerted against the extended portion 22 of the first planar portion 14 forward of the front leg 20 and this would hinder tipping of the dresser 8A.

One skilled in the art would be able to determine the distance of the extended portion 22 of the first planar portion 14 forward of the front leg 20 relative to characteristics of the dresser 8A, e.g., the height of the dresser 8A, the depth of the dresser 8A, the weight of the dresser 8A, and the number of drawers in the dresser 8A. As an example, if the dresser 8A has seven drawers, and is five feet high and nineteen inches deep (such dimensions being typical of a tippable dresser), then the L-shaped boots 12 should extend a number of inches forward of the dresser 8A to provide tip resistance. The more forward the L-shaped boots 12 extend, the more resistance to tip is provided to the dresser 8A.

The extended portion 22 has edges that may be contoured, e.g., curved and tapered to present a smooth surface as someone might walk over the extended portion 22. The front edge of the extended portion 22, i.e., the front edge of the first planar portion 14 of the L-shaped boot 12 may be in the shape of a semi-circular. It is envisioned that in some uses, the extended portion 22 is positioned underneath carpet or other floor covering to hide the extended portion 22. Placing them under a firm carpet may further assist in resisting tipping.

Boots 12, and other boots or extensions disclosed herein can be produced in plastic, as well as metal. In plastic, there can be the nice tapered edges on the front of the parts, however, if produced from metal, it may be desirable to use a typical stock of 16 gauge (0.060") or 14 gauge (0.0781") stainless steel or electroplated carbon steel. The boots 12 may be constructed with or without any edges being tapered, and with a rounded or square front, etc.

The invention also encompasses the combination of a piece of furniture, i.e., dresser 8A, and an anti-tipping mechanism, i.e., one or more of the L-shaped boots 12. Such a combination includes a frame having a front, and a rear. At least one drawer is slidable through the front of the frame into and partly out of the frame (not numbered in FIG. 1). The second planar portion 16 is attached to a rear surface of the frame, not specifically to the rear leg 18 since the rear leg 18 may not be present for all pieces of furniture with which the invention may be used, and when so attached, the second planar portion 16 is alongside and in contact with the rear surface of the frame (see FIG. 3). The first planar portion 14 is situated below the front and rear of the frame and has a size to extend forward of the front of the frame when the second planar portion 16 is attached to the rear surface of the frame to aid in preventing tipping of the dresser 8A (see FIGS. 1-3).

In the non-limiting illustrated embodiment, the frame includes a front leg 20 at the front of the frame and a rear leg 18 at a rear of the frame spaced apart from one another to provide a space between a front surface of the rear leg 18 and a rear surface of the front leg 20. In this case, the first planar portion 16 is below the front leg 20 and the rear leg 20, and possibly in contact with the lower/bottom surfaces of the rear and front legs 18, 20. When the dresser 8A has four legs as shown, two L-shaped boots 12 are used, one for each set of front/rear legs.

However, a single L-shaped boot may be used, as described below in connection with FIG. 11A wherein the first planar portion of the singular L-shaped boot is below, and possibly in contact with, the lower/bottom surfaces of both front legs 20 and the lower/bottom surfaces of both rear legs 18.

When the dresser or other piece of furniture does not have any legs that extend below the lower surface of the frame of the piece of furniture, then the front and rear lower support surfaces are formed by the lower surface of the frame that is configured to rest on and in contact with a horizontal surface supporting the piece of furniture. Alternatively, there may be side supports that extend from the front to rear of the frame along its sides and these side supports provide the front and rear lower support surfaces of the frame. The L-shaped boots 12 are therefore below the front and rear of the frame, and possibly in contact with the lower/bottom surfaces of the frame that would otherwise be in contact with the floor or other horizontal surface on which the piece of furniture is placed. The front of the frame is the front facing region where the front panels of the drawers are, while the rear of the fame is the rear facing region designed to abut against a wall or other vertical support.

Figure 4:
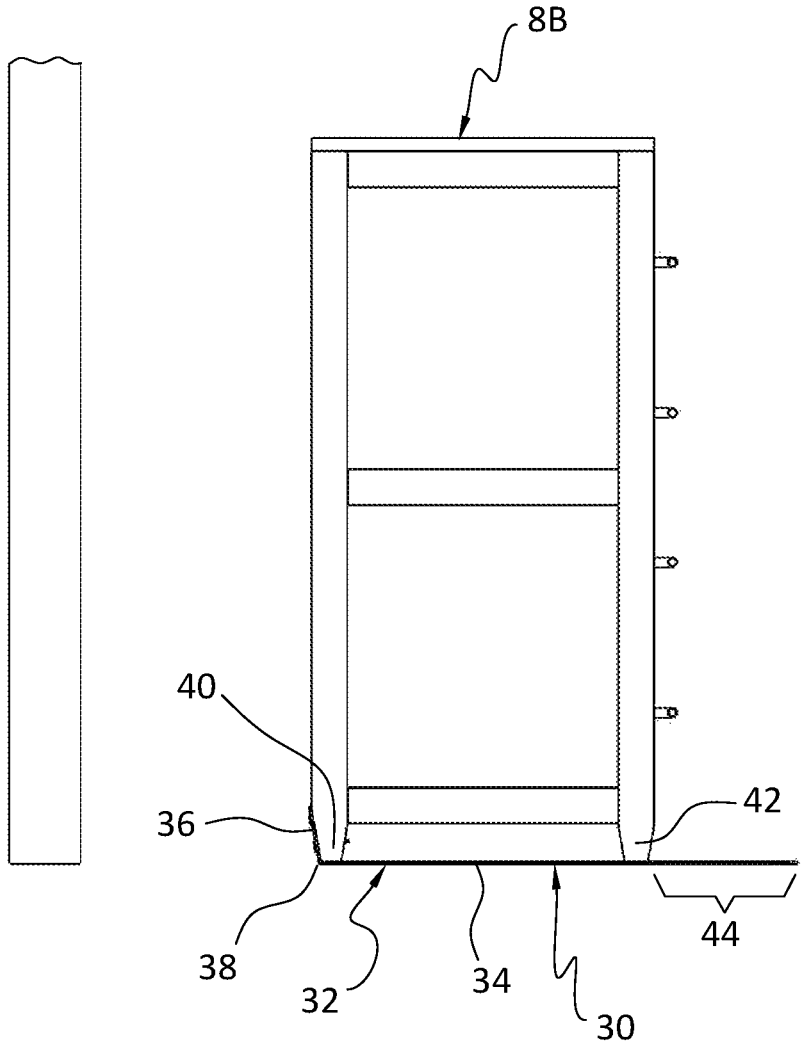
FIG. 4 is a side view of a dresser including a second embodiment of an anti-tipping mechanism in accordance with the invention shown attached to the dresser.
Figure 5:
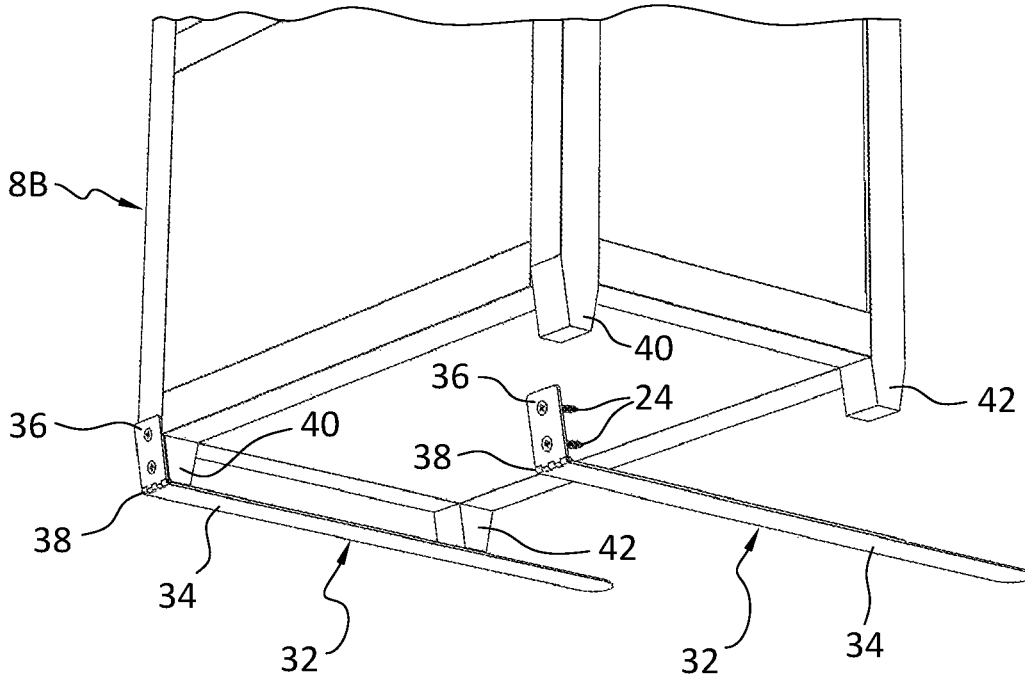
FIG. 5 is a rear perspective view of the dresser shown in FIG. 4 with the anti-tipping mechanism shown attached to the dresser.
Figure 6:
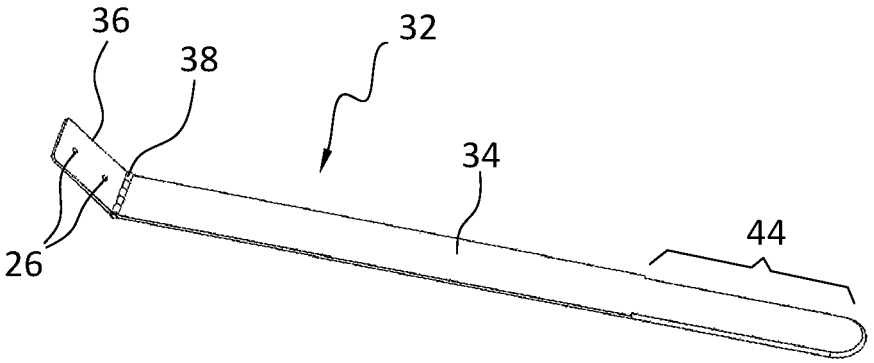
FIG. 6 is a perspective view of a part of the second embodiment of the anti-tipping mechanism.

FIGS. 4-6 show another anti-tipping mechanism in accordance with the invention which is designated 30 and includes an extension or boot 32 having first and second planar portions 34, 36 that are not rigidly fixed to one another (as in boot 12 in FIGS. 1-3), but rather are pivotally connected to one another by a hinge mechanism 38. Hinge mechanism 38 allows the second planar portion 36 to move to different angles and different angular positions relative to the first planar portion 34.

A primary advantage of the use of hinge mechanism 38 rotatably connecting the first and second planar portions 34, 36 is to account for different angles between the bottom surface of the rear leg 40 and the rear surface of the rear leg 40 of the dresser 8B. In the embodiment of FIGS. 1-3, this angle was about 90 degrees, but sometimes in actuality, the angle is different than 90 degrees, usually greater than 90 degrees. For example, as shown in FIGS. 4 and 5, the angle is about 110 degrees. Therefore, use of the fixed angle L-shaped boot 12 is not possible for the dresser 8B shown in FIGS. 4 and 5. Rather, variable angle, hinged boot 32 must be used. Hinged boot 32 has the advantage over the boot 12 insofar as it will accommodate most angles of the rear legs 40. It is estimated that fixed 90 degree boots, i.e., boot 12, will fit about 75% to about 90% of all existing dressers.

The first planar portion 34 is elongate and dimensioned relative to the dresser 8B, or other piece of furniture it is to be used with, so that when attached to the rear surface of the rear leg 40, the first planar portion 34 extends a distance beyond the front leg 42, this distance being represented as 44, see FIGS. 4 and 5. As such, it is envisioned to make a plurality of different boots 32 to fit different sizes of dressers 8B.

The planar portions 34, 36 may be solid or hollow or have any construction that enables them to support the dresser 8B without being damaged. Also, the planar portions 34, 36 may be made of a sturdy, supportive substantially unbreakable material.

In use, the angle to which the second planar portion 36 is pivoted relative to the first planar portion 34 is dependent on the angle between the rear surface of the rear leg 40 and the horizontal surface on which the dresser 8B is to be placed. The angle is thus determined by the shape of the rear leg 40 and specifically, the angle between the bottom surface of the rear leg 40 and the rear surface of the rear leg 40.

Hinge mechanism 38 may be any conventional hinge or pivot-providing structure that enables movement of one member relative to another to different angular positions. In a basic construction, hinge mechanism 38 includes a first part attached to the first planar portion 34 and a second part attached to the second planar portion 36 and one or more pivot pins between these parts, and possibly attached to only one of the parts.

The second planar portion 36 could, in a storage or shipping state, be pivoted against the first planar portion 34, i.e., the forward-facing surface of the second planar portion 36 is against the upper surface of the first planar portion 34, and then for installation, raised from this position to the necessary angle. The installer would position the second planar portion 36 against the rear surface of the rear leg 40 and then attach the screws 24 through apertures (which apertures 26 can be seen in FIG. 6), or using other attachment means. The anti-tipping mechanism 30 therefore comprises the boot 32 and the attachment means to attach the boot 32 to a piece of furniture.

In an exemplifying, non-limiting use, a boot 32 may be attached to each rear leg 40 of the dresser 8B (see FIG. 5). The specific size boot 32 is selected so that the first planar portion 34 thereof extends forward of the front leg 42. The longer the extension 44 of the first planar portion 34 forward of the front leg 42, the greater the resistance of the dresser 8B to tipping. In an attempt to tip the dresser 8B, there would be a downward force exerted against the extended portion 44 of the first planar portion 34 forward of the front leg 42 and this would hinder tipping of the dresser 8B.

One skilled in the art would be able to determine the distance of the extended portion 44 of the first planar portion 34 forward of the front leg 42 relative to characteristics of the furniture, e.g., the height of the dresser 8B, the depth of the dresser 8B, the weight of the dresser 8B, and the number of drawers in the dresser 8B. As an example, if the dresser 8B has seven drawers, and is five feet high and nineteen inches deep (such dimensions being typical of a tippable dresser), then the boots 32 should extend a number of inches forward of the dresser 8B to provide tip resistance.

Each planar section 34, 36 may have a wall thickness between about 0.100 inches and about 0.187 inches for flex resistance and rigidity. The boot 32 may be produced from sturdy unbreakable polycarbonate, e.g., for clear parts, Nylon, glass filled ABS and Acetal for opaque engineering thermo-plastics.

The extended portion 44 has edges that may be contoured, e.g., curved and tapered to present a smooth surface as someone might walk over the extended portion 44. The front edge of the extended portion 44, i.e., the front edge of the first planar portion 34 of the L-shaped boot 32 may be in the shape of a semi-circular and tapered down to an edge to resist possibly accidental tripping. It is envisioned that in some uses, the extended portion 44 is positioned underneath carpet or other floor covering to hide the extended portion 44. Ideally, this soothes things out and eliminates the chance of tripping.

FIGS. 7-11 show another embodiment of an anti-tipping mechanism designated 50 and which includes a different extension or boot 52 than either boot 12 or boot 32, but also includes attachment means. Differing from boot 32, boot 52 includes a first planar portion 54 that has a variable height, with the largest height at the end of extended portion or extension 56 and the smallest height at or proximate the edge adjacent the hinge mechanism 38 (see FIG. 9). The height may vary uniformly from the end of extension 56 to the hinge mechanism 38. Such a variable height planar portion 54 could nevertheless be provided on boot 12 if so desired.

Figure 10:
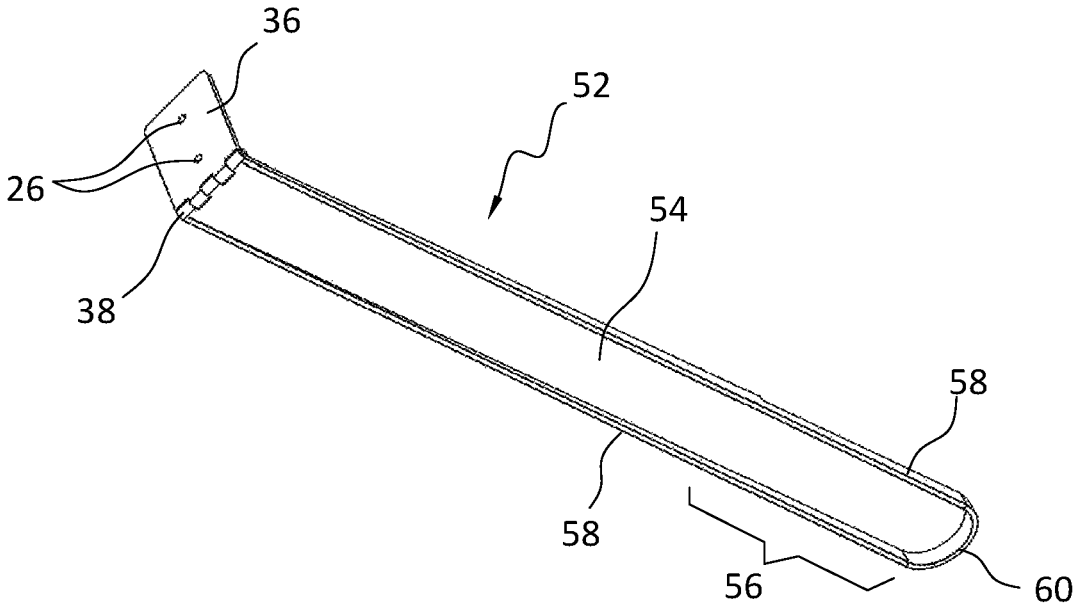
FIG. 10 is a bottom perspective view of a part of the third embodiment of the anti-tipping mechanism.

In the illustrated embodiment, the boot 52 has elongate, straight side ribs 58 and a front rib 60 connecting the front ends of the side ribs 58 to provide a horizontal support surface at a lower edge of the first planar portion 54 (see FIG. 10). The first planar portion 54 thus overlies a hollow cavity defined by the lower surface of the first planar portion 54 at the top, the inner surface of the side ribs 58 on the lateral sides, and the inner surface of the front rib 60 at the front, and possibly by the hinge mechanism 38 at the rear. Alternatively, the first planar portion 54 may be a solid.

Figure 7:
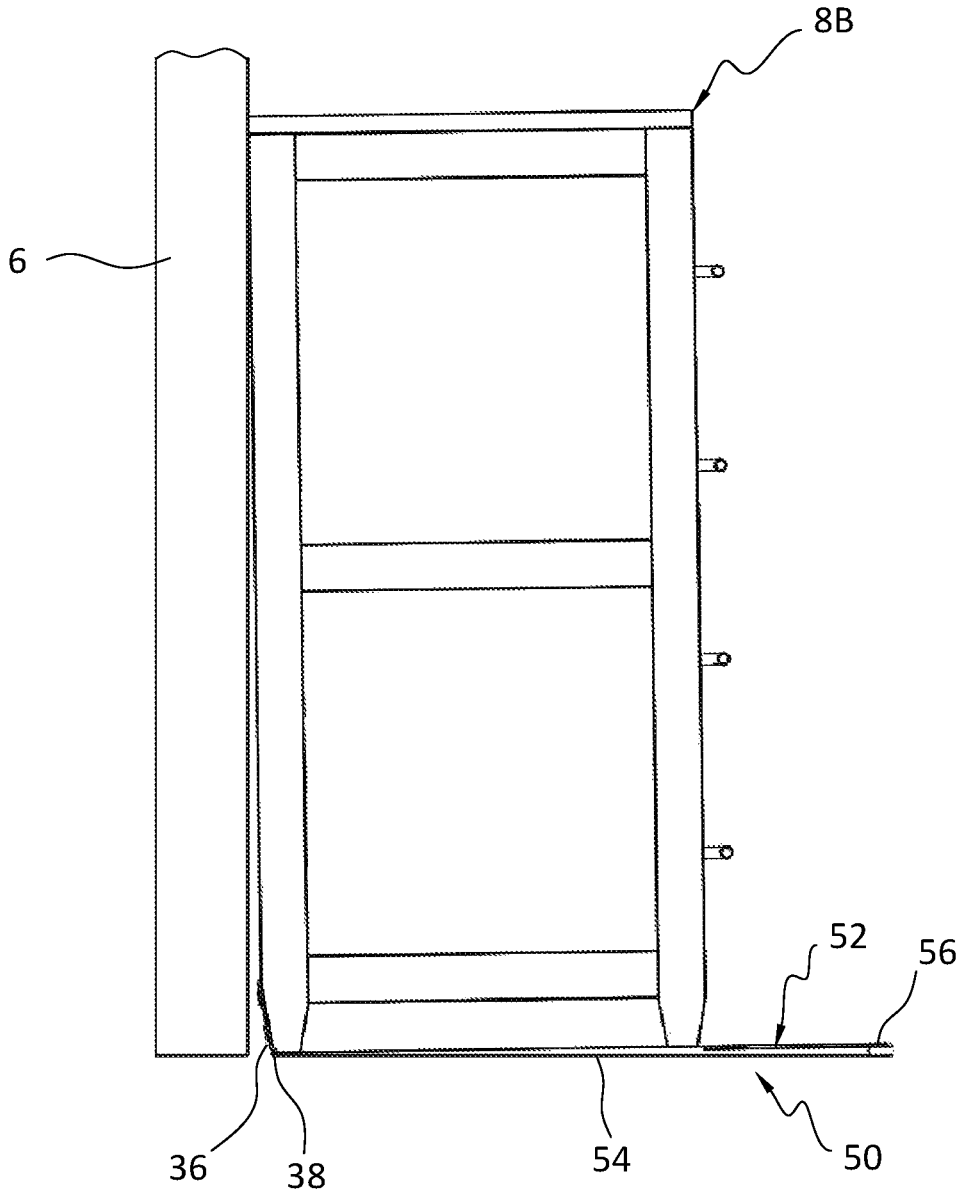
FIG. 7 is a side view of a dresser including a third embodiment of an anti-tipping mechanism in accordance with the invention shown attached to the dresser.
Figure 8:
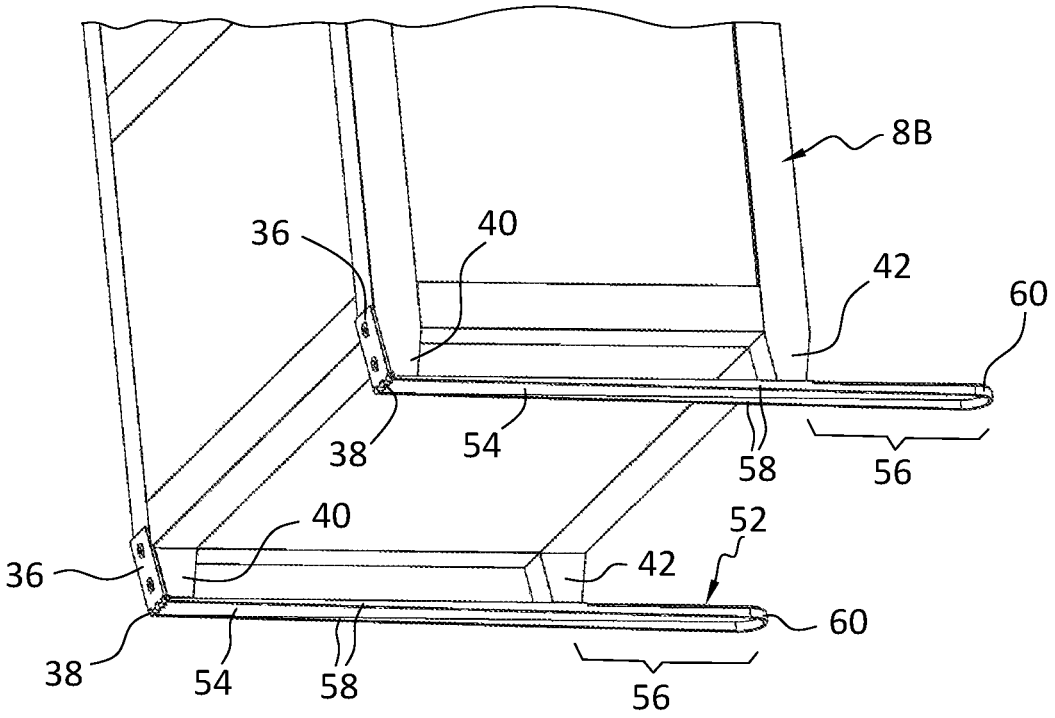
FIG. 8 is a rear perspective view of the dresser shown in FIG. 7 with the anti-tipping mechanism shown attached to the dresser.
Figure 9:
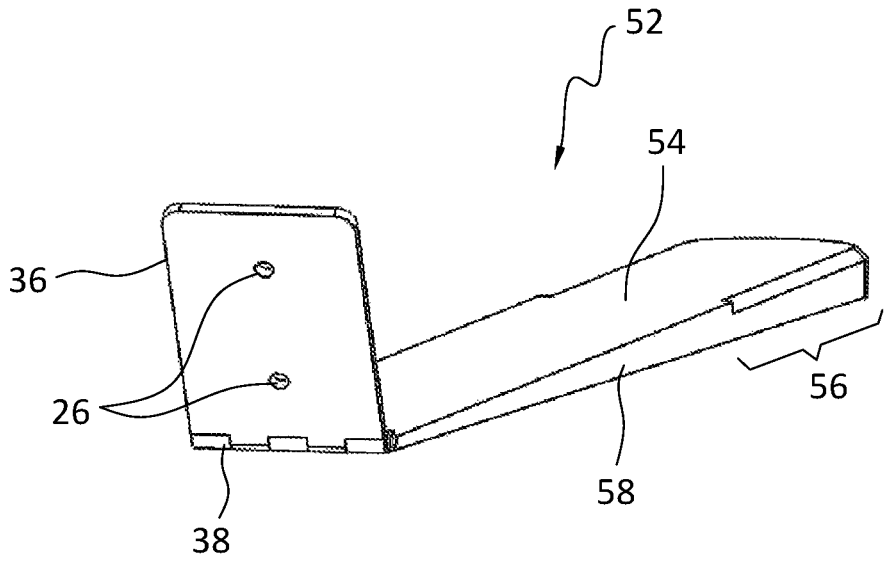
FIG. 9 is a top perspective view of a part of the third embodiment of the anti-tipping mechanism.
Figure 11:
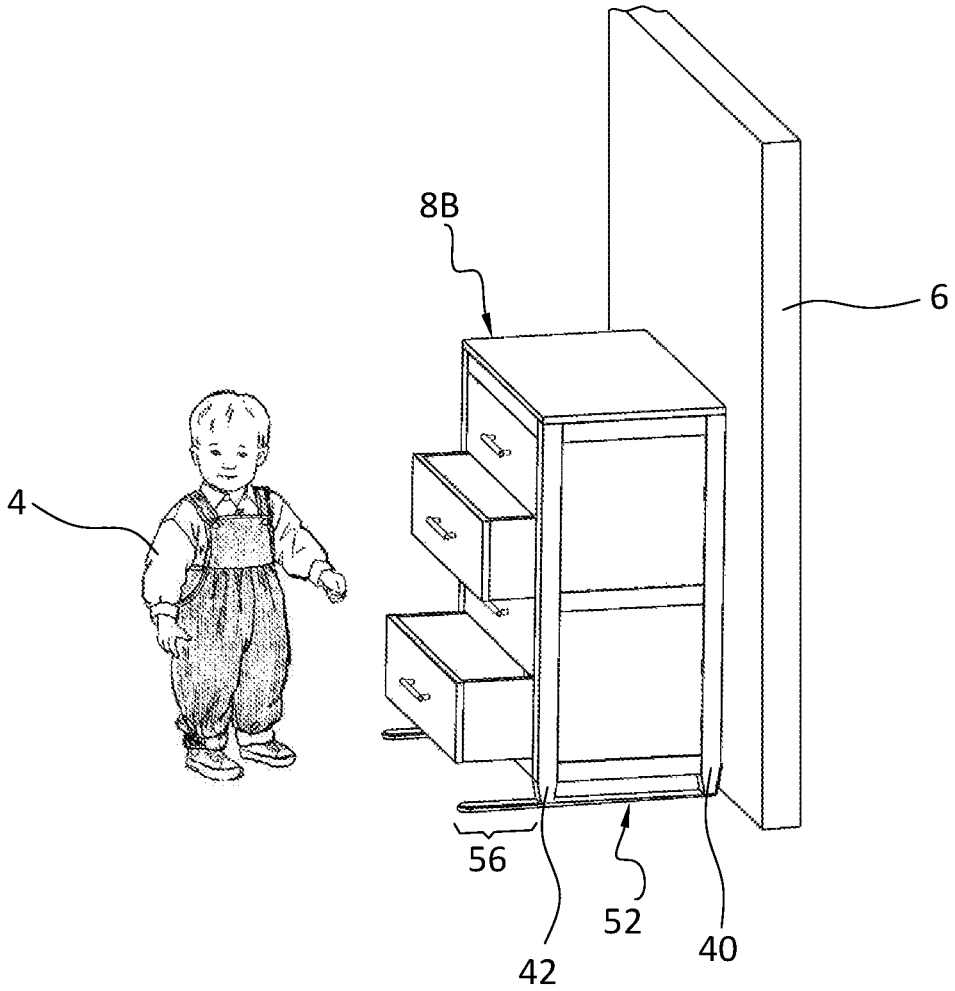
FIG. 11 is a side view of the dresser shown in FIG. 7 with a toddler in front potentially about to try to tip over the dresser.

This variable height results in the dresser 8B, when placed with its rear leg 40 and front leg 42 on the boot 52 as shown in FIGS. 7, 8 and 11, being slightly tilted rearward so that it is able to come into contact with a vertical wall 6 against which it is placed only at an upper portion (see in particular FIG. 7). Dresser 8B will not come into contact with the vertical wall 6 at the lower portion but rather will be spaced apart from the vertical wall 6 at the lower portion (see FIG. 7). The distance between the wall 6 and the rear of the dresser 8B increases in the direction from the top of the dresser 8B to the bottom of the dresser 8B. This rearward slanting of the dresser 8B resulting from the variable height boot 52 improves the tip resistance when a toddler or child 4 may try to pull the front of the dresser 8B (see FIG. 11).

The extension 56 has edges that may be contoured, e.g., curved to present a smooth surface as someone might walk over the extension 56. It is envisioned that in some uses, the extension 56 is positioned underneath carpet or other floor covering to hide the extension 56.

In the embodiments described above, the boots 12, 32, 52 are attached to the rear surface of the rear leg of the furniture. These uses are exemplifying only and do not limit the use of the boots 12, 32, 52. In some embodiments, it is envisioned that the boots 12, 32, 52 may be attached to another part of the furniture, e.g., the rear panel or rear wall of the furniture. In such cases, the legs 12, 32, 52 may extend forward of the front wall or front panel of the furniture at a location between the front legs, essentially sticking out in a middle region of and below the front wall or front panel. A single boot 12, 32, 52 may be used in these situations and would not be connected to the rear legs. The same attachment mechanism, e.g., screws, may be used to attach the boot 12, 32, 52 to the rear panel or rear wall of the furniture.

Figure 11A:
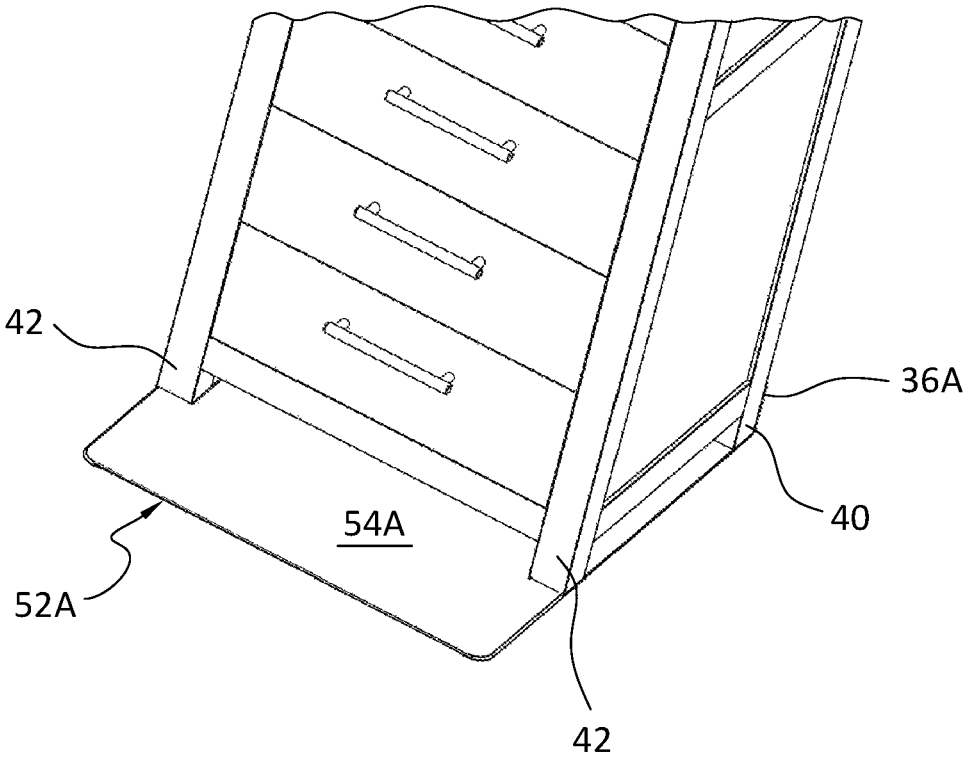
FIG. 11A is a perspective view of the dresser shown in FIG. 7 with a variant of the anti-tipping mechanism.

As shown in FIG. 11A, another embodiment wherein a single boot 52A is used is illustrated. This single boot 52A may have the form of boot 12, boot 32 or boot 52 and is preferably configured to have a width extending from the outer left side surfaces of the left set of legs 40, 42 to the outer right side surfaces of the right set of legs 40, 42. The boot 52A therefore extends from the right to left sides of the frame. As such, the single boot 52A will extend below all of the legs 40, 42, or under the left and rights sides of the furniture if there are no legs and only leg portions formed by the frame. The boot 52A may have a planar portion 54A which extends below all of the legs 40, 42, and which planar portion 54A may be angled as in boot 52.

Boot 52A also includes the planar portion(s) 36A at its rear that are used to attach the boot 52 to the furniture, e.g., the rear surfaces of the rear legs 40 or more generally the rear surfaces of the frame. There may be a single planar portion 36A that extends across the entire length of the boot 52, i.e., it would have the same width as the underlying planar portion 54A of the boot 52, or there may be two, spaced apart planar portions 36A that each only extend behind a respective one of the rear legs 40. These planar portions 36A may be rigid with the underlying planar portion 54A of the boot 52A as in boot 12, or pivotally attached thereto by hinges as in boot 32. In either situation, both rear legs 40 are attached to the same boot 52A.

The width of the boots 12, 32, 52 may also vary from that shown but be less than the full width of the furniture as in boot 52A shown in FIG. 11A. The width of the boots 12, 32, 52 may be 2 inches, 4 inches, 6 inches or 8 inches, for example, Other widths are also possible.

Figure 12:
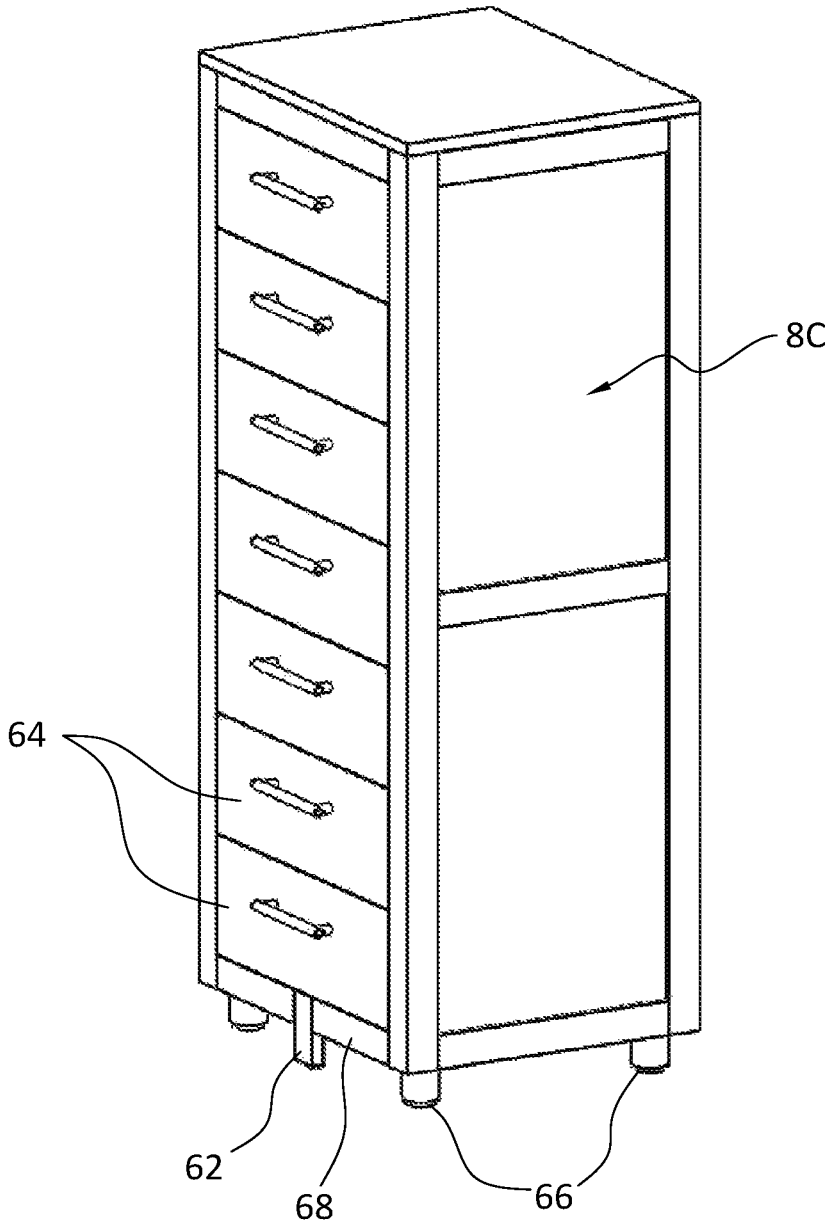
FIG. 12 is a front perspective view of a dresser including another embodiment of an anti-tipping mechanism in accordance with the invention.
Figure 13:
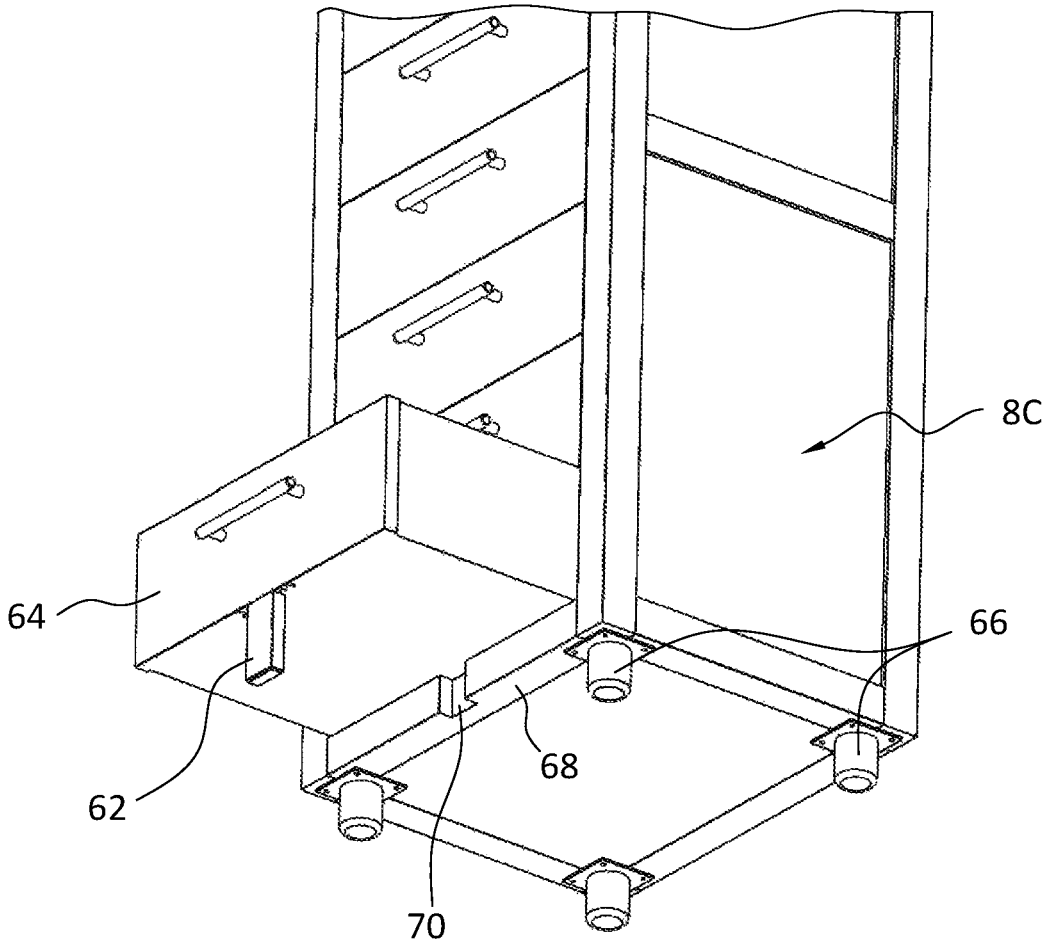
FIG. 13 is a bottom perspective view of the dresser shown in FIG. 12 with the bottom drawer in an open state.

FIGS. 12 and 13 show another embodiment of an anti-tipping mechanism in accordance with the invention which includes a fixed post 62 on the bottom drawer 64 of a dresser 8C. The fixed post 62 is rigid and is attached or integral with the bottom drawer 64 so as to provide a potential additional support point for the dresser 8C, along with support legs 66. Thus, the bottom surface of the fixed post 62 should be dimensioned to be close to the surface on which the dresser 8C is situated. Fixed post 62 serves to prevent forward tipping of the dresser 8C. The molding 68 on the dresser 8C ideally includes a cut-out 70 for the fixed post 62 (see FIG. 13).

As to this embodiment and other disclosed embodiments that have one or more fixed posts to the bottom drawer 64, this provides anti-tipping with the bottom drawer 64 when opened. Should a toddler climb into the bottom drawer 64, there would be resistance for the drawer 64 to fall forward. Each fixed post 62 is ideally at least about 0.25 inches shorter than the support legs 66 so when the bottom drawer 64 is opened, the fixed posts 62 do not interfere with drawer functionality. Since the distance to the floor is only about 0.25 inches, should a toddler climb into the drawer 64, the dresser 8C will only slightly fall forward.

Instead of a fixed post, a post could be pivotable between a position under the bottom drawer to an extended position.

Figure 14:
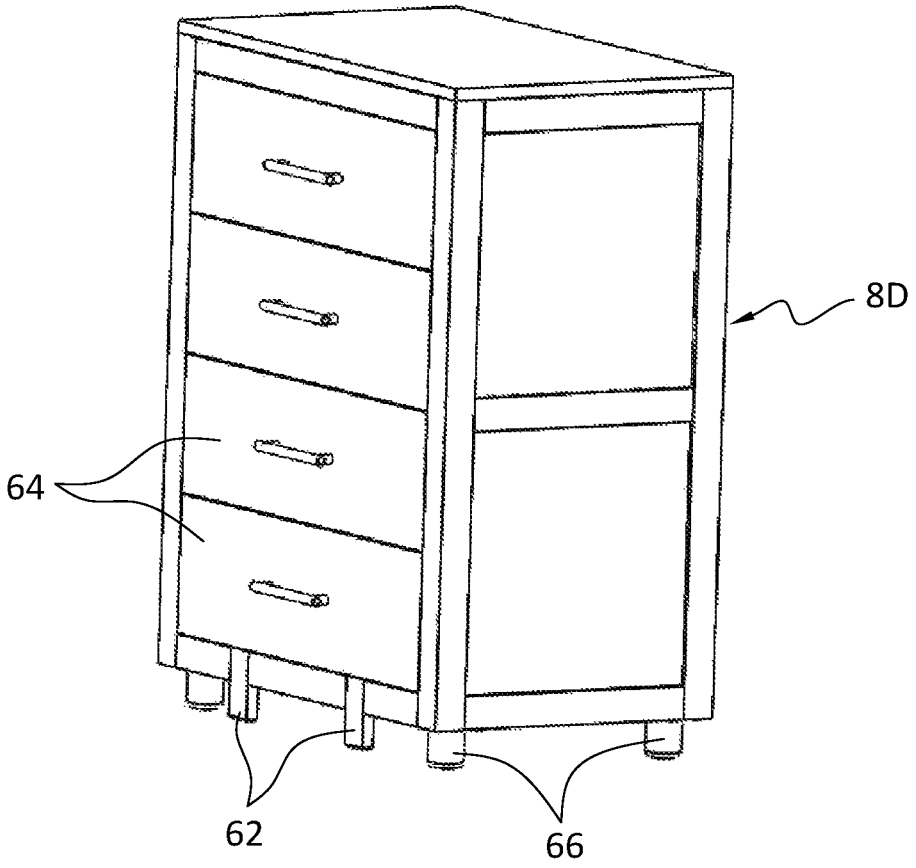
FIG. 14 is a front perspective view of a dresser including another embodiment of an anti-tipping mechanism in accordance with the invention.
Figure 15:
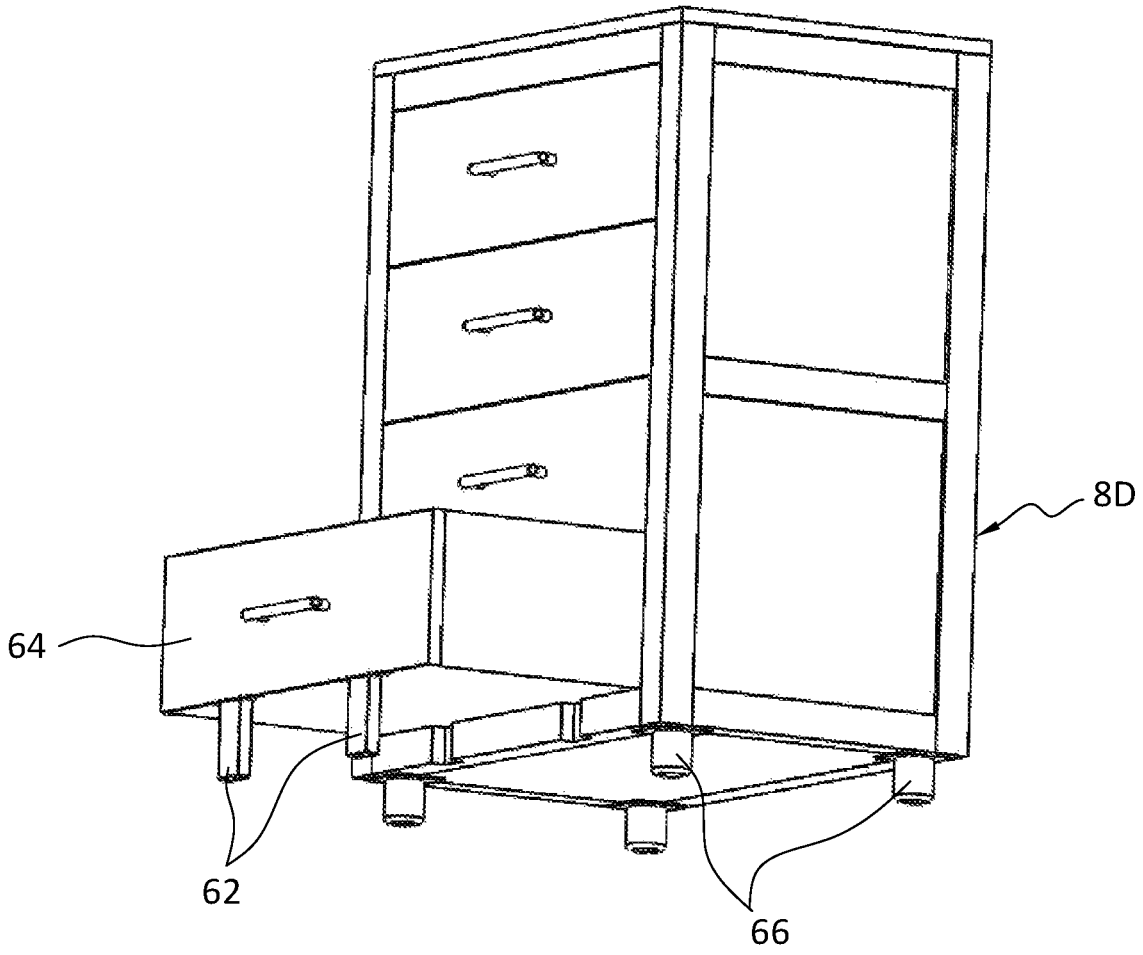
FIG. 15 is a front perspective view of the dresser shown in FIG. 14 with the bottom drawer in an open state.

While a single central fixed post as shown in FIGS. 12 and 13 will likely prevent an accident, an anti-tipping mechanism including two fixed posts 62 on the bottom drawer 64 of the dresser 8D will offer more positive floor surface engagement and resist cocking the dresser to pivot to one side, and is shown in the embodiment of in FIGS. 14 and 15. Ideally, the two posts 62 are placed a distance sufficiently apart from one another to provide stability as the drawer 64 tips about 0.25 inches forward and positively stops falling any further.

In many situations where the toddler is under 2 years old, it may very well be that he/she may not be able to reach any higher than the bottom drawer 64. If on the other hand, the toddler is 3, 4 or 5 years old, a superior choice may be to go with one of the boots disclosed herein. An embodiment of a dresser is also envisioned which includes both the boots as well as one or more fixed posts 62 for double anti-tipping insurance.

Figure 16:
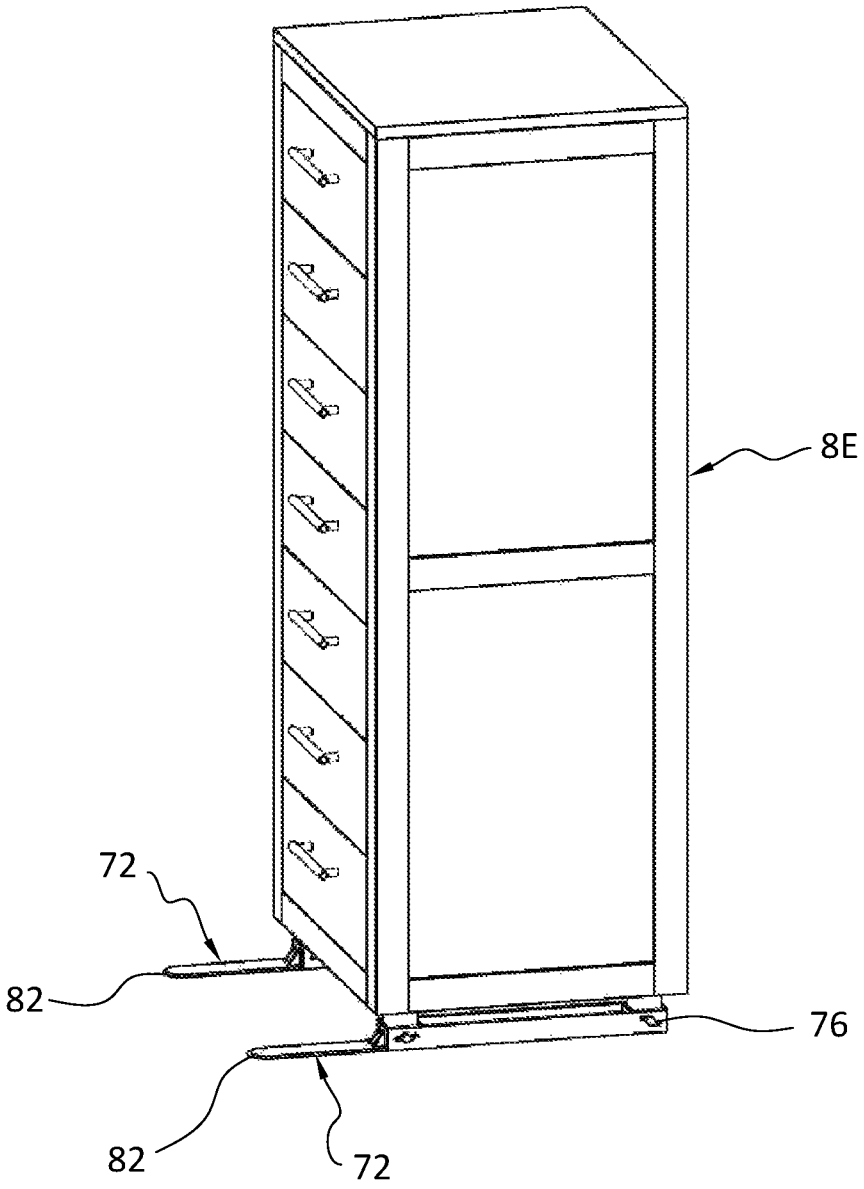
FIG. 16 is a side perspective view of a dresser including another embodiment of an anti-tipping mechanism in accordance with the invention.
Figure 17:
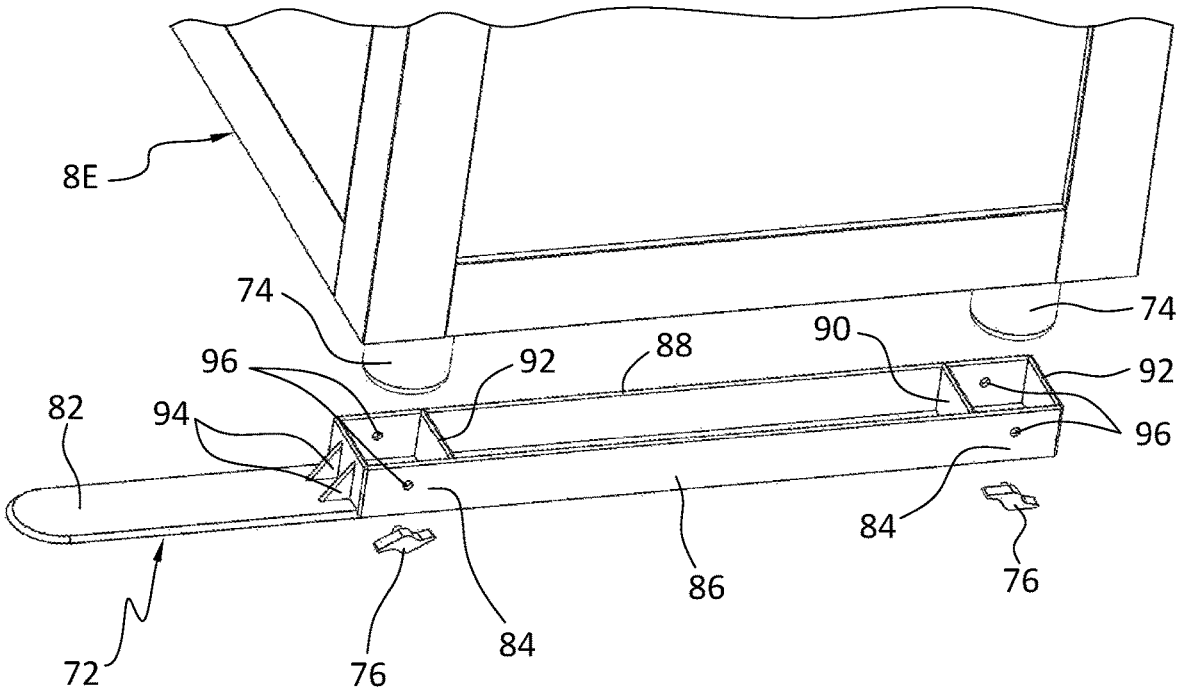
FIG. 17 is a view of the anti-tipping mechanism of FIG. 16.
Figure 18:
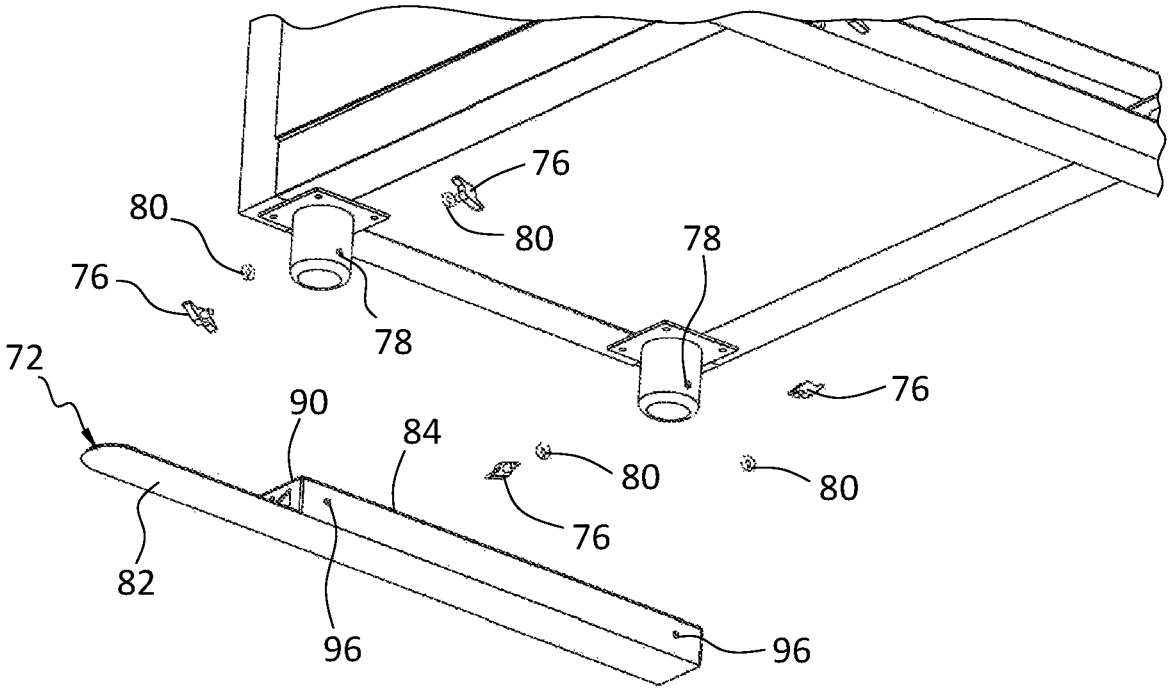
FIG. 18 is a bottom perspective view showing attachment of the anti-tipping mechanism of FIGS. 16 and 17 in connection with legs of a dresser having apertures.

FIGS. 16-18 show another embodiment of a mechanism for preventing tipping of a dresser 8E which includes a boot 72 attached to the forward and rearward (front and back) support legs 74.

Boot 72 are mountable to the outside of the support legs 74, the inside of the support legs 74 and secured with tightening wing nuts 76 that either tighten flush to the support legs 74 (FIGS. 16 and 18) or even more positively, enter corresponding holes 78 in the support legs 74 that mate up with the thread of the wing nut screw which provide further insurance that the boots 72 are securely in place (such holes 78 being shown in FIG. 18). Lock washers 80 may be provided between the wing nuts 76 and the surfaces of the boots 72 (FIG. 18) for positive lock tight engagement.

Each boot 72 includes a bottom portion 82 that is configured to include an extension portion which extends forward of the front support leg 74 and retaining structure 84 to retain each support leg 74 that interacts with the boot 72 (two retaining structure 84 in the illustrated embodiment). Each retaining structure 84 includes one or more walls that cooperate to surround the support leg 74 and provide access to the wing nut 76 to enable it to be tightened against the support leg 74 through holes 78. The boot 72 has a bottom flange portion extending laterally from a first location of the forward retaining structure 84, this location being the location at which a portion of the support leg 74 is received by the retaining structure 84.

The retaining structure 84 may include an outside vertical wall 86 extending upward from the bottom portion 82 and an inside vertical wall 88 extending upward from the bottom portion 82 a distance from the outside vertical wall 86 that is equal to or slightly larger than the thickness of the support leg 74 to be retained by the retaining structure 84. The outside wall is that wall that will be seen from a side view of the dresser 8E. The boots 72 are generally symmetric.

Lateral walls 90, 92 are also provided extending between the inside and outside vertical walls 88, 86, spaced apart a distance that is equal to or slightly larger than the thickness of the support leg 74 to be retained by the retaining structure 84. Instead of four walls, an alternative number of walls may be provided, e.g., a single circular wall or six walls forming a hexagon.

One or more reinforcement ribs 94 may be provided between the forwardmost lateral wall 90 of the forwardmost retaining structure 84 and the extension portion of the bottom portion 82. Lateral walls 86, 88 also include holes 96 for the wing nuts 76, see FIG. 17, and that align with the holes 78 in the support legs 74 if present (see FIG. 18). It is possible to form an extension without the rear wall 92 of the forward retaining structure 84 and without the forward wall 90 of the rear retaining structure 84.

Removal of the boot 72 from engagement with the support legs 74 is possible by turning the wing nuts 76 and releasing their pressing force against the support legs 74.

The presence of the extension portion of the bottom portion 82, forward of the front leg, functions in the same manner as described above with respect to FIGS. 1-11A. The size of the extension portion of the bottom portion 82 may also be as described above for the extension portions of the boots 12, 32, 52.

Figure 19:
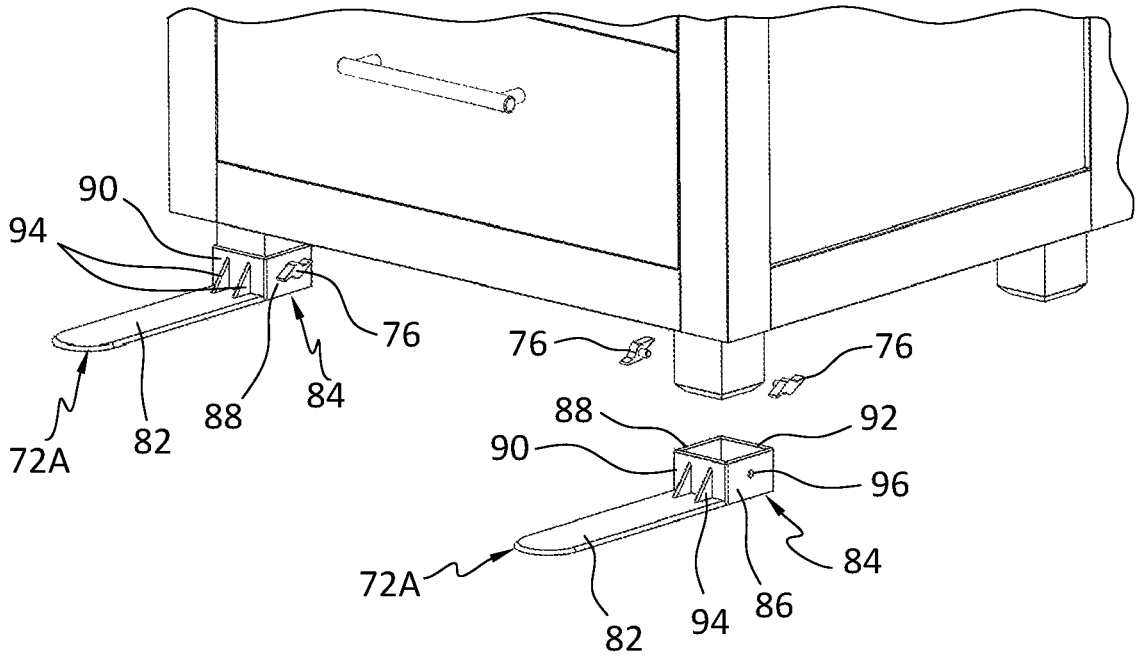
FIG. 19 is a front perspective view of part of a dresser including another embodiment of an anti-tipping mechanism in accordance with the invention.

FIGS. 16-18 show an embodiment wherein the boot 72 is designed to accept two support legs 74, one in the front of the dresser 8E and one in the rear of the dresser 8E behind the front support leg 74. By contrast, FIG. 19 shows an embodiment wherein the boot or boot 72A is designed to accept only a single support leg 74 in the front of the dresser 8E. A therefore includes only a single retention structure 84.

Wing nuts 76 may be considered tightening means that serve to tighten the boot 72 (or 72A) to the support leg 74. Other comparable tightening structure may be used. The tightening structure or means may depend on which the support legs 74 of the dresser 8E have holes 78 or not. If there are no holes 78, then the tightening means should be designed to press against the support legs 74, so that when pressed in opposite direction by tightening means on opposite sides of the support legs 74, the support legs 74 are secured in connection with the boot 72 (or 72A). Holes 78 aid in the retention and securing of the boot 72 (or 72A) to the support legs 74.

The tightening means used may also depend on the shape of the support legs 74, e.g., whether they are circular (FIGS. 16-18) or have flat lateral sides (FIG. 19). Support legs 74 may be round as in some embodiment or square. When square, the holes in the support legs 74 may be eliminated.

Figure 20:
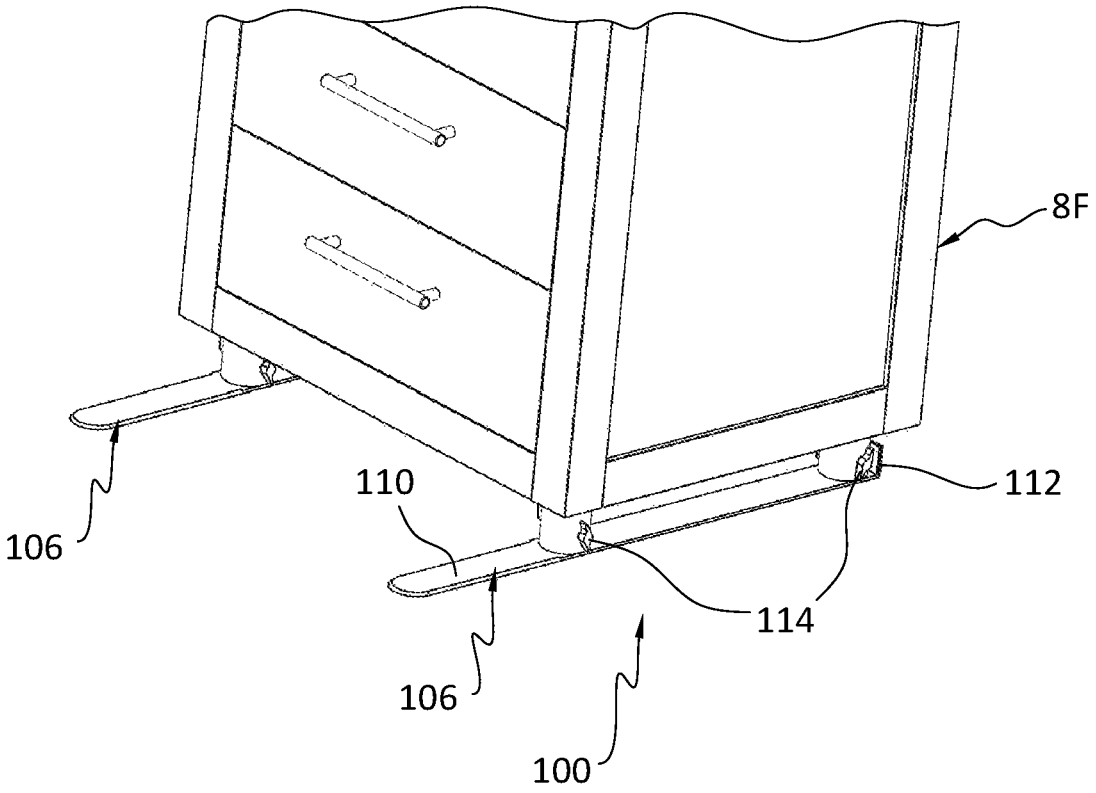
FIG. 20 is a view showing the bottom of a dresser including another embodiment of an anti-tipping mechanism in accordance with the invention.
Figure 21:
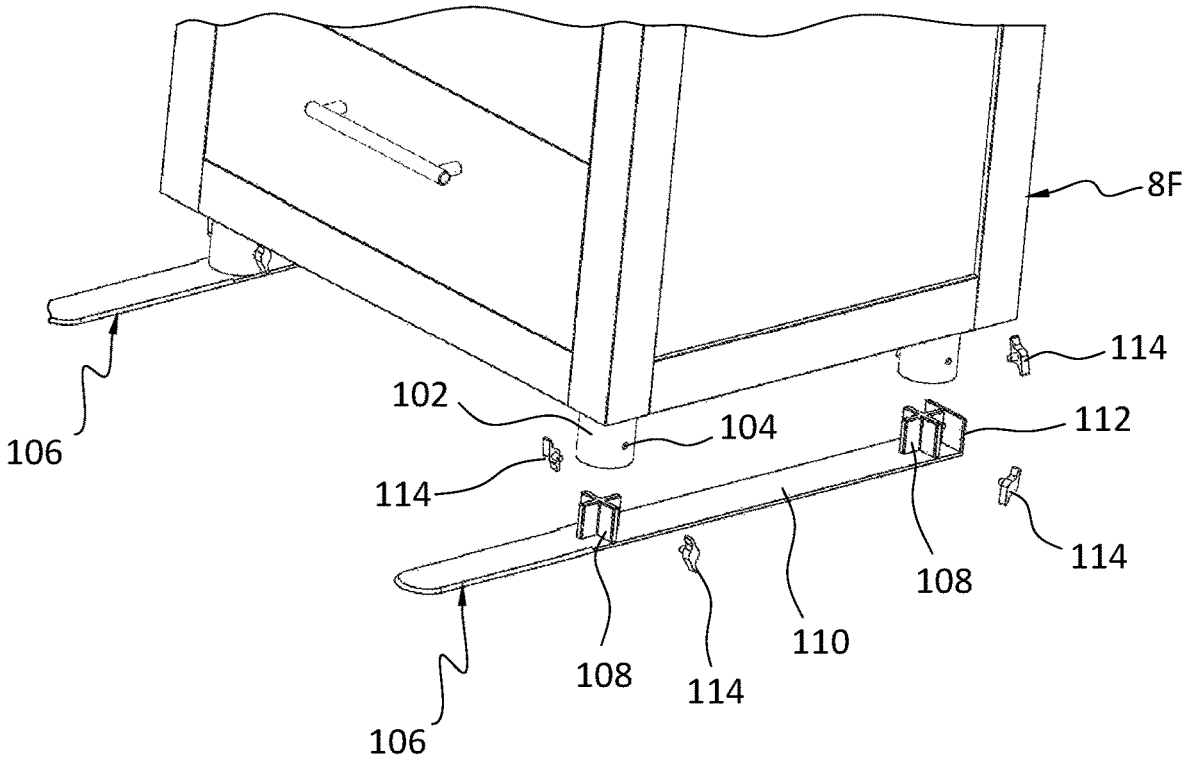
FIG. 21 is a view of the dresser shown in FIG. 20 with the anti-tipping mechanism detached from the dresser.
Figure 22:
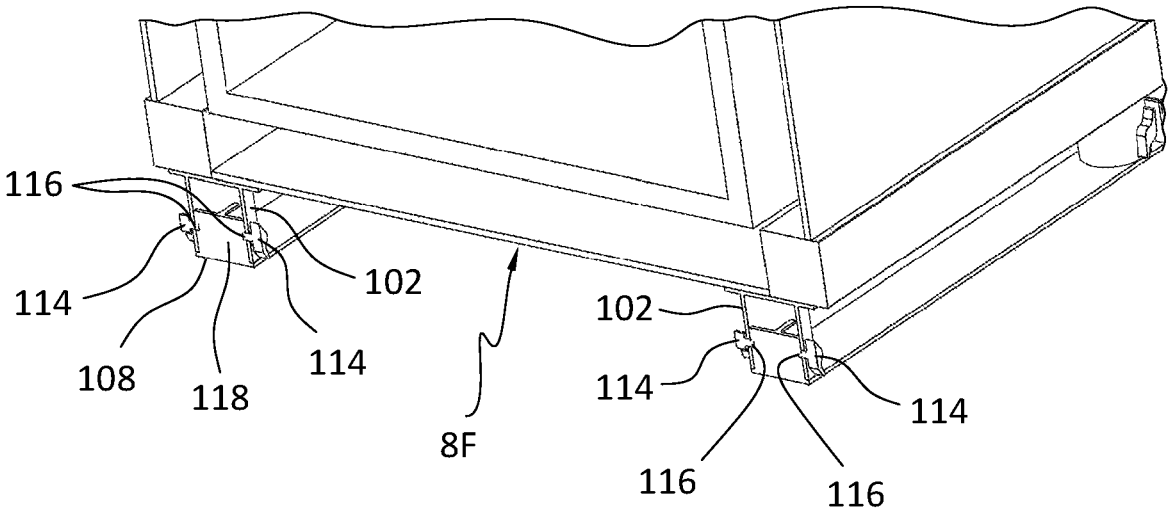
FIG. 22 is a sectional view of FIG. 21 showing the engagement between the dresser and the anti-tipping mechanism.

FIGS. 20-22 show an embodiment of an anti-tipping mechanism 100 in accordance with the invention which is used with a dresser 8F having hollow support legs 102 and holes 104 extending through the peripheral wall of the support leg 102 into the hollow interior of the support leg 102. Anti-tipping mechanism 100 includes a boot or extension 106 having an elevated placement structure 108 as a retention structure for each support leg 102. Each elevated placement structure 108 extends upward from a bottom portion 110 of the boot 106 and that is configured to fit within the hollow interior of the support leg 102.

The elevated structure 108 may include a plurality of intersecting walls, e.g., two walls intersecting at a 90 degree angle (perpendicular to one another in the shape of an +). For this embodiment, only a rearmost lateral wall 112 is provided to assist in positioning of the boot 106, although even rearmost lateral wall 112 should be considered optional. Other lateral walls may be provided to aid in positioning of the support legs 102 on the boot 106, i.e., so that each hollow interior of the support legs 102 receives a respective elevated structure 108.

The elevated structure 108 is configured so that the holes 104 in the support legs 102 align with one of the walls thereof so that the wing nuts 114 when inserted through the holes 104, press against the wall and tighten the support leg 102 to the elevated structure 108, or enter into aligning holes 116 in the walls 118 to provide a tightening effect (see FIG. 22).

The boots 72 (FIGS. 16-18), 72A (FIG. 19), 106 (FIGS. 20-22) ideally will be constructed in substantially unbreakable injection molded substrates such as Acetal (DELRIN), Polycarbonate (LEXAN), and even ABS (which is used to make crash helmets). While it is strong and reasonably rigid, the inventors feel that even a little flex in the boot 72, 72A, 106 can further assist in resisting tip-ability.

Currently, a 9 inch boot 72 (FIGS. 16-18), 72A (FIG. 19), 106 (FIGS. 20-22) of a drawer that might open up fully to 12 or 13 inches should be sufficient. However, it is contemplated that the portion of the boot 72, 72A, 106 extending beyond the front surface of the dresser may be as long as that of the drawer opening or even longer.

The boot 72 (FIGS. 16-18), 72A (FIG. 19), 106 (FIGS. 20-22) can be as thin as ⅛ inches, i.e., the thickness of the bottom portion thereof, and soft round to the edge, i.e., at least the front edge, to prevent possible tripping. Because it is thin, it is ideal to consider placing a carpet on top of the left and right boots 72, 72A, 106 to thus hide the boots 72 (FIGS. 16-18), 72A (FIG. 19), 106 (FIGS. 20-22) and at the same time insure there will be no tripping. The carpet may also serve to assist the dresser from moving, as well.

The foregoing anti-tipping mechanisms generally relate to additional structure to attach to the furniture in order to increase the anti-tipping resistance of the dresser without requiring any modifications to the furniture, or only nominal modifications, e.g., making holes in the support legs. These attachments are easily removed from the furniture, e.g., for moving the furniture. The invention also encompasses modifications to furniture itself used in combination with additional structure.

The following embodiments relate to anti-tipping mechanisms that involve modification to a piece of furniture to provide for two cooperating parts that are engaged with one another to secure the furniture to a support structure, one part being attached to or integral with the support structure and the other part being attached to or integral with the furniture.

In a first such embodiment shown in FIGS. 23-26, the first part is a rigid wall bracket 132 having a central planar portion 134 and side flanges 136 in a common plane with one another but in a different plane than the planar portion 134. The central planar portion 134 may be a flat piece of material with opposing planar sides or surfaces. There is one side flange 136 on each side of the central portion 134. The side flanges 136 may each be a flat piece of material with opposing planar sides or surfaces. The thickness of the planar portion 134 and the side flanges 136 is selected to provide the desired rigidity. The planar portion 134 and the side flanges 163 may be formed from a unitary or integral piece of material.

The distance from planar portion 134 to side flanges 136 ideally is the depth of the head of a carriage bolt 140, so when the bracket 132 is mounted to the wall 138 the carriage bolt square member aligns perfectly with that of the square hole in the bracket 132 and will stay perfectly in place when engaged by the wingnuts 148 inside the dresser 144. The square member engages the square opening and resists rotation. This provides a positive engagement when tightening the dresser 144 to the wall 138 when tightening it with the wingnuts 148. If the head of the carriage bolt 140 is about ⅛ inches, then the distance from inside the planar portion 134 to that of the side flanges 136 should be substantially the same. If the gap is too large, the carriage bolt 140 will want to disengage the square hole.

Although a carriage bolt 140 is mentioned, the bolt does not have to be a carriage bolt and may be any type of bolt, e.g., a welded bolt, or possibly even just a screw or other type of threaded elongate member.

The side flanges 136 include one or more apertures through which a respective number of screws are passed to attach the bracket 132 to the support structure, i.e., a vertical wall 138. When the bracket 132 is attached to the vertical wall 138, the side flanges 136 will be against the vertical wall 138, either directly or indirectly in contact therewith, while the central portion 134 will be spaced apart from the vertical wall 138 (see FIG. 24).

The structure of the screws (or carriage bolt to connect the bracket to the wall) and apertures, and number of screws that should be provided will be obvious to those skilled in the art to which this invention pertains in view of the disclosure herein. Instead of screws and apertures, other attachment means may be used. Bracket attachment means will therefore mean any structure that provides for a secure attachment of one part to another part (secured or part of a stationary or difficult to move structure) and prevents separation of that part from the other part when a force is exerted to that part. Those skilled in the art to which this invention pertains will readily ascertain other suitable bracket attachment means.

Figure 23:
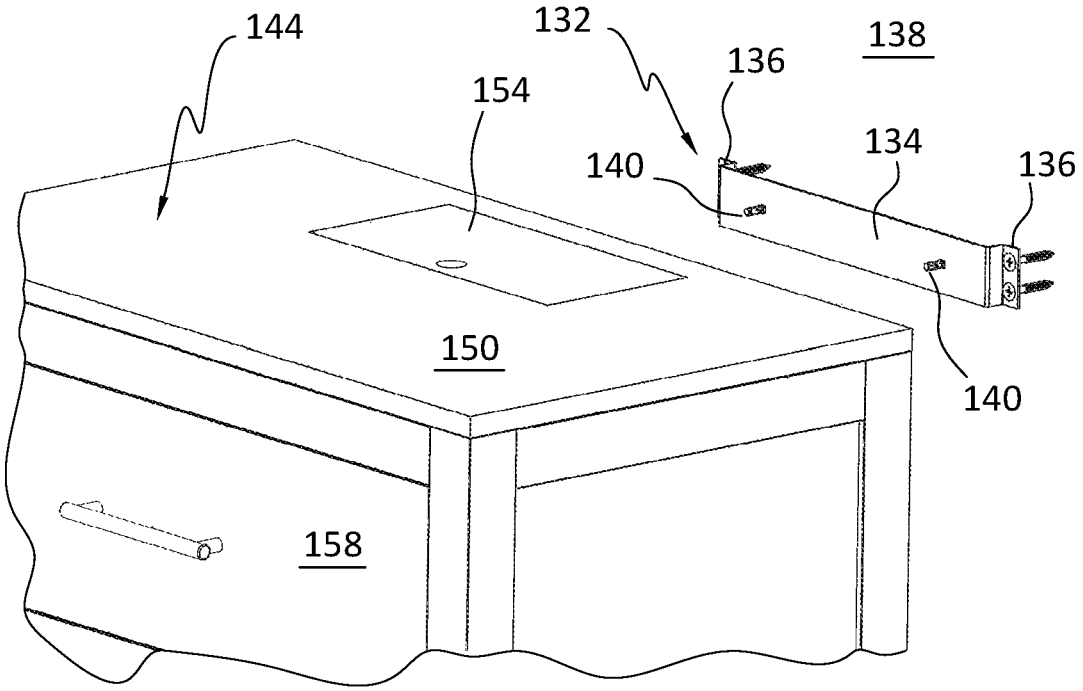
FIG. 23 is a partial perspective view of another embodiment of an anti-tipping mechanism in accordance with the invention having a part integrated into a dresser.

The bracket 132 includes two carriage bolts 140 that project from the central portion 134 to the side away from the side flanges 136 (see FIG. 23). Although two carriage bolts 140 are shown, there may be a different number of carriage bolts 140. The carriage bolts 140 may be passed from behind through an aperture in the bracket 132 to project outward from the bracket 132. The manner in which the carriage bolts 140 may be attached to the bracket 132 are readily ascertainable by those skilled in the art to which this invention pertains. A threaded projection may also be formed integral with the bracket 132 if so desired instead of using carriage bolts 140.

Figure 24:
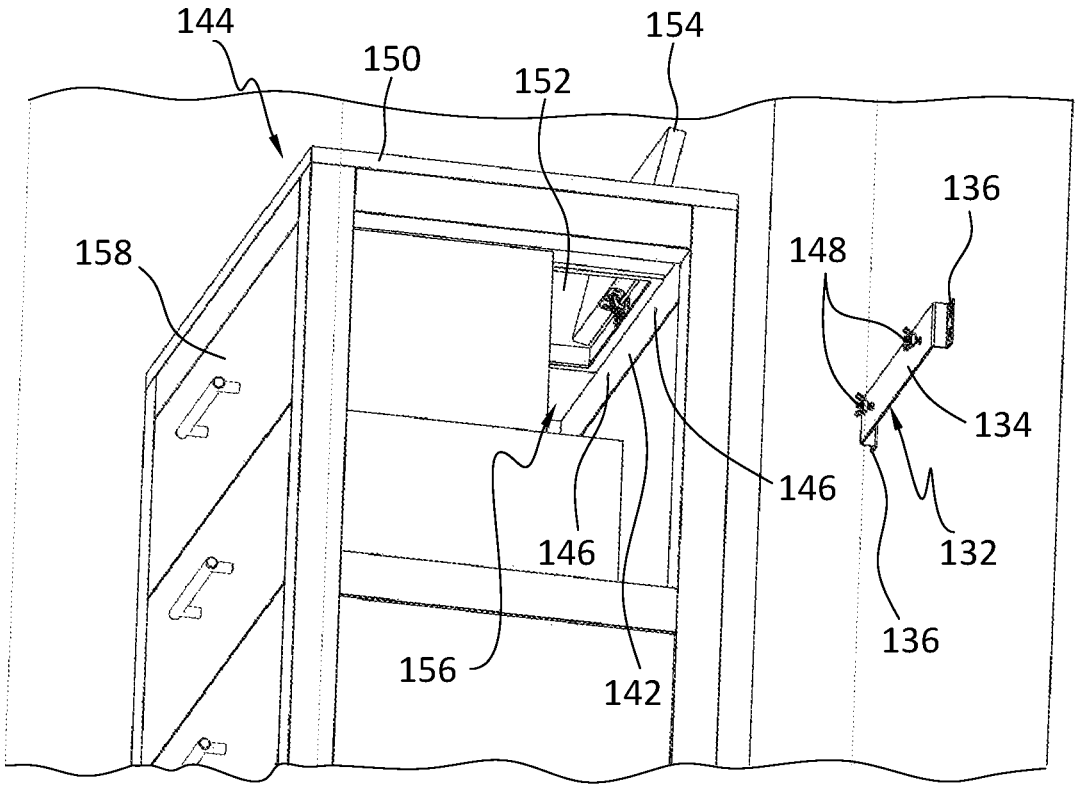
FIG. 24 is a side perspective view of the anti-tipping mechanism in accordance with the invention shown in FIG. 23 with the side panel of the dresser removed.

The second part of the anti-tipping mechanism is a wall section 142 of the dresser 144 that has apertures 146 configured to accommodate the number, pattern, size and location of the carriage bolts 140 of the bracket 132 (see FIG. 24). The thickness of the wall section 142 is less than the height of the carriage bolts 140 to provide for a portion of the carriage bolts 140 extending beyond the wall section 142.

There may be more apertures 146 in the wall section 142 than carriage bolts 140 of the bracket 132, which may be useful if there are different brackets used with different numbers, patterns, sizes and locations of carriage bolts 140. That is, the wall section 142 may be provided with apertures 146 whereby different sets of apertures 146 match different configurations of carriage bolts 140 on different brackets 132.

In the illustrated embodiment, the wall section 142 includes two apertures 146 configured to receive the two carriage bolts 140 (see FIG. 24). As such, it is possible to position the dresser 144 so that the carriage bolts 140 extend through the apertures 146.

The anti-tipping mechanism then also includes wing nuts 148 adapted to the carriage bolts 140 (see FIG. 24 wherein the wing nuts 148 are threaded onto the carriage bolts 140). The wing nuts 148 are threaded onto the carriage bolts 140 after the carriage bolts 140 are passed through the apertures 146. The wing nuts 148 are then tightened to secure the wall section 140 to the bracket 132, and thus the dresser 144 to the wall 138 (see FIG. 25). To aid this, the dresser 144 is first pushed as far as possible against the bracket 132.

When the wall section 132 is secured against the bracket 132, the dresser 144 is thereby secured to the vertical wall 138 and tipping of the dresser 144 is prevented.

Figure 25:
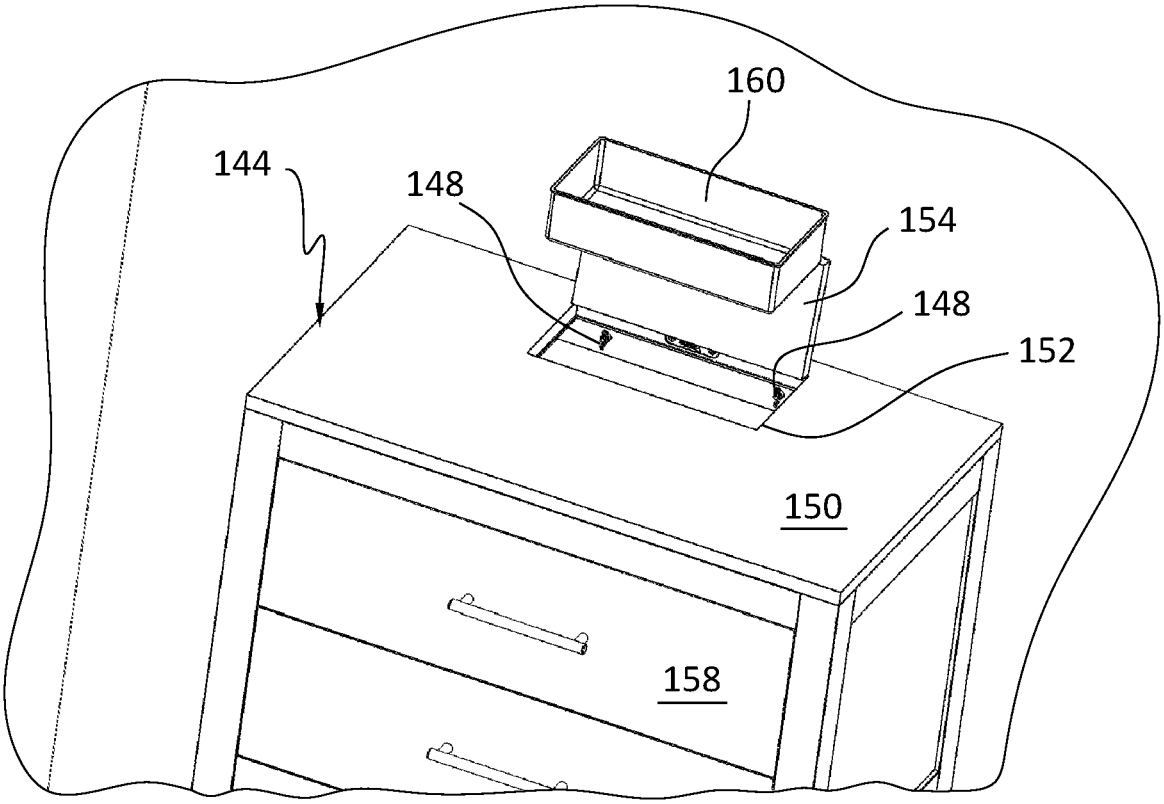
FIG. 25 is a perspective view of the anti-tipping mechanism in accordance with the invention shown in FIG. 23 with a utility tray removed through an open access door.

To enable the wing nuts 148 to be threaded onto the carriage bolts 140 and then tightened, an upper panel 150 of the dresser 144 is provided with an opening 152 into which an access door 154 fits (see FIGS. 24 and 25). Access door 154 is pivotally attached to the upper panel 150 by a hinge to enable opening and closing of the access door 154 in order to access the space 156 underneath the upper panel 150 (see FIG. 24). When the access door 154 is in the closed state, it may be flush with the remaining portion of the upper surface of the upper panel 150.

This space 156 is formed by appropriately dimensioning the depth of the upper drawer 158 of the dresser 144, e.g., to be slightly less than the depth of the lower drawers in the dresser 144 (see FIG. 24). This lesser drawer depth enables the bracket 132 to avoid interfering with drawer operation. If multiple drawers are provided at the top of the dresser 144, then only those drawers that will be in front of the bracket 132 may be made with the lesser depth.

A utility tray 160 may be provided to insert into the space 156 and obstructs viewing of the wall section 142 when the access door 154 is open (see FIG. 25). The utility tray 160 has a depth that is dimensioned to avoid interfering with the upper drawer 158 and rests on one or more flanges formed on surfaces defining the opening 152.

Figure 26:
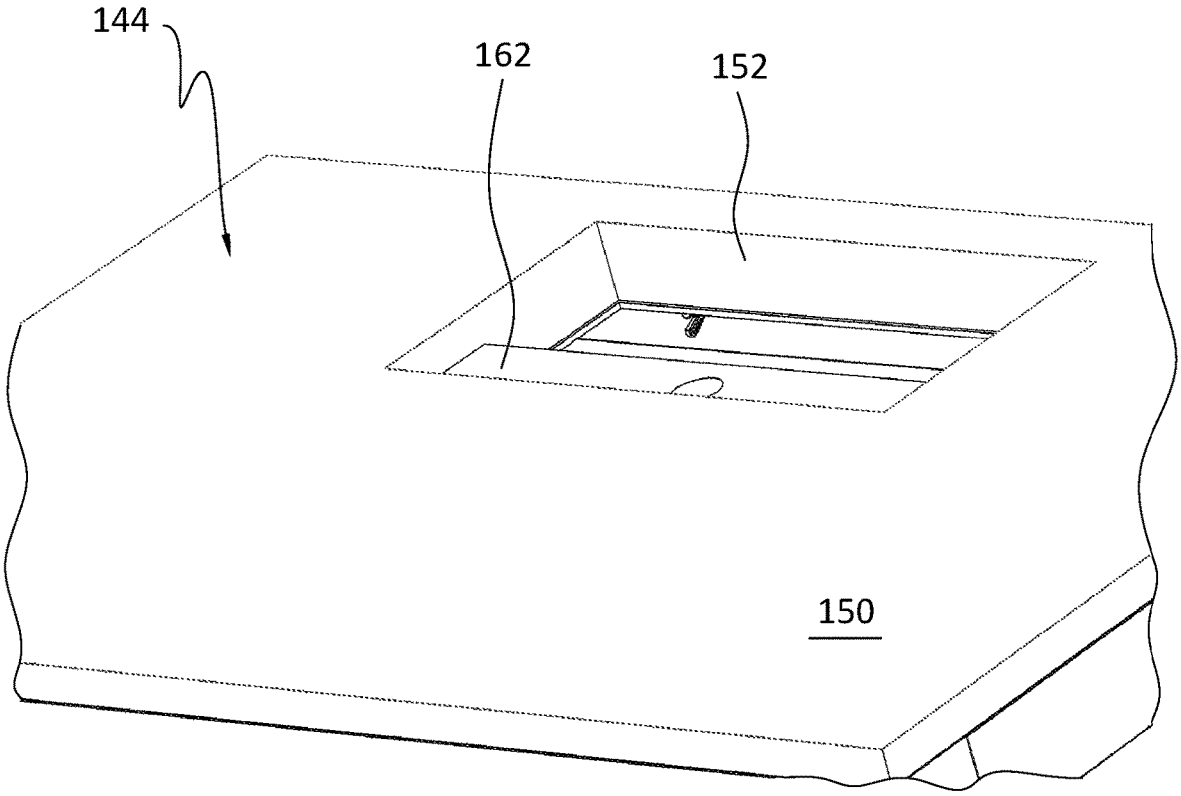
FIG. 26 is a perspective view of the anti-tipping mechanism in accordance with the invention shown in FIG. 23 with a sliding access door.

Instead of a pivoting access door 154, it is also possible to provide a sliding access door 162 as shown in FIG. 26. The sliding access door 162 is provided by mounting sliding tracks on the dresser 144 and the access door 152. One skilled in the art would readily ascertain how to install such sliding doors in view of the disclosure herein.

In an exemplifying use, installation of the anti-tipping mechanism involves first placing the dresser 144 against the wall 138, opening the access door 154, removing the utility tray 160 if present and then tracing through the apertures 146 onto the vertical wall 138. The dresser 144 is then moving away from the wall 138. The carriage bolts 140 are attached to the bracket 132 if not already attached thereto. The bracket 132 is then positioned such that the carriage bolts 140 align with the markings on the wall 138, and then secured to the wall by passing the screws through the apertures in the side flanges 136 of the bracket 132. The wing nuts 148, if present on the carriage bolts 140, are removed and the dresser 144 is then repositioned against the bracket 132, pushing the wall section 142 as far as possible against the bracket 132 while the carriage bolts 140 extend through apertures 146. While the access door 154 is open and the utility tray 160 removed, access to the space 156 is possible and the wing nuts 148 are then threaded onto the carriage bolts 140 and tightened. The optional utility tray 160 is placed into position and the access door 154 is then closed. The dresser 144 is now prevented from tipping.

FIGS. 27-30 show a variant of the embodiment of FIGS. 23-26 wherein a different wall bracket, designated 172 is used. Wall bracket 172 has a central planar portion 174 and side flanges 176 in a common plane with one another but in a different plane than the planar portion 174. Wall bracket 172 is wider than wall bracket 132, but the width of a wall bracket may be varied as desired. There is one side flange 176 on each side of the central portion 174. The side flanges 176 include bracket attachment means as defined above, e.g., one or more apertures, two as shown, through which a respective number of screws are passed to attach the bracket 172 to the vertical wall 138. When the bracket 172 is attached to the vertical wall 138, the side flanges 176 will be against the vertical wall 138, either directly or indirectly in contact therewith, while the central portion 174 will be spaced apart from the vertical wall 138 (see FIG. 27).

Figure 27:
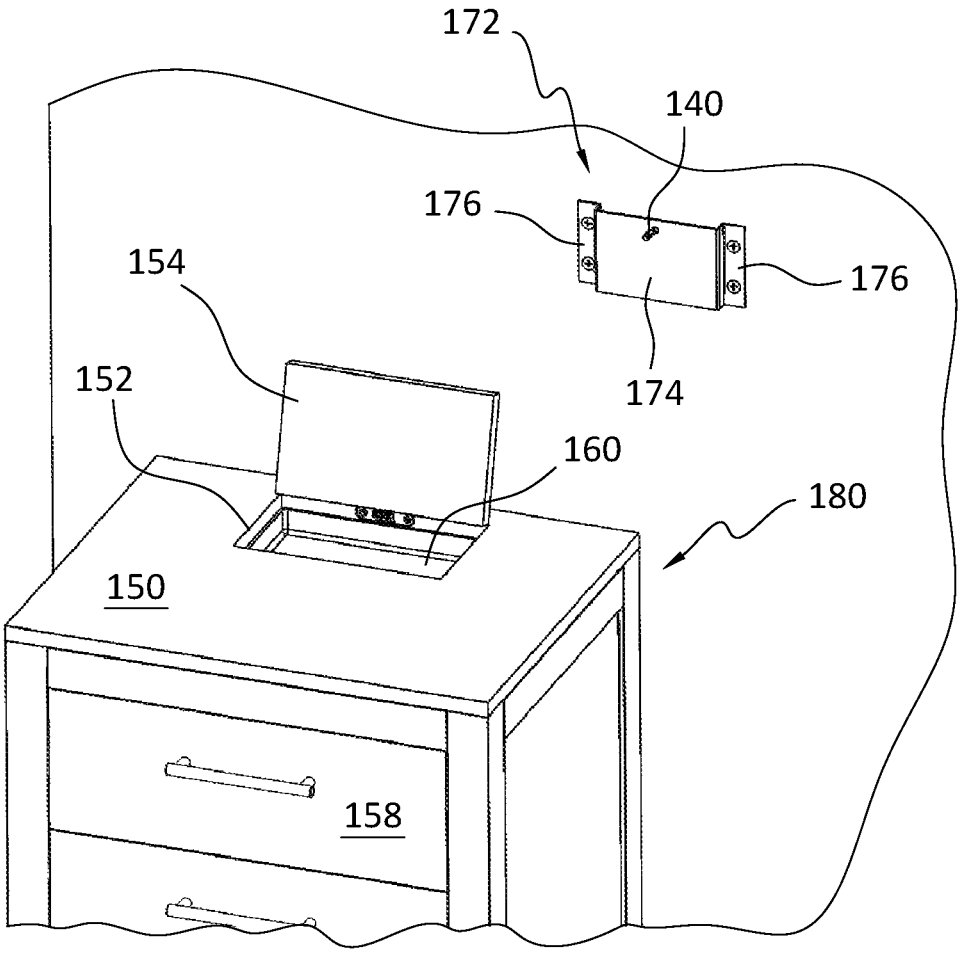
FIG. 27 is a partial perspective view of an anti-tipping mechanism in accordance with the invention having a part integrated into a dresser.
Figure 29:
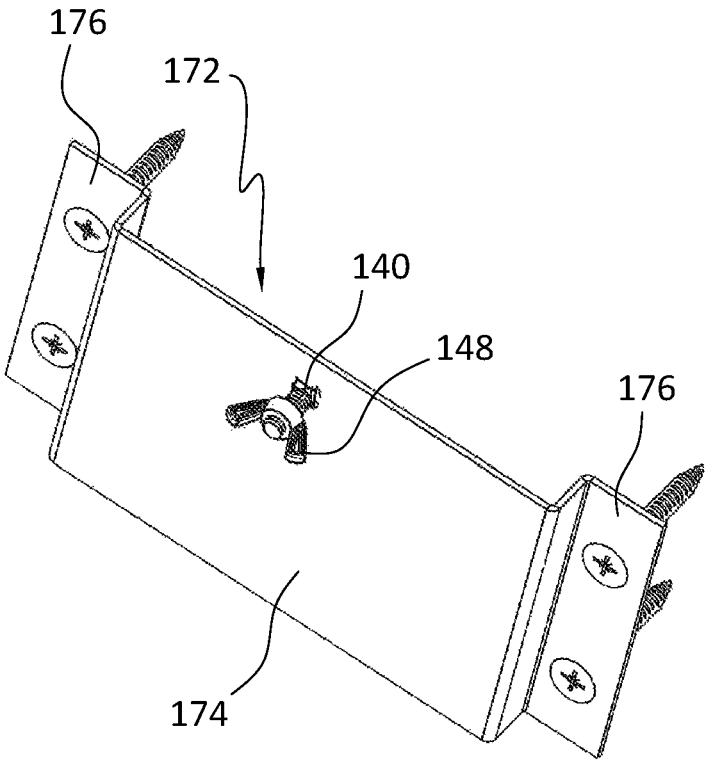
FIG. 29 is a view of the bracket for the anti-tipping mechanism of FIG. 27.
Figure 30:
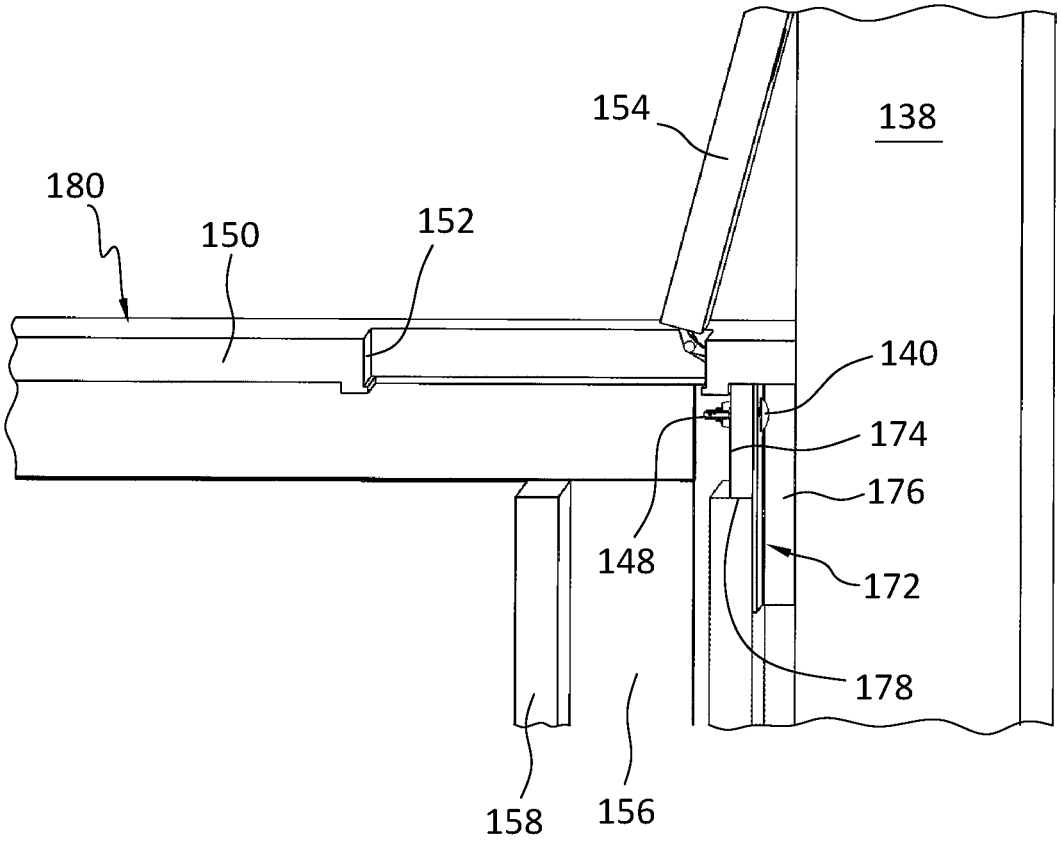
FIG. 30 is a cross-sectional view through the anti-tipping mechanism of FIG. 27.

The bracket 172 includes one carriage bolt 140 that project from the central portion 174 to the side away from the side flanges 176 (see FIGS. 27 and 29). Although one carriage bolt 140 is shown, there may be more than one carriage bolt 140. The carriage bolt 140 may be passed from behind through an aperture in the bracket 172 to project outward (in the forward direction) from the bracket 172. A threaded projection may also be formed integral with the bracket 172 if so desired instead of using carriage bolt 140.

Figure 28:
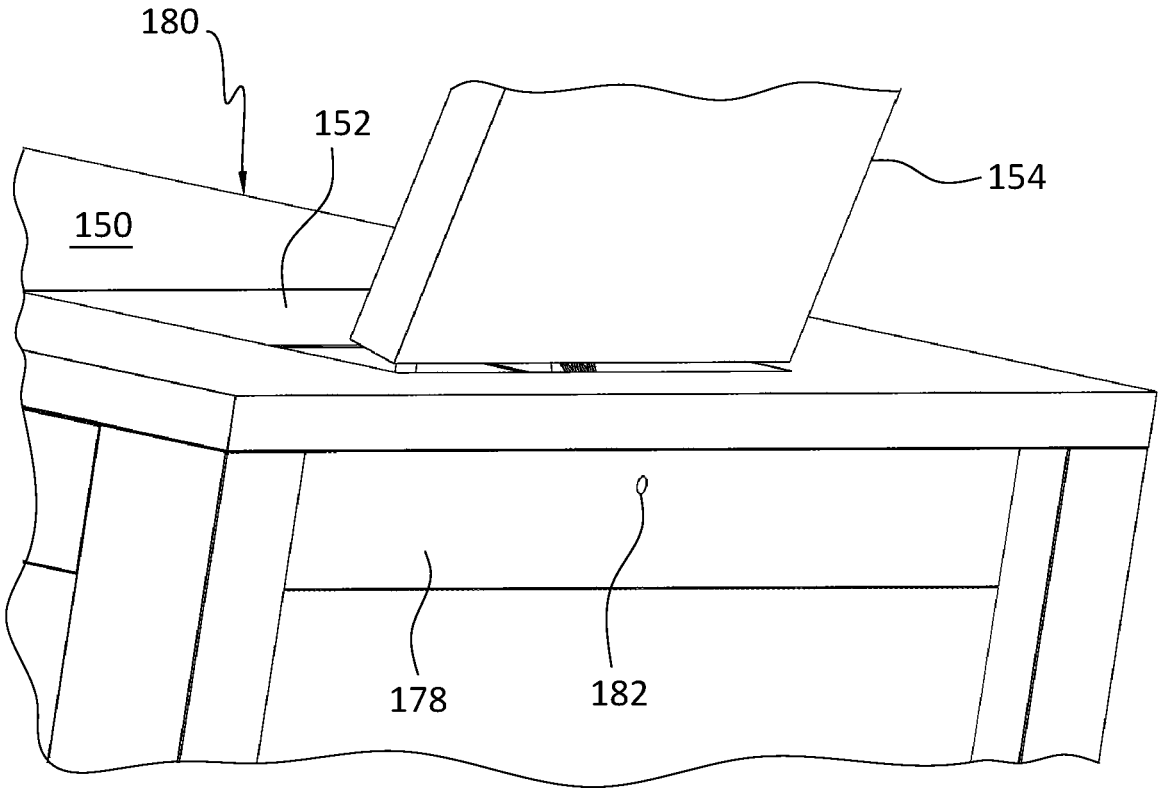
FIG. 28 is a rear view of the dresser of FIG. 27.

The second part of the anti-tipping mechanism is a wall section 178 of the dresser 180 that has an aperture 182 configured to accommodate the carriage bolt 140 of the bracket 172 (see FIG. 28). The thickness of the wall section 178 is less than the height of the carriage bolt 140 to provide for a portion of the carriage bolt 140 extending beyond the wall section 178.

There may be more apertures 182 in the wall section 178 than the number of carriage bolts 140 of the bracket 172, which may be useful if there are different brackets used with different numbers, patterns, sizes and locations of carriage bolts 140. That is, the wall section 178 may be provided with apertures 182 whereby different sets of one or more apertures 182 match different configurations of carriage bolts 140 on different brackets 172.

In the illustrated embodiment, the wall section 178 includes a single aperture 182 configured to receive the single carriage bolt 140 (see FIG. 28). As such, it is possible to position the dresser 180 so that the carriage bolt 140 extends through the apertures 182.

The anti-tipping mechanism also includes a wing nut 148 adapted to the carriage bolt 140 (see FIG. 29 wherein the wing nut 148 is threaded onto the carriage bolt 140). The wing nut 148 is threaded onto the carriage bolt 140 after the carriage bolt 140 is passed through the aperture 182. The wing nut 148 is then tightened to secure the wall section 178 to the bracket 172 (see FIG. 30). To aid this, the dresser 180 is first pushed as far as possible against the bracket 172.

When the wall section 178 is secured against the bracket 172, the dresser 180 is thereby secured to the vertical wall 138 and tipping of the dresser 180 is prevented.

Wall section 178 may be dimensioned to avoid interfering with the opening of the upper drawer so that the upper drawer can have the same depth as the remaining drawers in the dresser 180. To this end, the installer of the anti-tipping mechanism must measure the location on the vertical wall 138 to install the bracket 172.

FIGS. 31-34 show another variant of the embodiment of FIGS. 23-26 wherein a different wall bracket, designated 192 is used. Wall bracket 192 has a central planar portion 194 and side flanges 196 in a common plane with one another but in a different plane than the planar portion 194. Wall bracket 192 is wider than wall bracket 132, but the width of a wall bracket may be varied as desired.

The central planar portion 194 may be a flat piece of material with opposing planar sides or surfaces. There is one side flange 196 on each side of the central portion 194. The side flanges 196 may each be a flat piece of material with opposing planar sides or surfaces. The thickness of the planar portion 194 and the side flanges 196 is selected to provide the desired rigidity. The planar portion 194 and the side flanges 196 may be formed from a unitary or integral piece of material.

The side flanges 196 include bracket attachment means as defined above, e.g., one or more apertures, two as shown, through which a respective number of screws are passed to attach the bracket 192 to the vertical wall 138. When the bracket 192 is attached to the vertical wall 138, the side flanges 196 will be against the vertical wall 138, either directly or indirectly in contact therewith, while the central portion 194 will be spaced apart from the vertical wall 138 (see FIG. 31).

Figure 31:
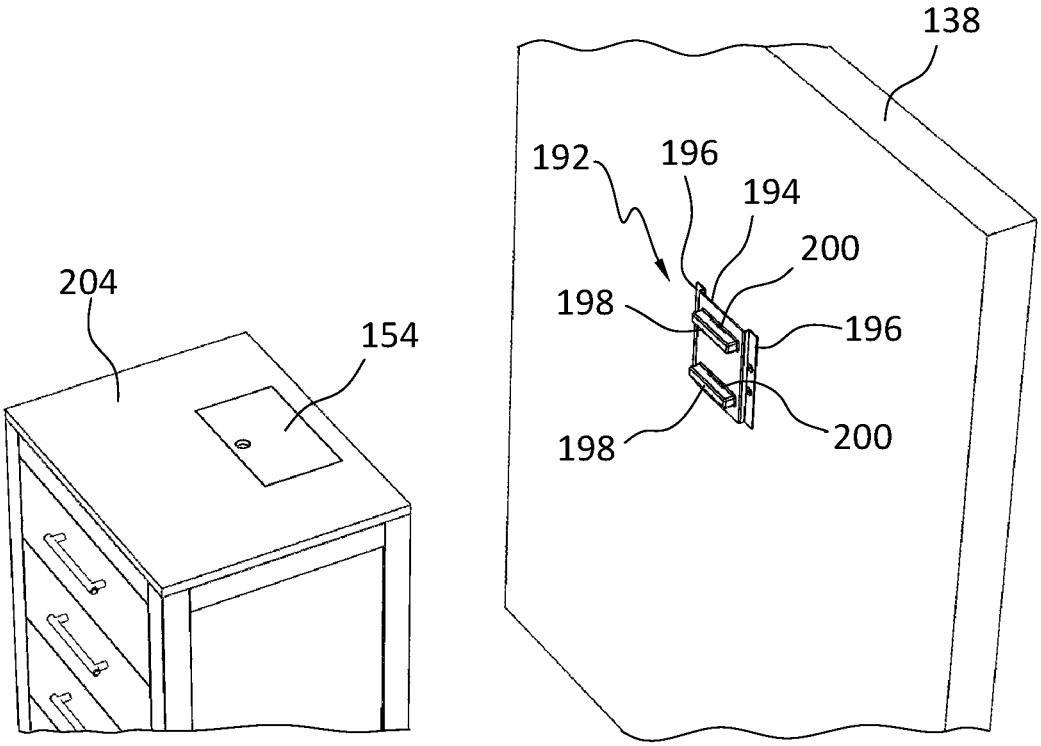
FIG. 31 is a partial perspective view of another embodiment of an anti-tipping mechanism in accordance with the invention having a part integrated into a dresser.

The bracket 192 includes two projections 198 that project from the central portion 194 to the side away from the side flanges 196 and are spaced apart from one another (see FIG. 31). Although two projections 198 are shown, there may be a different number of projections 198. Each projection 198 may be formed separate from the central portion 194 and then attached thereto or formed integral or as a unit with the central portion 194 from the same material. The projections 198 are elongate and may be parallel to one another.

Each projection 198 includes a slot 200 (see FIG. 31). In a preferred embodiment, the slot 200 is formed close to the central portion 194 and at the same position on all of the projections 198 present on the central portion 194. Each slot 200 is elongate and extends from an upper surface of the projection 198 through the projection 198 to a lower surface of the projection 198. Other shapes of slots are also possible, but each slot must pass through the projection 198 between the upper and lower surfaces.

Figure 32:
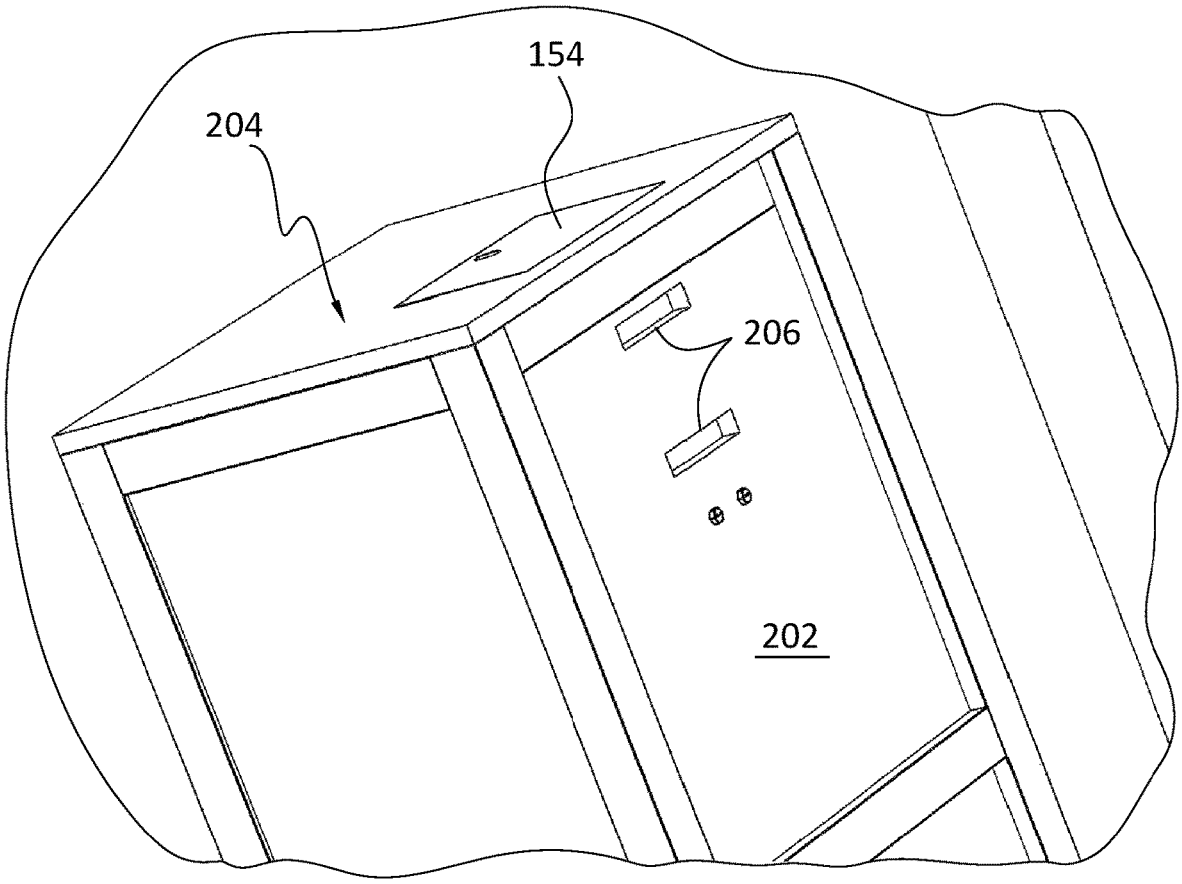
FIG. 32 is a rear view of the dresser of FIG. 31.

The second part of the anti-tipping mechanism is a wall section 202 of the dresser 204 that has elongate apertures 206 configured to accommodate the projections 198 of the bracket 192 (see FIG. 32).

It is important to align the location of the wall bracket 192 in FIG. 31 to mate exactly to the apertures 206 in the wall section 202 shown in FIG. 32. While this can be accomplished in several ways, one possibility would be the use of double faced tape strips placed on the rear of the side flanges 196 of both sides of the bracket 192. The bracket 192 is temporarily placed in the respective aperture 206 in the rear of the dresser 204 and pressed against the wall at the desired location. Removal of the dresser 204 will leave the bracket 192 affixed temporarily to the wall in the properly registered position for permanent marking and subsequent fastening (screwing) to the wall 138. Other methods might consist of protruding marks on the back side of the side flanges 196 and when pressed against the wall 138, the marks will leave indents as precise guides for fastening the bracket 192 and insuring it will mate to the openings 206 on the back of the dresser 204.

Yet another method might be to temporarily engage the bracket 192 into the dresser apertures 206 and carefully place the dresser 204 flush to the desired position. Once in place, the installer can pivot open the access door 154 to carefully pencil-mark the lines through the apertures 206 to that of the wall 138. Once done, you will have proper locations for permanent mounting. While these are a few methods for aligning and registering the bracket 192 to the dresser 204, there are others that will provide similar desired results.

There may be more apertures 206 in the wall section 202 than the number of projections 198 of the bracket 192, which may be useful if there are different brackets used with different numbers, patterns, sizes and locations of projections 198. That is, the wall section 202 may be provided with apertures 206 whereby different sets of one or more projections 198 match different configurations of projections 198 on different brackets 192.

Figure 33:
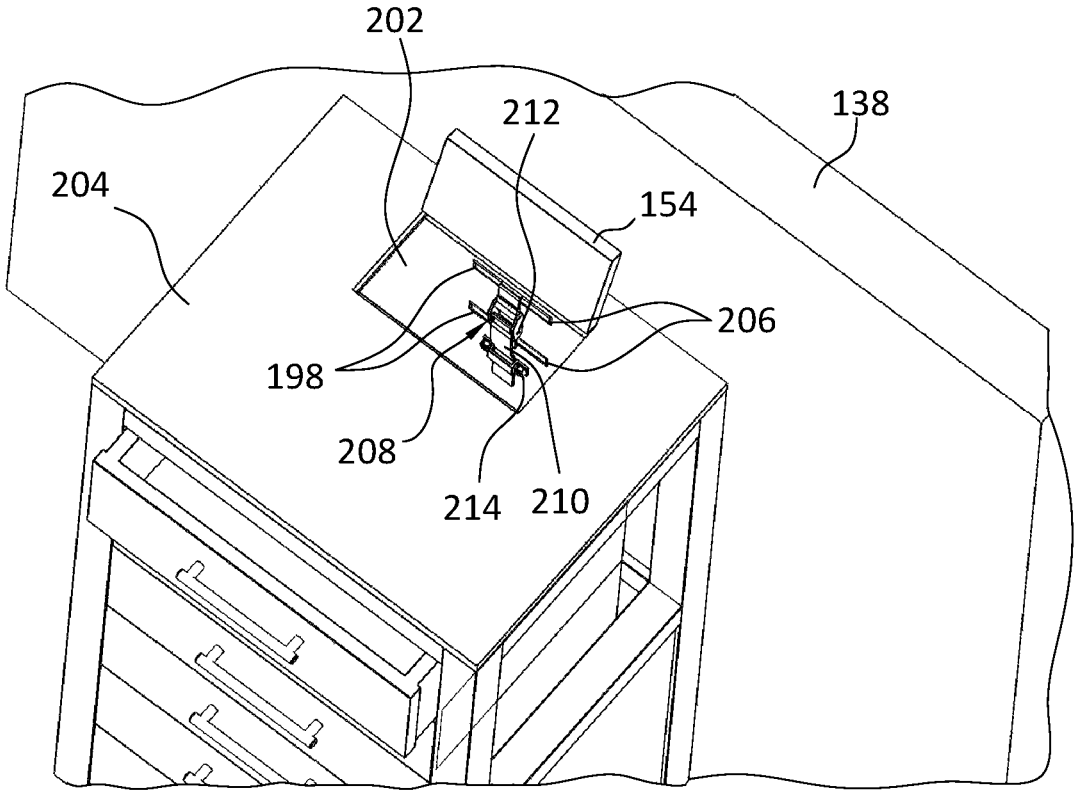
FIG. 33 is a view of the anti-tipping mechanism of FIG. 31 through an access door in the upper panel of the dresser.
Figure 34:
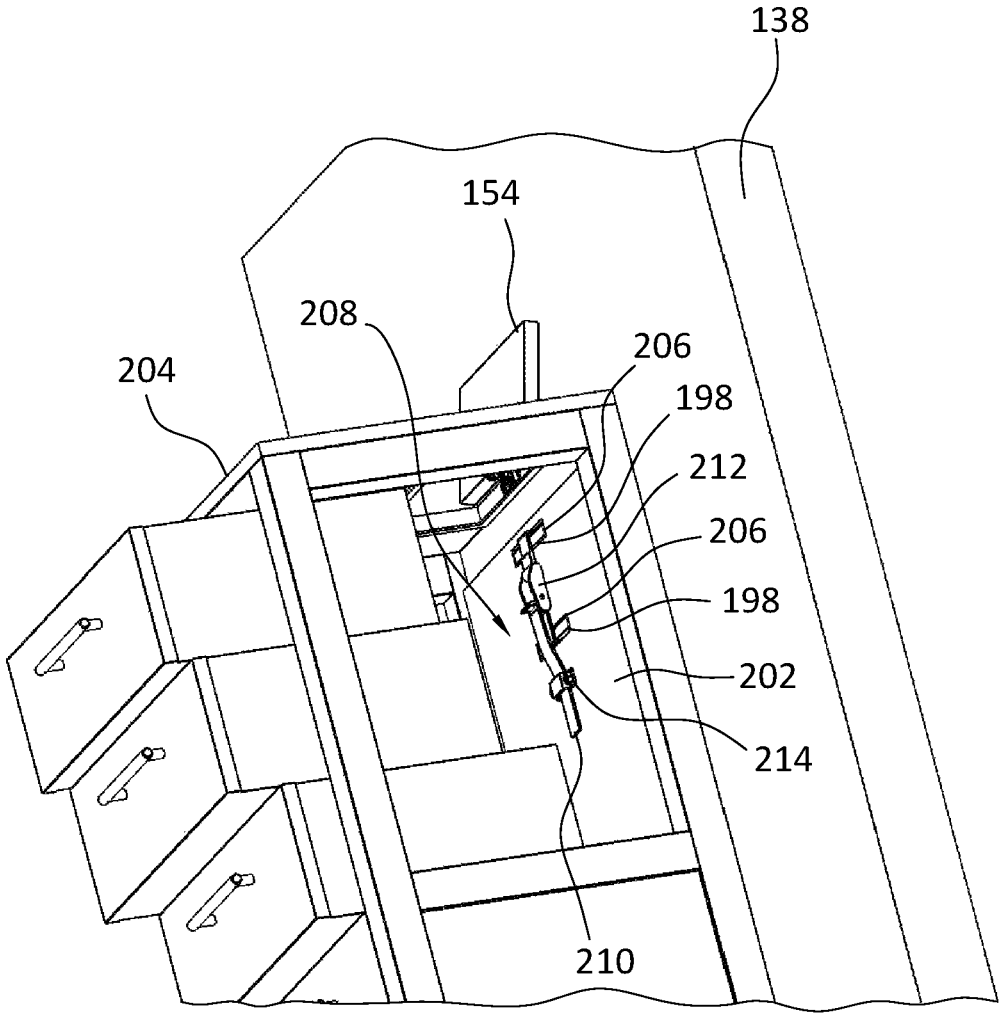
FIG. 34 is a side perspective view of the dresser with the anti-tipping mechanism of FIG. 31 with the side panel of the dresser removed.

In the illustrated embodiment, the wall section 202 includes two apertures 206 each configured to receive a respective one of the projections 198 (see FIGS. 33 and 34). As such, it is possible to position the dresser 204 so that the projections 198 extend into and possibly through the apertures 206.

The anti-tipping mechanism also includes a lashing strap 208 including a strap 210 that is passed through the slots 200 in the projections 198 and a cam-lock buckle 212 engaging with the strap 210. The buckle 212 tightens the strap 210 and releases the strap 210 based on manipulation of the buckle 212. The construction of such buckles 212 and their engagement with a strap 210 is known to those skilled in the art to which this invention pertains. The strap 210 may be made of polyester or NYLON™, or other suitable webbing material. The strap 210 may be pulled downward to tighten the dresser 204 against the wall and once tight, the cam-lock buckle 212 which was open to allow for the tightening is then pushed in a closed locking position. A cam-lock buckle 212 is representative of various similar-function mechanisms, such as a ratchet.

A hold-down bracket 214 is situated on the wall section 202 and is used to retain an excess portion of the strap 210. The hold-down bracket 214 may be positioned a few inches below the lower one of the apertures 206. In addition to the hold-down bracket 214 keeping the excess strap 210 neat, it serves also as that of a secondary security lock to keep the dresser 204 against the wall should the cam-lock buckle 212 become loose for some unforeseen reason such as that of not properly locking it in the first place.

Installation of the anti-tipping mechanism involves first placing the dresser 204 against the wall 138, opening the access door 154, removing the utility tray if present and then tracing through the apertures 206 onto the vertical wall 138. The dresser 204 is then moved away from the wall 138. The bracket 192 is attached to the wall 138 in a position in which the projections 198 align with the markings on the wall 138, and then secured to the wall 138 using the bracket attachment means. Other position marking or alignment techniques may be used as described above.

The strap 210 is passed through the slots 200 in the projections 198 with both ends being free.

The dresser 204 is then repositioned against the bracket 192, pushing the wall section 202 as far as possible against the bracket 192 while the projections 198 extend through the apertures 206 and the upper free end of the strap 210 is passed through the upper one of the apertures 206 and the lower free end of the strap 210 is passed through the lower one of the apertures 206. As such, the ends of the strap 210 are accessible.

While the access door 154 is open and the utility tray 160 removed, the buckle 212 is attached to the strap 210 and tightened, preferably positioning the buckle 212 between the apertures 206. This tightening secures the dresser 204 against the wall 138.

The excess portion of the strap 210 is put into the hold-down bracket 214 (see FIGS. 33 and 34).

The embodiment of FIGS. 31-34 is not limited to the disclosed structure and encompasses other functionally equivalent structure. The general concept of providing a bracket 192 with one or more projections that align with and pass into apertures 206 in the wall section 202 of a piece of furniture and using a strap 210 to secure the projection(s) on the bracket 192 to the wall section 202 is intended to be covered by the embodiment of FIGS. 31-34. Thus, this embodiment covers the use of one or more straps that are guided inside the space defined by the dresser 204 and then into engagement with the wall 138 through one or more apertures 206 in the back of the dresser 204.

There is a tightening mechanism associated with the strap 210 to provide for a tight and secure attachment of the dresser 204 to the wall 138. During installation, the tightening of the lashing strap 208 typically does not cause movement of the dresser 204 but rather the dresser 204 is positioned in its desired place and then the lashing strap 208 is tightened. Any excess portion of the strap 201 may be inserted into the hold-down bracket 214.

Figure 35:
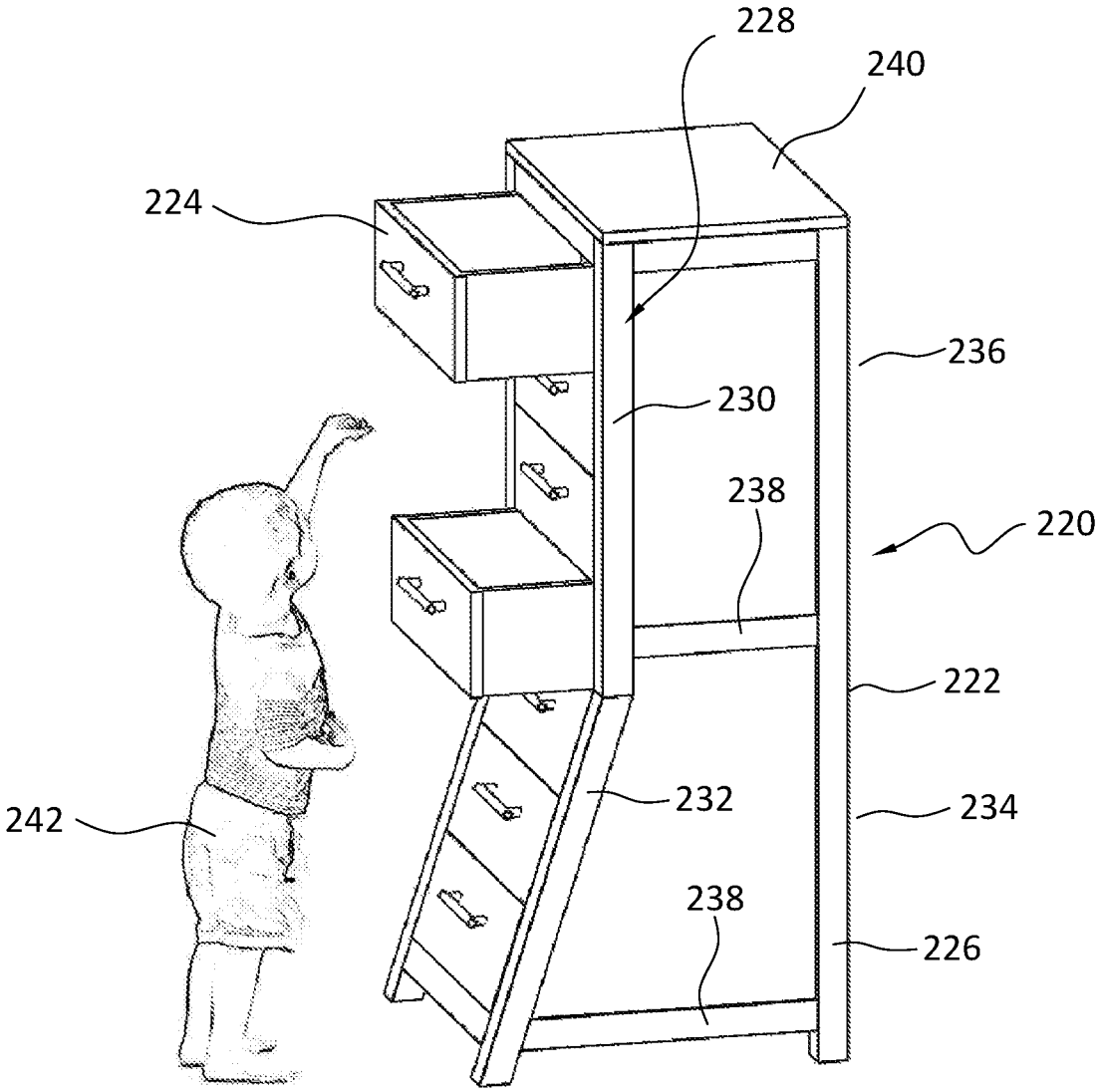
FIG. 35 is a perspective view of an embodiment of a dresser providing anti-tipping properties in accordance with the invention.
Figure 36:
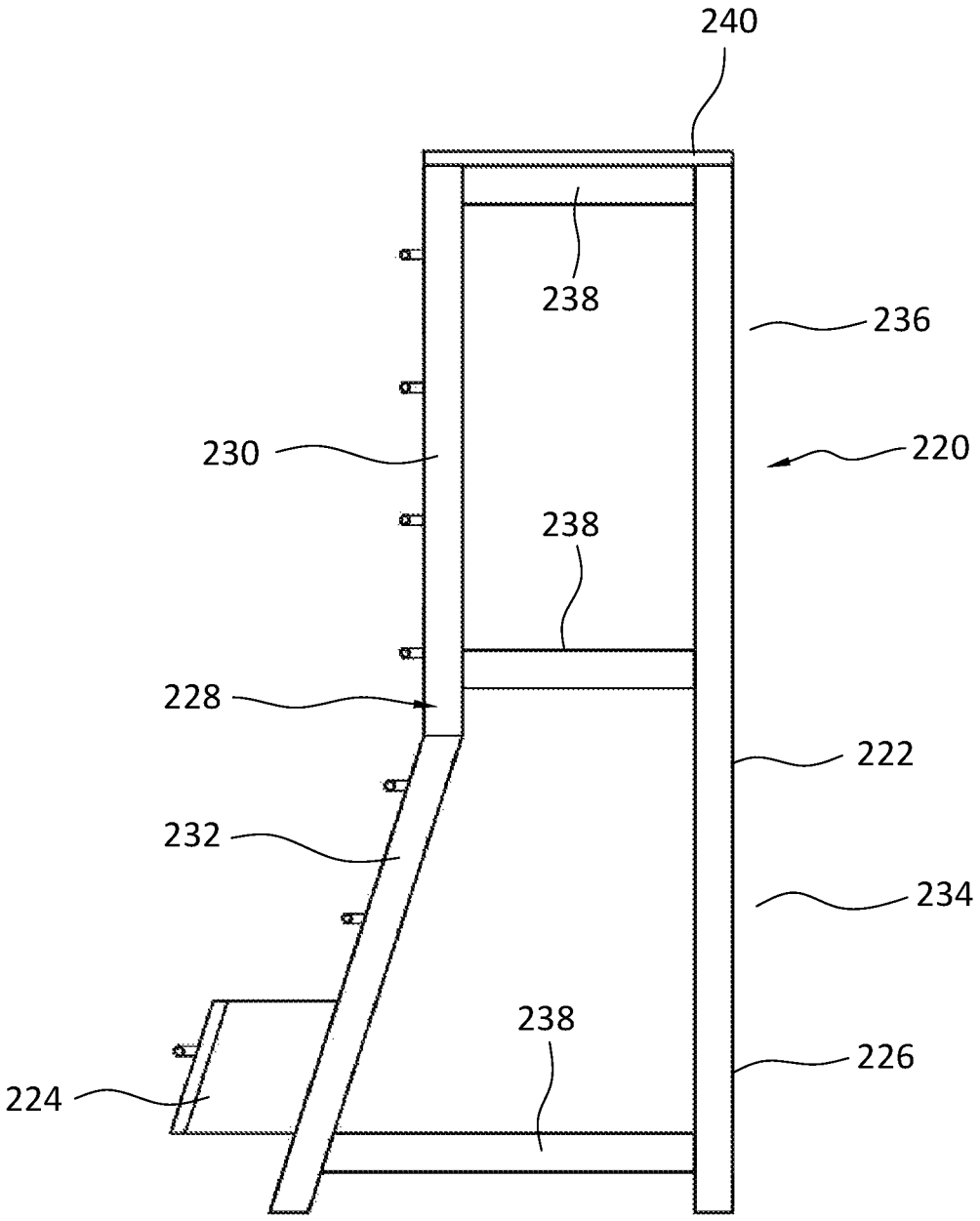
FIG. 36 is a side view of the dresser of FIG. 35.

FIGS. 35 and 36 show a first embodiment of a dresser 220 in accordance with the invention that provides for anti-tipping properties arising from its construction. For this embodiment of a dresser 220 and the following embodiments of dressers, the dressers may be made of various material and in various styles and designs. The essential aspect of the dressers is their shape, i.e., other than the traditional rectangular shape with all of the drawers having the same depth.

Dresser 220 includes a frame 222, a plurality of drawers 224, and hardware (not shown) to enable the drawers 224 to slide into and out of the frame 222 while being secured therein. The hardware is well-known to those skilled in the art.

The frame 222 includes two rear vertical supports 226, one on each side of the dresser 220, and two front vertical supports 228, one on each side of the dresser 220 and aligning with a respective one of the rear vertical supports 226. The rear vertical supports 226 are elongate and straight, preferably over their entire length. The front vertical supports 228 have two elongate sections 230, 232 with section 230 being above section 232. The entire left and right sides can be one panel as an alternative to vertical supports 226. There are many ways to design dressers and this is just one. What is important is the substantial shape configuration.

Section 230 is elongate and straight, preferably over its entire length, while section 232 is also elongate and straight, preferably over its entire length, but oriented at an acute angle to a longitudinal axis of section 230, and outward toward the front of the dresser 220. This acute angle may be anywhere from about 5 degrees to about 60 degrees. An optimum angle or angular range can be determined by considering the objectives of the invention, e.g., tipping prevention, and different dressers 220 can be made with different angles between the sections 230, 232. As a result of the angular orientation of section 232 relative to section 230, a lower portion 234 of the dresser 220 is larger in the front-to-back direction than an upper portion 236 of the dresser 220 (the front-to-back direction being depth of the dresser 220). Lower portion 234 is that portion defined in part by section 232 of support 228 and a lower part of support 226 of (one set of supports 226, 228 being on each side of the dresser 220) and one or more horizontal supports 238 (one set on each side of the dresser 220). Upper portion 236 is that portion defined by section 230 of support 228 and an upper part of support 226 (one set of supports 226, 228 being on each side of the dresser 220) and one or more horizontal supports 238 (one set of each side of the dresser 220).

This larger lower portion 234 enables deeper drawers to be provided in the lower portion 234. The drawers 224 in the lower portion 224 have a gradually increasing depth from a smallest depth closest to the drawer(s) 224 in the upper portion 236 to a maximum depth in the lowermost drawer 224 in the dresser 220. The front panel of each of these drawers 224 in the lower portion 234 is preferably angled at an angle commensurate with the angular orientation of the section 232 (see FIG. 36).

Horizontal supports 238 include one support at the bottom of the dresser 220, one in a middle region of the dresser 220, slightly above the seam between the sections 230, 232 and one at the top of the dresser 10. A different number and position of horizontal supports 238 may be provided. The lowermost horizontal support may be a small distance above the lower edge of the vertical supports 226, 228 to enable a lower end region of the vertical supports 226, 228 to form legs for the dresser 220.

The frame 222 also includes an upper board or panel 240, and may also include a lower board or panel to define a support for the lowermost one of the drawers 224.

In dresser 220, the relationship with the top or upper portion 236 having substantially less depth than the depth of the base (part of lower portion 234) provides substantially increased tip-prevention than that of conventional dressers with a consistent depth in the front-to-back direction. With such conventional dressers, tipping is easily performed by simply reaching the top surface and pulling the dresser forward. Alternatively, the dresser may fall forward when the upper region drawers are filled with contents. Such condition will make tipping even easier. Another problem that can cause serious accidents would be for the toddler to climb into the bottom drawer with and without the upper region drawers containing heavy contents. All such conditions contribute to the myriads of annual accidents, injuries and even death.

The inventors realize that reaching the top forward back of dresser 220 configured as shown produces significant resistance, including grab area and stance to provide a significant level of safety and anti-tip-ability.

The invention typically sets the top and upper portion 236 back from the frontmost edge (of lower portion 234) causing a rearrangement of the center of gravity. The center of gravity is generally considered the point of an object at which the weight is evenly dispersed and all sides are in balance. By providing deeper drawers at the lower portion 234 of the dresser 220 relative to those in the upper portion 236, the center of gravity is caused to be closer to or in the lower portion 234 and such rearrangement of the center of gravity makes tipping of the dresser 220 more difficult.

In dresser 220, the upper region drawers are substantially less deep than those in the lower region 234 and the lower region 234 has, therefore, a deeper stance which invariably prevents the toddler 242 from engaging with enough force and stance to cause the dresser 220 to fall forward (see FIG. 35). In fact, this embodiment of dresser 220 will likely produce resistance for full grown adults, as well.

The relationship of the top to bottom depths of drawers 224 will produce desired results. For example, a dresser with a 16" deep top or upper board or panel 240 and a 24" deep base will perform better than if the top was 24" (conventional designs), 20" (better), 18" (even better). Furthermore, by having the top further back than the bottom, the toddler 242 now has significantly more difficulty in grabbing the upper drawers (the drawers 224 in upper section 236) as well as the appropriate stance. Plus the distance of a four drawer conventional dresser is closer to the toddler, than a dresser of the same height, but whose top is set back. As such, the toddler 242 will need to reach all the way forward and be off balance and the result is that they would be able to exert less force and engagement. This configuration provides significant resistance to advance forward. Reach and pull is significantly diminished by toddlers, babies and children.

Figure 35A:
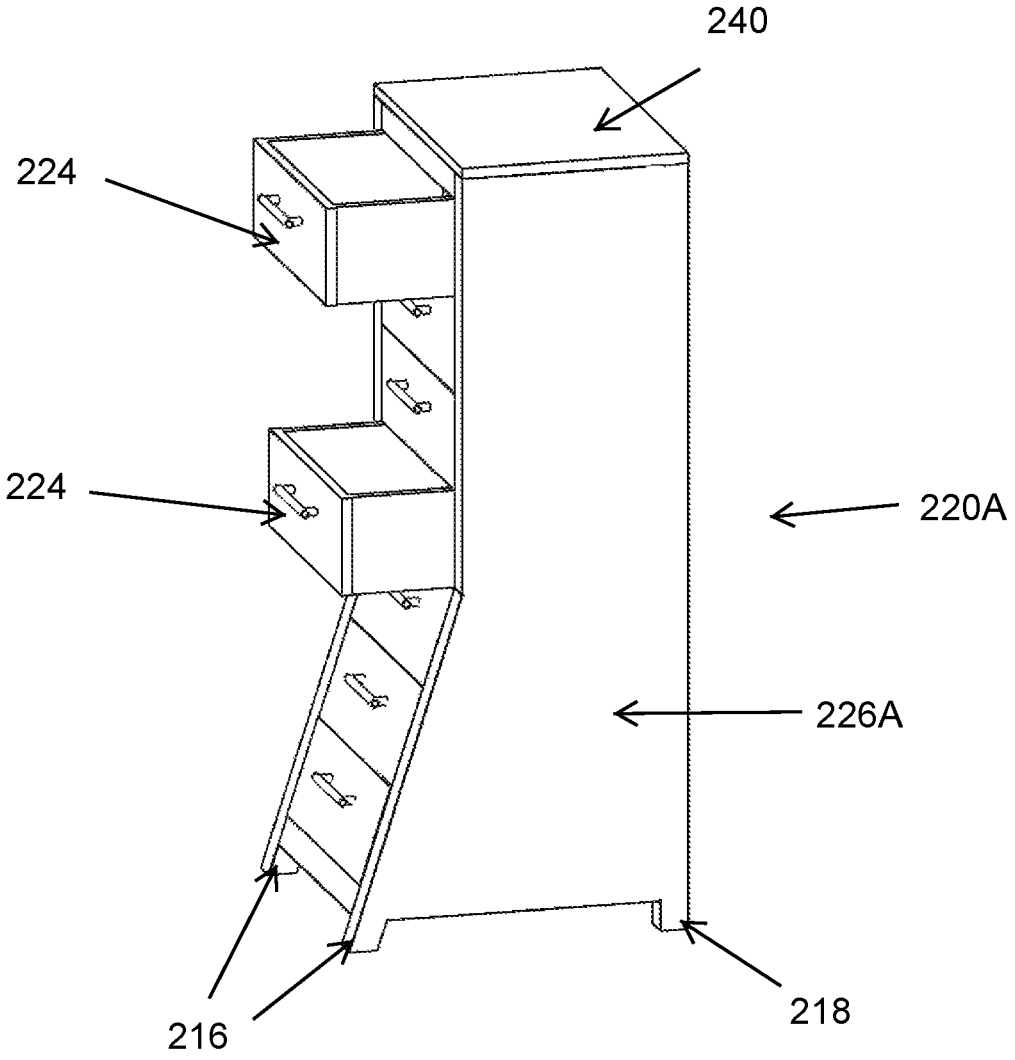
FIGS. 35A, 35B and 35C are perspective views of variations of the dresser of FIG. 35.
Figure 36A:
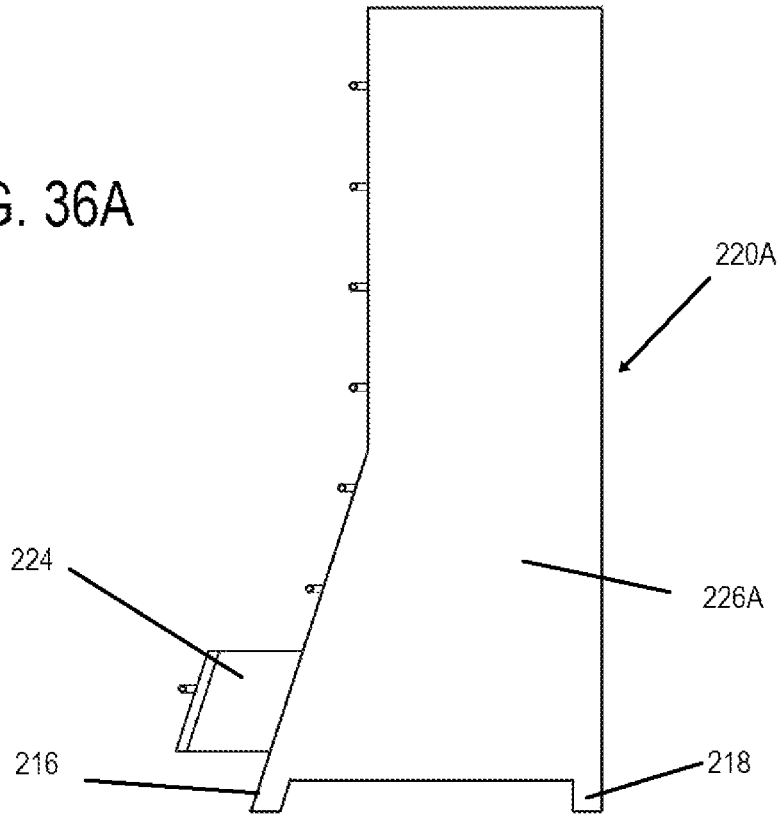
FIGS. 36A, 36B and 36C are each a side view of variations of the dresser of FIGS. 35A, 35B and 35C, respectively.

FIGS. 35A and 36A show a variant of the dresser 220, now designated 220A, wherein instead of three horizontal supports 238, there is a side panel 226A on each side of the dresser 220A. The side panels 226A extend from the upper panel 240 to the bottom of the dresser 220A and form and include front legs 216 and rear legs 218 spaced apart from the front legs 216. The side panels 226A perform the same function as the horizontal supports 238, e.g., provide front to back support for the frame of the dresser 220A.

Figure 35B:
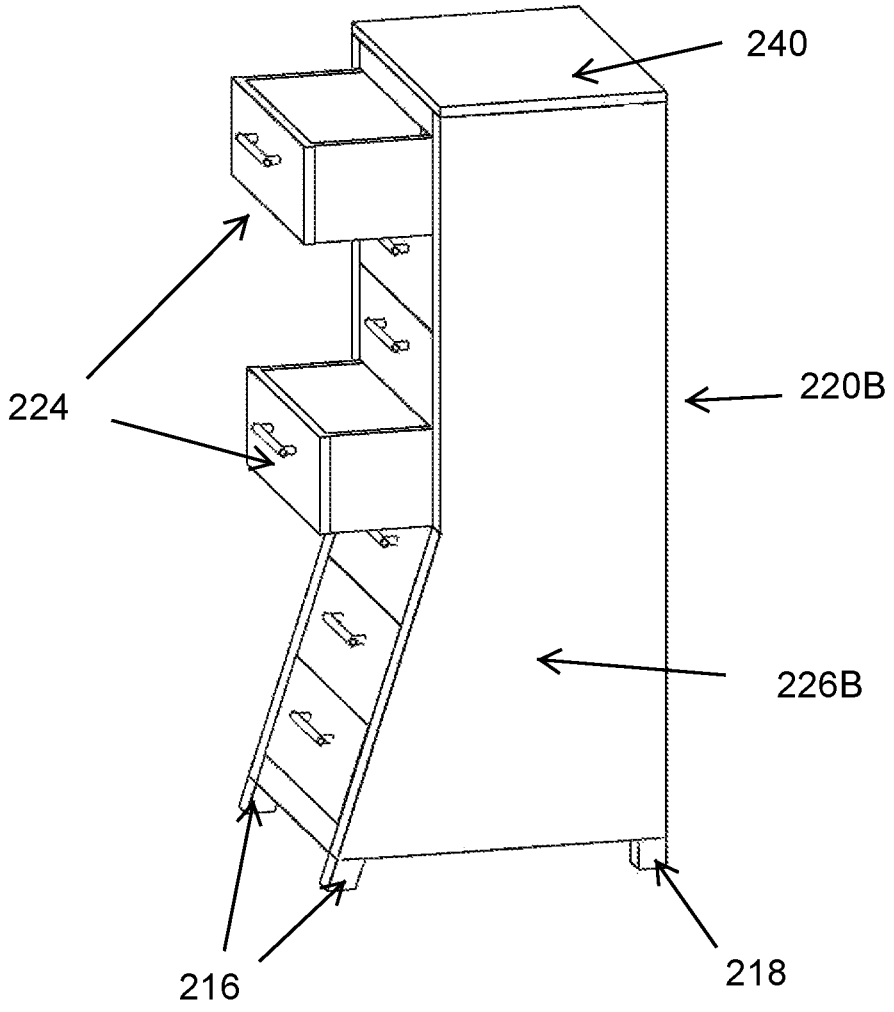
Figure 36B:
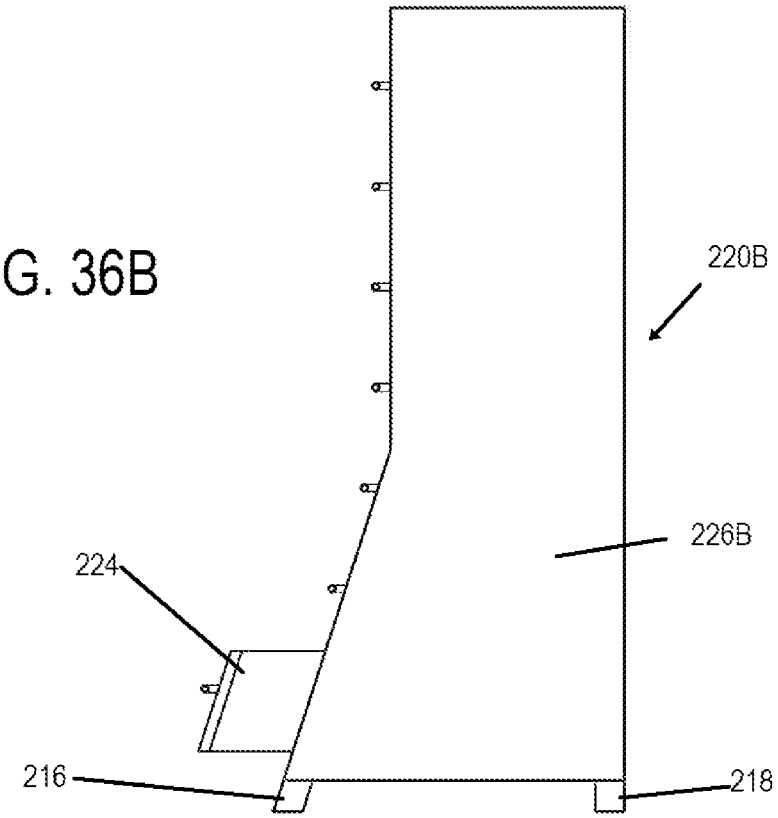

FIGS. 35B and 36B show another variant of the dresser 200, now designated 220B, wherein instead of three horizontal supports 238, there is a side panel 226B on each side of the dresser 220B. The side panels 226B extend from the upper panel 240 to the bottom of the dresser 220B but in contrast to side panels 226A in FIG. 35A, do not form front legs 216 and rear legs 218 spaced apart from the front legs 216. Rather, there are separate front and rear legs 216, 218. The side panels 226B perform the same function as the horizontal supports 238, e.g., provide front to back support for the frame of the dresser 220B.

Figure 35C:
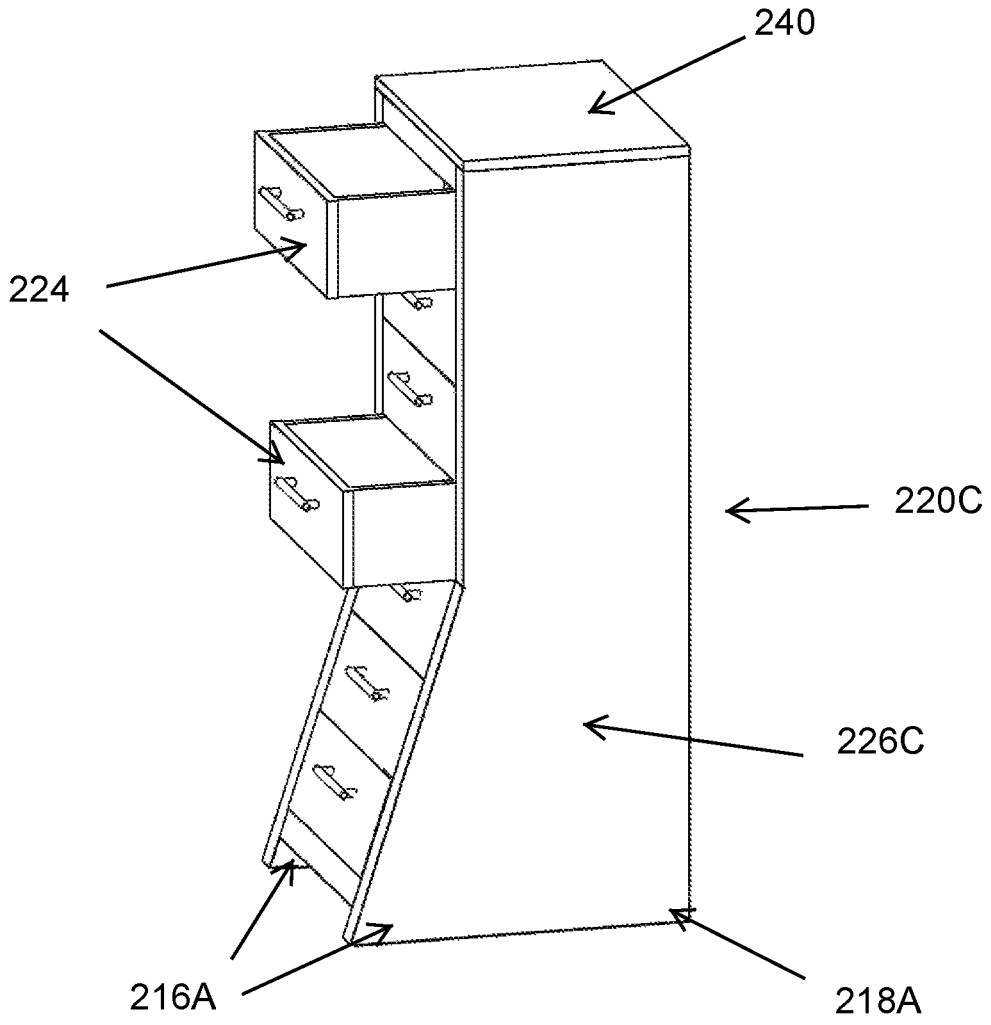
Figure 36C:
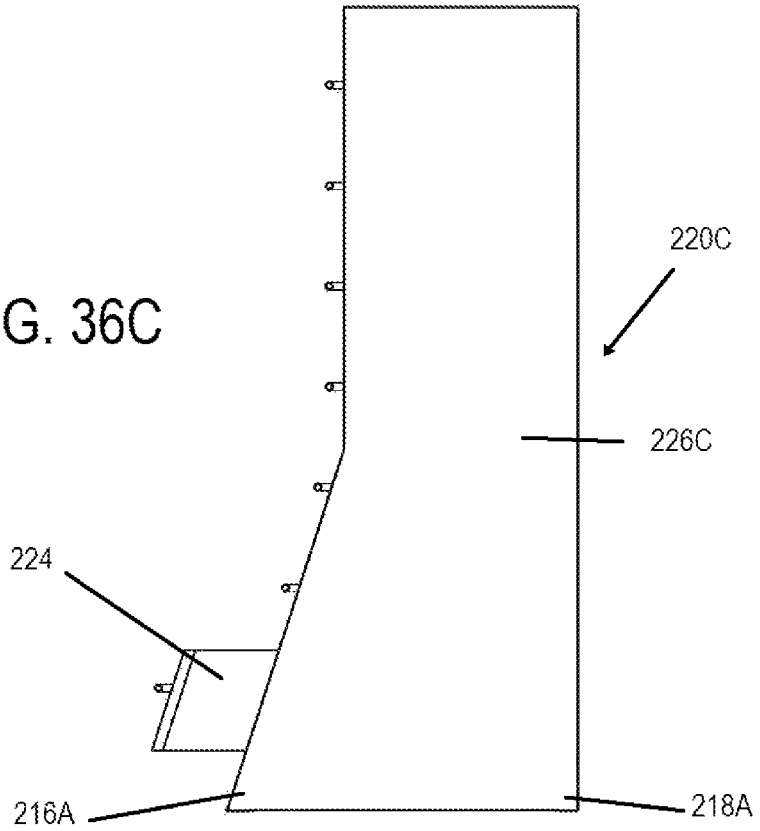

FIGS. 35C and 36C show another variant of the dresser 220, now designated 220C, wherein instead of three horizontal supports 238, there is a side panel 226C on each side of the dresser 220C. The side panels 226C extend from the upper panel 240 to the bottom of the dresser 220C and provide the lower/bottom surfaces of the frame that rest on and in contact with a horizontal surface. There are thus no separate legs in this variant. However, it may be considered that a front, lower portion of each of the side panels 226C forms a front support region 216A and a rear, lower portion of each of the side panels 226C forms a rear support region 218A. The side panels 226C perform the same function as the horizontal supports 238, e.g., provide front to back support for the frame of the dresser 220C, and the front and rear support regions 216A, 218A also perform the function of legs to form a support surface for the frame of the dresser 220C on and in contact with a horizontal surface. The lower surface of the side panels 226C may be flat as shown so that it would ideally rest in its entirety on a similarly flat horizontal surface.

Instead of horizontal supports 238, side panels 226A. 226B or 226C, other comparable or equivalent support structure may be used for a dresser like dressers 220, 220A, 220B, 220C.

Figure 37:
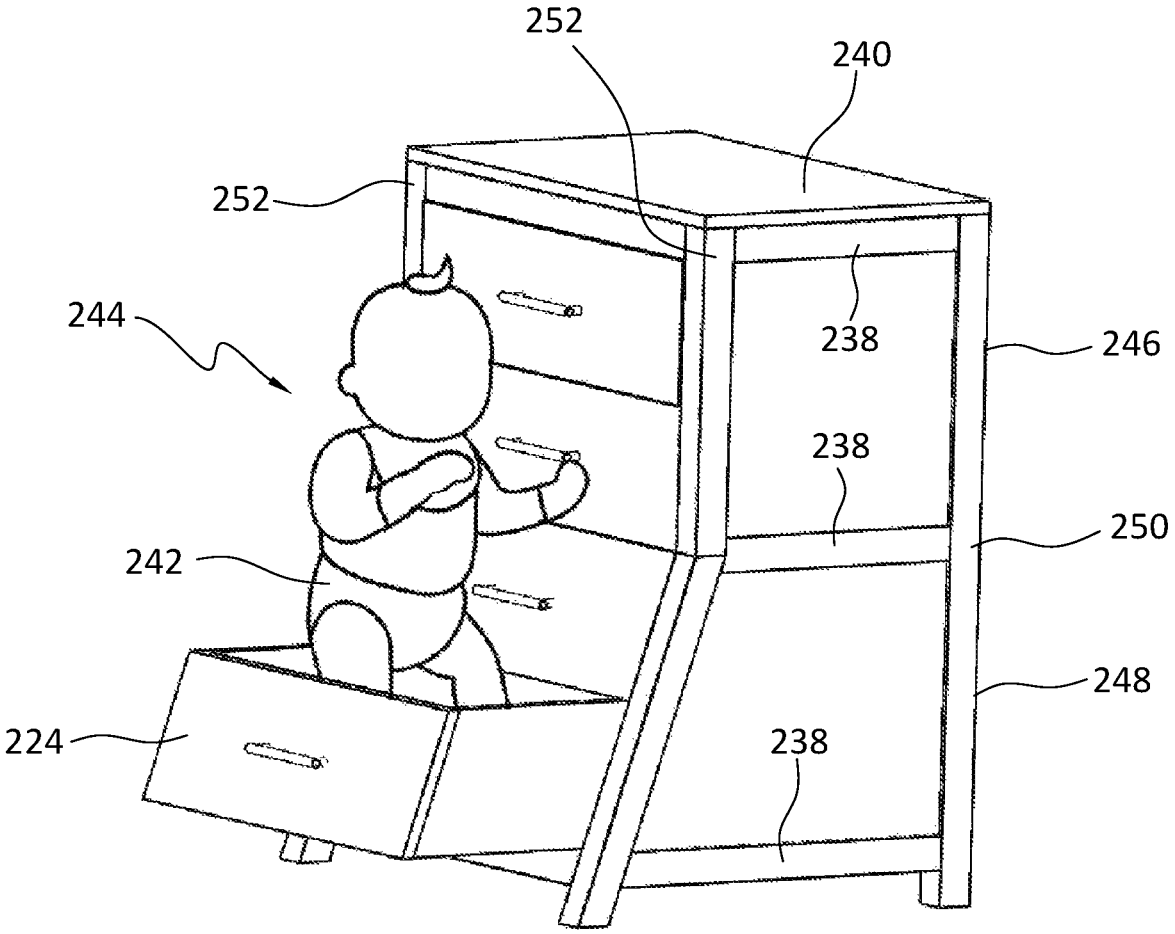
FIG. 37 is a perspective view of yet another embodiment of a dresser providing anti-tipping properties in accordance with the invention showing a toddler in one of the drawers, similar to the embodiment shown in FIG. 35.

Referring now to FIG. 37, this embodiment of a dresser 244 differs from the dresser 220 shown in FIGS. 35 and 36 in that instead of four drawers 224 in the upper portion 236 and three drawers 224 in the lower portion 234 of dresser 220, there only two drawers 224 in each of the upper section 246 and the lower section 248. The number of drawers 224 in the upper and lower sections of dresser 220 can thus vary to those as shown in FIG. 37 or any other numerical configuration.

The vertical supports 250, 252 in dresser 244 are similar to vertical supports 226, 228 in dresser 220, but dimensioned differently relative to the presence of only two drawers 224 in each of the upper and lower sections 246, 248. Thus, front vertical supports 250 have two sections, shorter than sections 230, 232, assuming the same height drawers 224 are provided in dresser 244 as in dresser 220. Otherwise, the components of dresser 244 are similar to those in dresser 220.

Figure 37A:
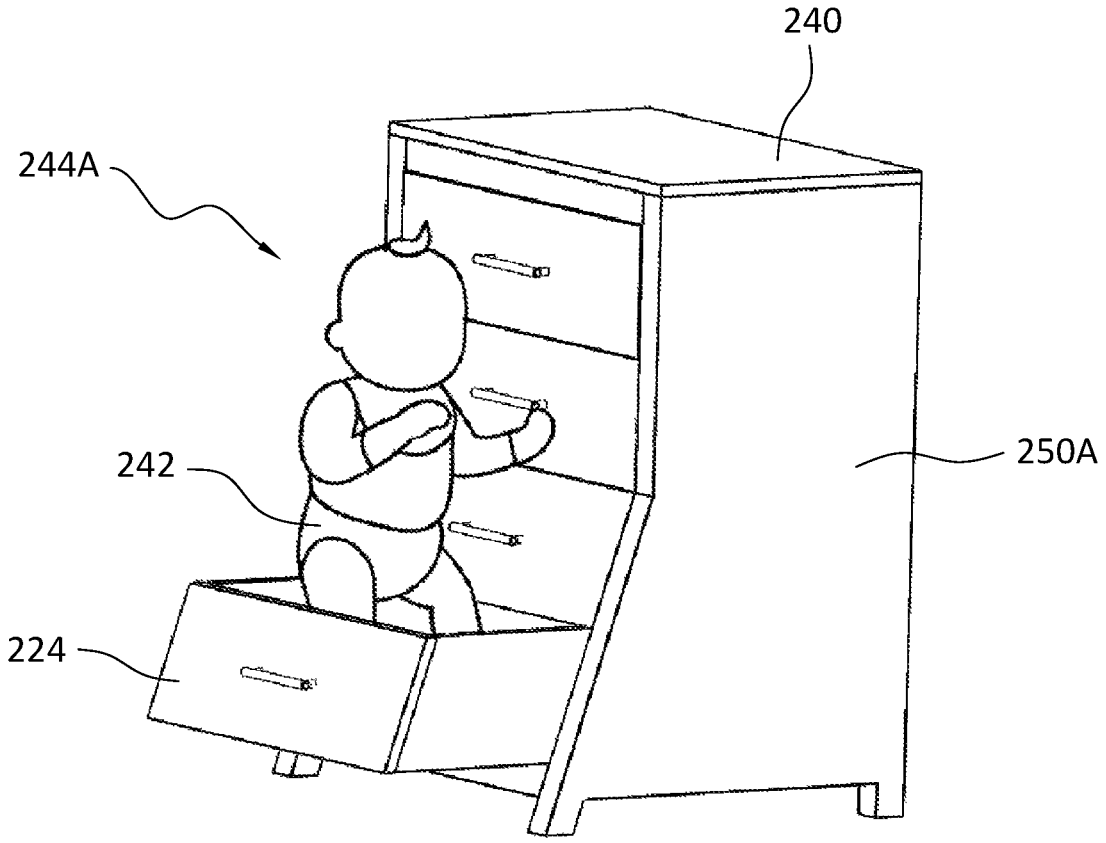
FIGS. 37A, 37B and 37C are perspective views of other embodiments of a dresser providing anti-tipping properties in accordance with the invention similar to the embodiment shown in FIG. 37 but with different side panels.

In a variant shown in FIG. 37A, a dresser 244A can be designed with full panels on both sides, one such panel 250A being shown on the right side, and may not have discrete vertical supports 250, 252 such as in this case. The side panels 250A extend from the upper panel 240 to the bottom of the dresser 244A and form and include front legs 216 and rear legs 218 spaced apart from the front legs 216. Such a design construction will function substantially the same as other dressers disclosed herein.

Figure 37B:
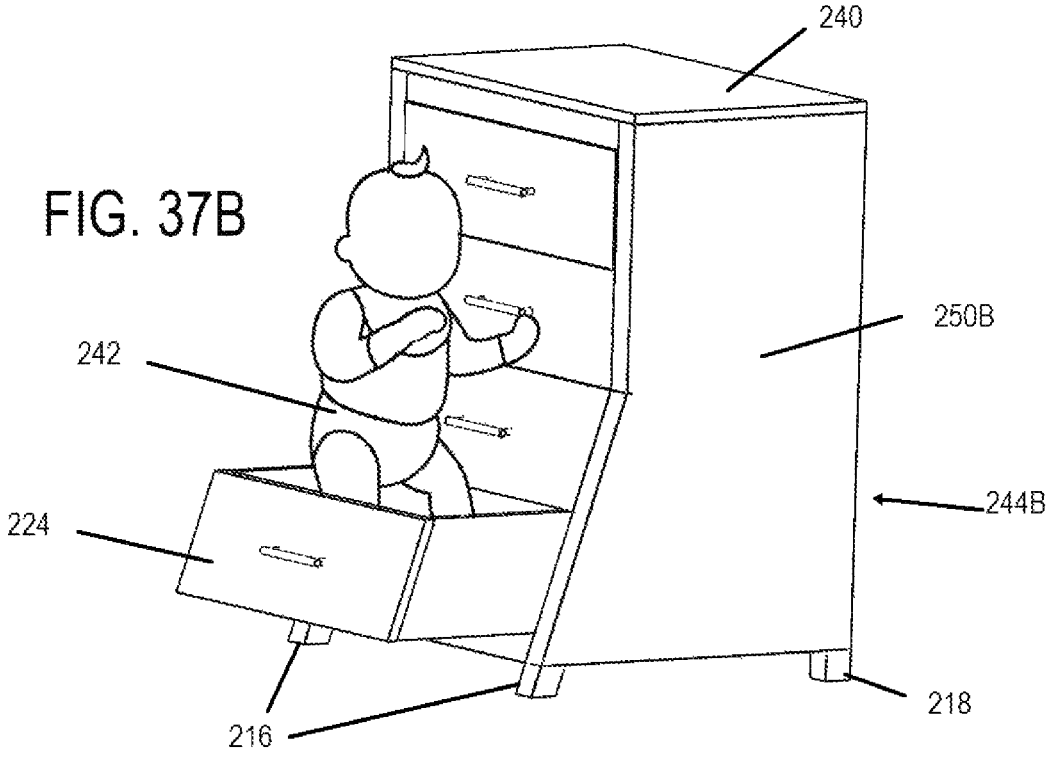

In another variant shown in FIG. 37B, a dresser 244B can be designed with full panels on both sides, one such panel 250B being shown on the right side, and may not have vertical supports 250, 252 such as in this case. The side panels 250B extend from the upper panel 240 to the bottom of the dresser 244B but in contrast to side panels 250A in FIG. 37A, do not form front legs 216 and rear legs 218 spaced apart from the front legs 216. Rather, there are separate front and rear legs 216, 218. The side panels 250B perform the same function as the horizontal supports 238, e.g., provide front to back support for the frame of the dresser 244B.

Figure 37C:
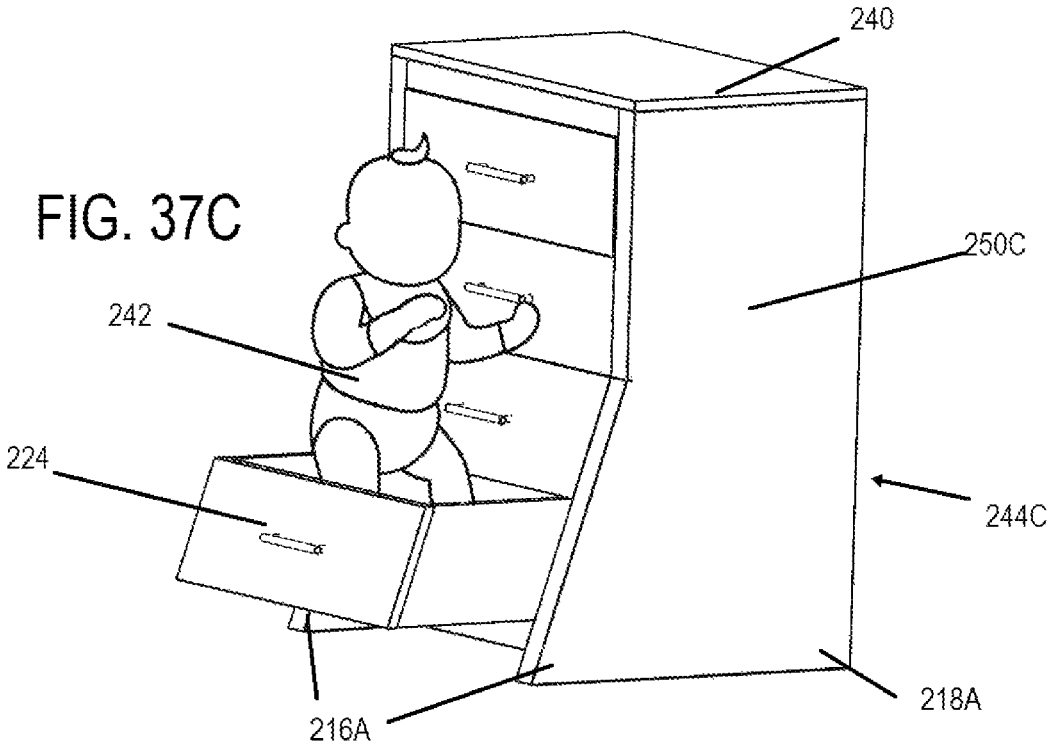

In another variant shown in FIG. 37C, a dresser 244C can be designed with full panels on both sides, one such panel 250C being shown on the right side, and may not have vertical supports 250, 252. The side panels 250C extend from the upper panel 240 to the bottom of the dresser 244C and provide the lower/bottom surfaces of the frame that rest on and in contact with a horizontal surface. There are thus no separate legs in this variant. However, it may be considered that a front, lower portion of each of the side panels 250C forms a front support region 216A and a rear, lower portion of each of the side panels 250C forms a rear support region 218A. The side panels 250C perform the same function as the horizontal supports 238, e.g., provide front to back support for the frame of the dresser 244C, and also perform the function of legs to form a support surface for the frame of the dresser 244C on and in contact with a horizontal surface. The lower surface of the side panels 250C may be flat as shown so that it would ideally rest in its entirety on a similarly flat horizontal surface.

It should thus be apparent to those skilled in the art to which this invention pertains that the number of drawers and their height is variable. The basic construction of a dresser exemplified by the dressers 220, 244 is that the front vertical supports include two elongate sections. The profile of the side can in some embodiments, be one panel with the exact shape and dresser configurations. As such vertical supports 226, 228, 250, 252 constitute just one such design. As shown in FIG. 37, a lower front vertical support extends forward and at an angle to an upper front vertical support to enable a lower portion of the dresser to have a larger front-to-back dimension, and a lower center of gravity than a dresser with only single depth drawers. The size of the two elongate sections is variable and depends on, for example, the desired height of the drawers and the number of drawers.

A general feature of the embodiments of FIGS. 37-37C is that there are two side, front facing parts of the frame of the dresser that each has two discrete sections, namely an upper straight and elongate vertical section adjacent and/or adjoining the upper panel of the frame and a lower straight and elongate section adjacent and/or adjoining a lower panel of the frame and that is at an angle to the upper section (which may be referred to as a tapered section since it extends at a forward angle to the upper section). The upper vertical section may be perpendicular to the horizontal axis or plane through the dresser. The front facing parts may be formed or defined by specific vertical supports which have two elongate sections, like vertical supports 228 with the two elongate sections 230, 232 described above, or provided integral with or as a portion of a side panel, like in side panels 250A, 250B and 250C. The manner in which the front facing parts on the sides of the frame are provided with the vertical and tapered sections is dependent on, for example, the designer of the furniture and the design sought. It does not affect the anti-tipping properties of the furniture. If a side panel is sought, then the vertical and tapered sections would be incorporated into side panels, i.e., the side panels may be considered to include an upper front vertical support section and a lower front vertical support section. If the appearance of discrete frame sections is sought, then the front vertical supports 228 would be formed and provided with their two sections 230, 232.

A similar variability is present with respect to the legs. The legs may be provided as separate components attached to the frame, e.g., to the lower panel, or formed integral with the side panels. Alternatively, separate legs may be eliminated and the function of the legs incorporated into the side panels (see FIG. 37C). Other support structure to support the furniture instead of legs or side panels may also be provided without deviating from the scope and spirit of the invention.

Figure 38:
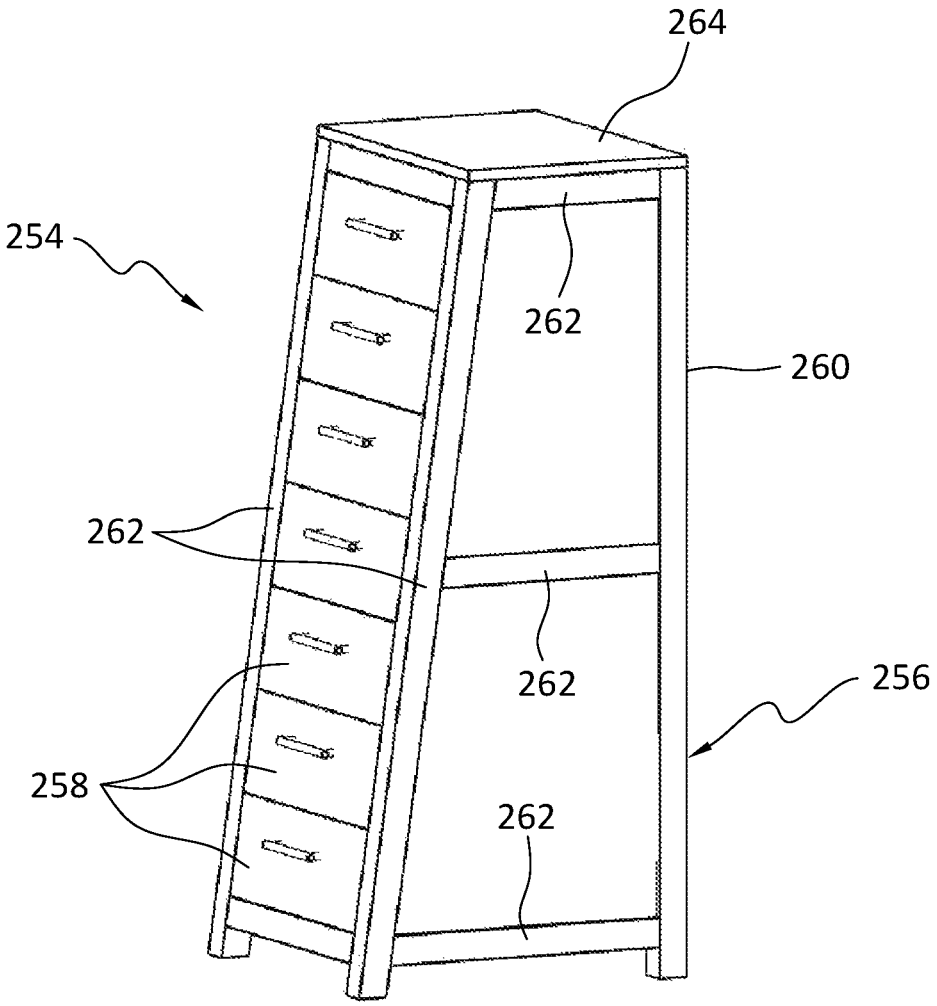
FIG. 38 is a perspective view of another embodiment of a dresser providing anti-tipping properties in accordance with the invention.
Figure 39:
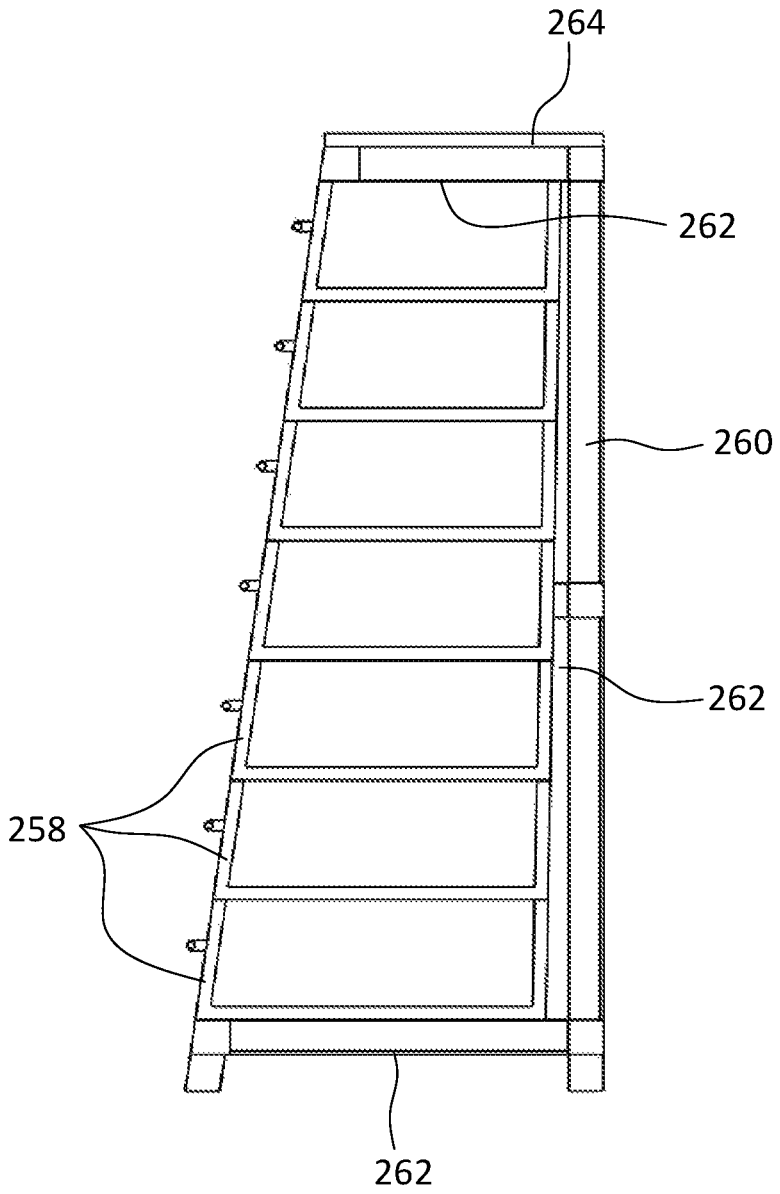
FIG. 39 is an internal, cross-sectional view of dresser shown in FIG. 38.

FIGS. 38 and 39 show another embodiment of a dresser 254 integrating or incorporating anti-tipping properties in accordance with the invention includes a frame 256, a plurality of drawers 258, and hardware (not shown) to enable the drawers 258 to slide into and out of the frame 256 while being secured therein. The hardware is well-known to those skilled in the art.

The frame 256 includes two rear vertical supports 260, one on each side of the dresser 254, and two front vertical supports 262, one on each side of the dresser 254 and aligning with a respective one of the rear vertical supports 260. The rear vertical supports 260 are elongate and straight, preferably over their entire length. The front vertical supports 262 are also elongate and straight, preferably over their entire length, but oriented at an acute angle to a longitudinal axis of rear vertical supports 260, i.e., the longitudinal axis of the front vertical support 262 on each of the left and right sides of the dresser 254 intersects the longitudinal axis of the corresponding rear vertical support 260 on the left or right side of the dresser 254 at an acute angle. Supports 262 are also angled toward the front of the dresser 254.

This acute angle may be anywhere from about 5 degrees to about 60 degrees. An optimum angle or angular range can be determined by considering the objectives of the invention, e.g., tipping prevention, and different dressers 254 can be made with different angles between the rear vertical supports 260 and the front vertical supports 262.

As a result of the angular orientation of front vertical supports 262 relative to rear vertical supports 260, the front-to-back dimension of the dresser 254 increases in the downward direction from an upper board or panel 264. As such, the drawers 258 have a gradually increasing depth when proceeding from the uppermost drawer 258 to the lowermost drawer 258 (see FIG. 39). The front panel of each drawer 258 may be angled at an angle commensurate with the angular orientation of the front vertical supports 262 (see FIG. 39). Also, a bottom front region of the lower section is more forward from a central vertical plane of the frame than a top front region. Horizontal supports 266 include one support at the bottom of the dresser 254, one in a middle region of the dresser 254, and one at the top of the dresser 254. A different number and position of horizontal supports 266 may be provided. The lowermost horizontal support 266 may be a small distance above the lower edge of the rear and front vertical supports 260, 262 to enable a lower end region of the rear and front vertical supports 260, 262 to form legs for the dresser 254.

The frame 256 may also include a lower board or panel to define a support for the lowermost one of the drawers 258.

When a child grabs the uppermost one of the drawers 258 when in an open state or stands on the lowermost one of the drawers 258 when in an open state, the child is unlikely to cause the dresser 254 to tip because of the lower center of gravity of the dresser 254 resulting from the larger drawers 258 at the bottom.

Figure 38A:
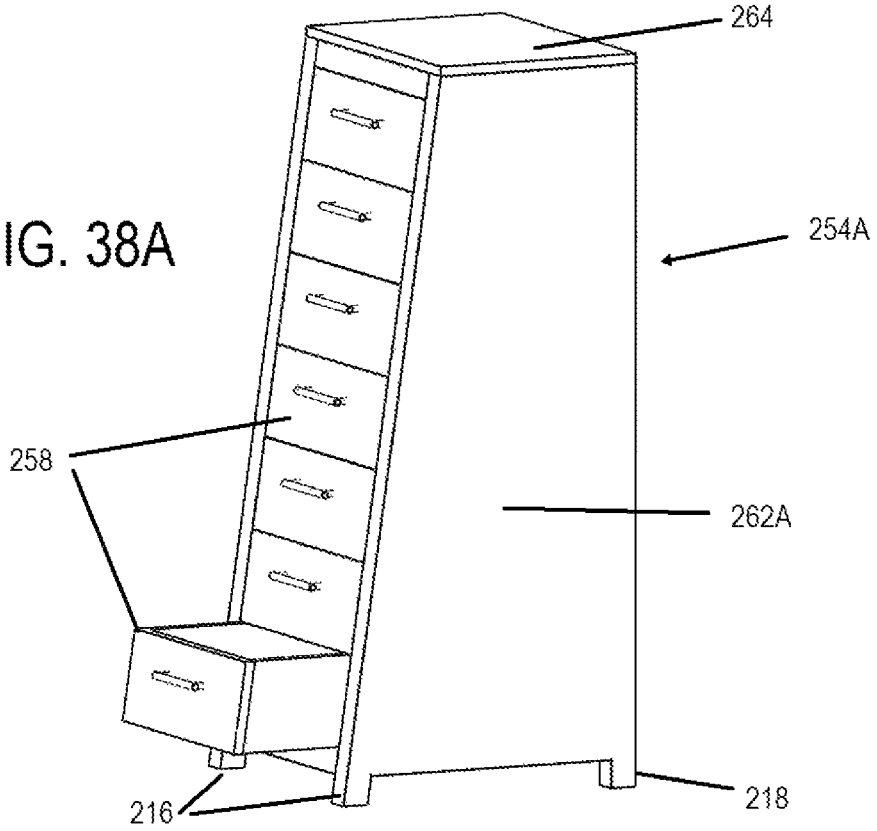
FIGS. 38A, 38B and 38C are perspective views of other embodiments of a dresser providing anti-tipping properties in accordance with the invention similar to the embodiment shown in FIG. 38 but with different side panels.

FIG. 38A shows a variant of the dresser 254, now designated 254A, wherein instead of three horizontal supports 266, there is a side panel 262A on each side of the dresser 254A. The side panels 262A extend from the upper panel 264 to the bottom of the dresser 254A and form and include front legs 216 and rear legs 218 spaced apart from the front legs 216. The side panels 262A perform the same function as the horizontal supports 266, e.g., provide front to back support for the frame of the dresser 254A.

Figure 38B:
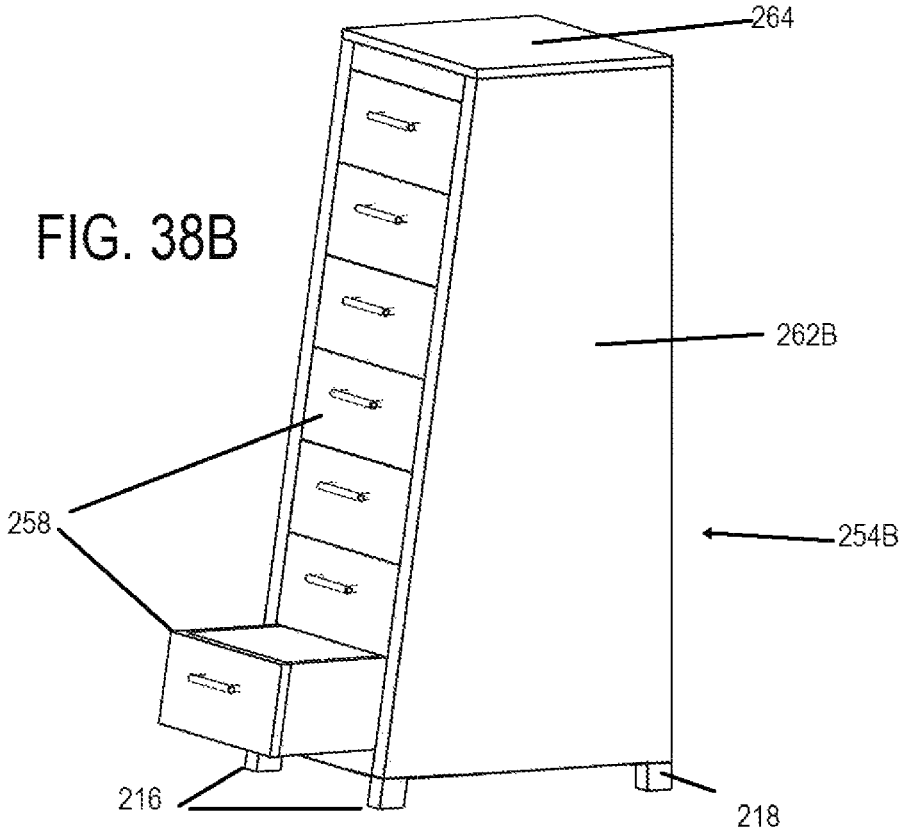

FIG. 38B shows another variant of the dresser 254, now designated 254B, wherein instead of three horizontal supports 266, there is a side panel 262B on each side of the dresser 254B. The side panels 262B extend from the upper panel 264 to the bottom of the dresser 254B but in contrast to side panels 262A in FIG. 38A, do not form front legs 216 and rear legs 218 spaced apart from the front legs 216. Rather, there are separate front and rear legs 216, 218. The side panels 262B perform the same function as the horizontal supports 266, e.g., provide front to back support for the frame of the dresser 254B.

Figure 38C:
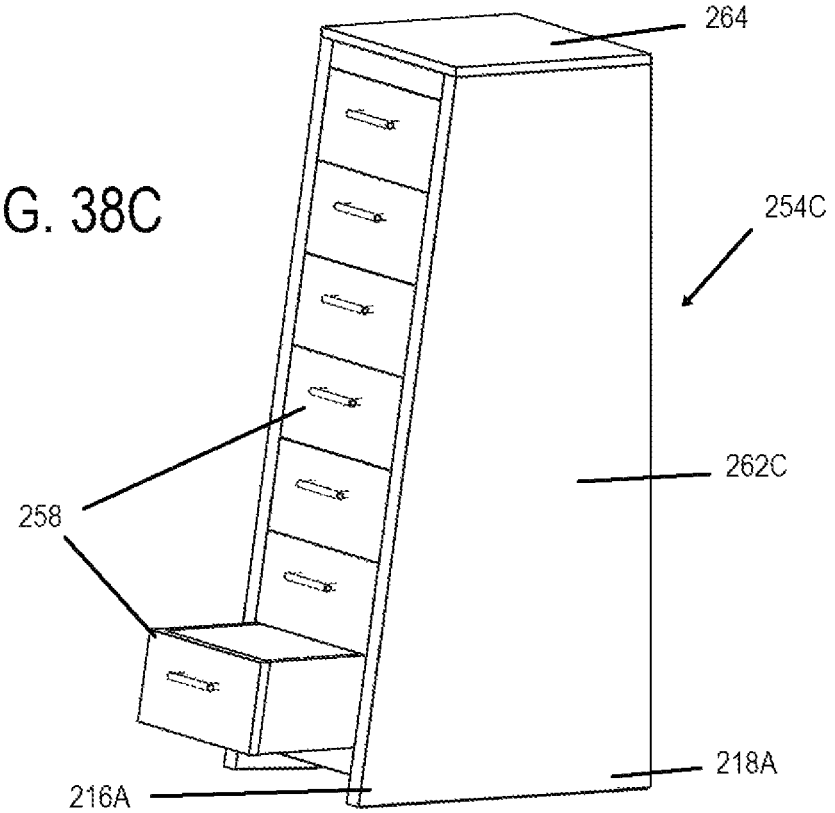

FIG. 38C shows another variant of the dresser 254, now designated 254C, wherein instead of three horizontal supports 266, there is a side panel 262C on each side of the dresser 254C. The side panels 262C extend from the upper panel 264 to the bottom of the dresser 254C and provide the lower/bottom surfaces of the frame that rest on and in contact with a horizontal surface. There are thus no separate legs in this variant. However, it may be considered that a front, lower portion of each of the side panels 262C forms a front support region 216A and a rear, lower portion of each of the side panels 262C forms a rear support region 218A. The side panels 262C perform the same function as the horizontal supports 266, e.g., provide front to back support for the frame of the dresser 254C, and also perform the function of legs to form a support surface for the frame of the dresser 254C on and in contact with a horizontal surface. The lower surface of the side panels 262C may be flat as shown so that it would ideally rest in its entirety on a similarly flat horizontal surface.

Accordingly, instead of horizontal supports 266, side panels 262A, 262B or 262C, other comparable or equivalent support structure may be used for a dresser like dressers 254, 254A, 254B, 254C.

A general feature of the embodiments of FIGS. 38-38C is that there are two side, front facing parts of the frame of the dresser that each has a single elongate and straight section extending from the upper panel of the frame to the bottom of the frame and that is at an angle to the rear facing parts of the frame. The front facing parts may be formed or defined by specific vertical supports which have a single elongate sections, like vertical supports 262 described above, or provided integral with or as a portion of a side panel, like in side panels 262A, 262B and 262C. The manner in which the front facing parts on the sides of the frame are provided with a single elongate section is dependent on, for example, the designer of the furniture and the design sought. It does not affect the anti-tipping properties of the furniture. If a side panel is sought, then the single elongate section would be incorporated into a side panel, i.e., the side panels may be considered to include an elongate section at the front. If the appearance of discrete frame sections is sought, then the front vertical supports 262 would be formed.

A similar variability is present with respect to the legs. The legs may be provided as separate components attached to the frame, e.g., to the lower panel, or formed integral with the side panels. Alternatively, separate legs may be eliminated and the function of the legs incorporated into the side panels (see FIG. 38C). Other support structure to support the furniture instead of legs or side panels may also be provided without deviating from the scope and spirit of the invention.

Figure 40:
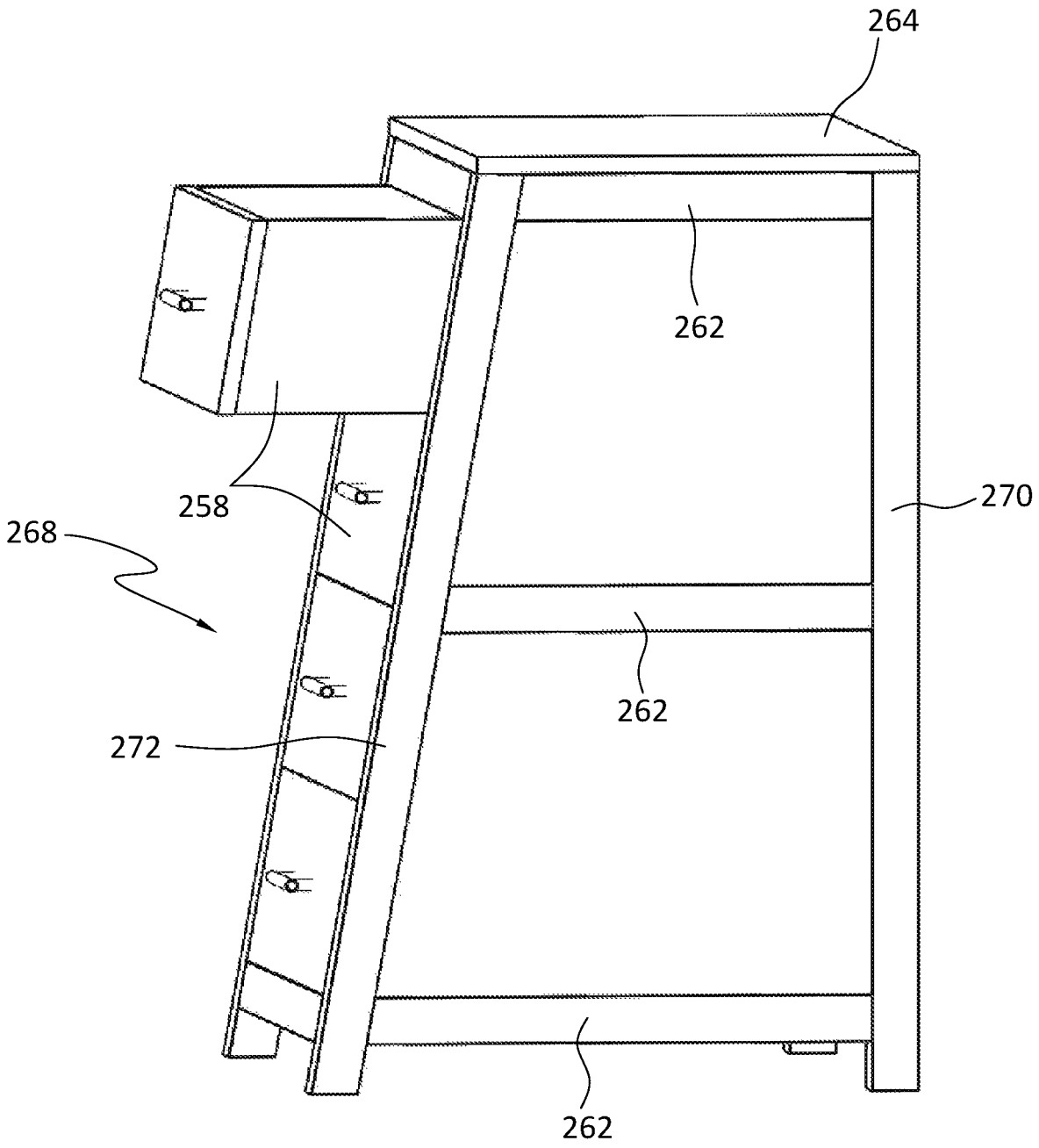
FIG. 40 is a perspective view of another embodiment of a dresser providing anti-tipping properties in accordance with the invention.

FIG. 40 shows an embodiment of a dresser 268 differs from the dresser 254 shown in FIGS. 38 and 39 in that instead of seven drawers 258, there only four drawers 258 of basically equal height resulting in a shorter dresser 268. The number of drawers 258 can thus vary to those as shown in FIGS. 38 and 39 or any other numerical configuration.

The vertical supports 270, 272 in the dresser 268 are similar to rear and front vertical supports 260, 262 in the dresser 254, but dimensioned differently relative to the presence of only four drawers 258. Other aspects of dresser 268 are the same as those of dresser 254, or possibly dressers 220, 244.

It should thus be apparent to those skilled in the art to which this invention pertains that the number of drawers in a dresser exhibiting anti-tipping properties and their height is variable. The basic construction of the dresser is that the front vertical supports are angled forward relative to the vertical rear supports to have an increasing front-to-back dimension in a direction downward from the upper board of the dresser, and thus a lower center of gravity than a dresser with only single depth drawers. Also, a bottom front region of the lower section is more forward from a central vertical plane of the frame than a top front region.

Figure 40A:
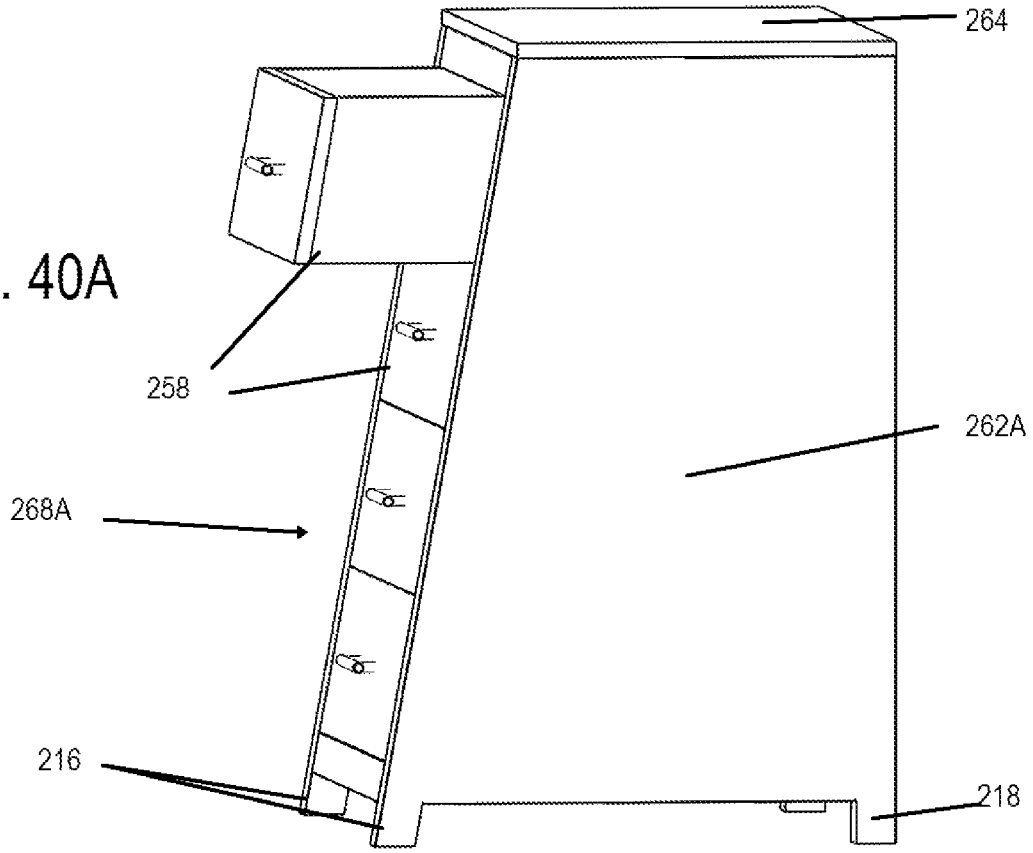
FIGS. 40A, 40B and 40C are perspective views of other embodiments of a dresser providing anti-tipping properties in accordance with the invention similar to the embodiment shown in FIG. 40 but with different side panels.

FIG. 40A shows a variant of the dresser 268, now designated 268A, wherein instead of three horizontal supports 266, there is a side panel 270A on each side of the dresser 268A. The side panels 270A extend from the upper panel 264 to the bottom of the dresser 268A and form and include front legs 216 and rear legs 218 spaced apart from the front legs 216. The side panels 270A perform the same function as the horizontal supports 266, e.g., provide front to back support for the frame of the dresser 268A.

Figure 40B:
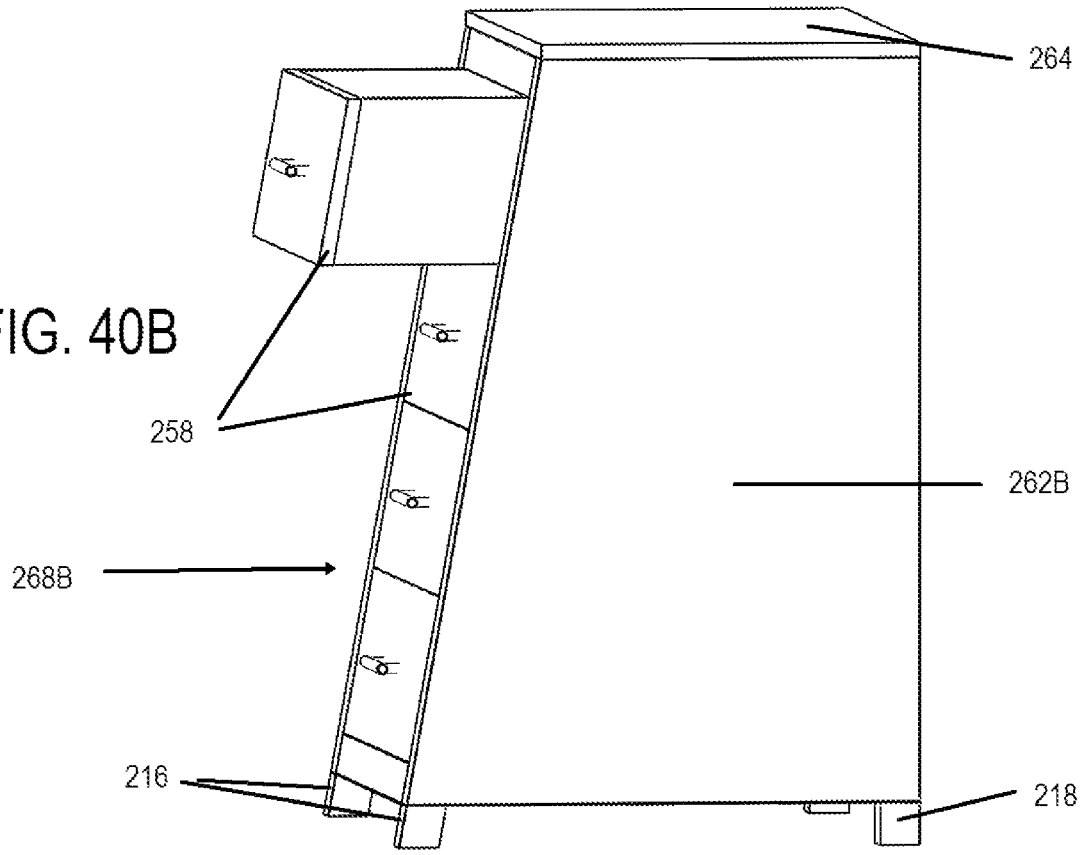

FIG. 40B shows another variant of the dresser 268, now designated 268B, wherein instead of three horizontal supports 266, there is a side panel 270B on each side of the dresser 268B. The side panels 270B extend from the upper panel 264 to the bottom of the dresser 268B but in contrast to side panels 270A in FIG. 40A, do not form front legs 216 and rear legs 218 spaced apart from the front legs 216. Rather, there are separate front and rear legs 216, 218. The side panels 270B perform the same function as the horizontal supports 266, e.g., provide front to back support for the frame of the dresser 268B.

Figure 40C:
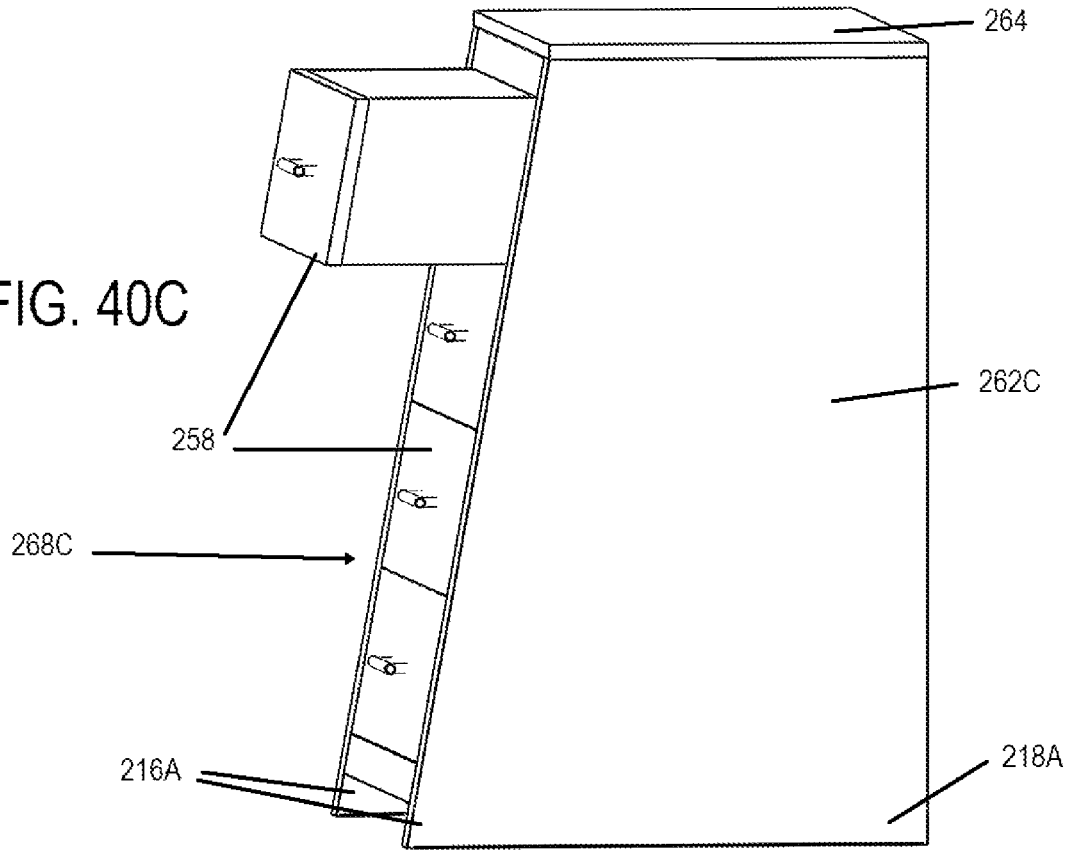

FIG. 40C shows another variant of the dresser 268, now designated 268C, wherein instead of three horizontal supports 266, there is a side panel 270C on each side of the dresser 268C. The side panels 270C extend from the upper panel 264 to the bottom of the dresser 268C and provide the lower/bottom surfaces of the frame that rest on and in contact with a horizontal surface. There are thus no separate legs in this variant. However, it may be considered that a front, lower portion of each of the side panels 270C forms a front support region 216A and a rear, lower portion of each of the side panels 270C forms a rear support region 218A. The side panels 270C perform the same function as the horizontal supports 266, e.g., provide front to back support for the frame of the dresser 268C, and also perform the function of legs to form a support surface for the frame of the dresser 268C on and in contact with a horizontal surface. The lower surface of the side panels 270C may be flat as shown so that it would ideally rest in its entirety on a similarly flat horizontal surface.

Accordingly, instead of horizontal supports 266, side panels 262A, 262B or 262C, other comparable or equivalent support structure may be used for a dresser like dressers 268, 268A, 268B, 268C.

A general feature of the embodiments of FIGS. 40-40C is that there are two side, front facing parts of the frame of the dresser that each has a single elongate section extending from the upper panel of the frame to the bottom of the frame and that is at an angle to the rear facing parts of the frame. The front facing parts may be formed or defined by specific vertical supports which have a single elongate sections, like vertical supports 272 described above, or provided integral with or as a portion of a side panel, like in side panels 270A, 270B and 270C. The manner in which the front facing parts on the sides of the frame are provided with a single elongate section is dependent on, for example, the designer of the furniture and the design sought. It does not affect the anti-tipping properties of the furniture. If a side panel is sought, then the single elongate section would be incorporated into a side panel, i.e., the side panels may be considered to include an elongate section at the front. If the appearance of discrete frame sections is sought, then the front vertical supports 272 would be formed.

A similar variability is present with respect to the legs. The legs may be provided as separate components attached to the frame, e.g., to the lower panel, or formed integral with the side panels. Alternatively, separate legs may be eliminated and the function of the legs incorporated into the side panels (see FIG. 40C). Other support structure to support the furniture instead of legs or side panels may also be provided without deviating from the scope and spirit of the invention.

Figure 41:
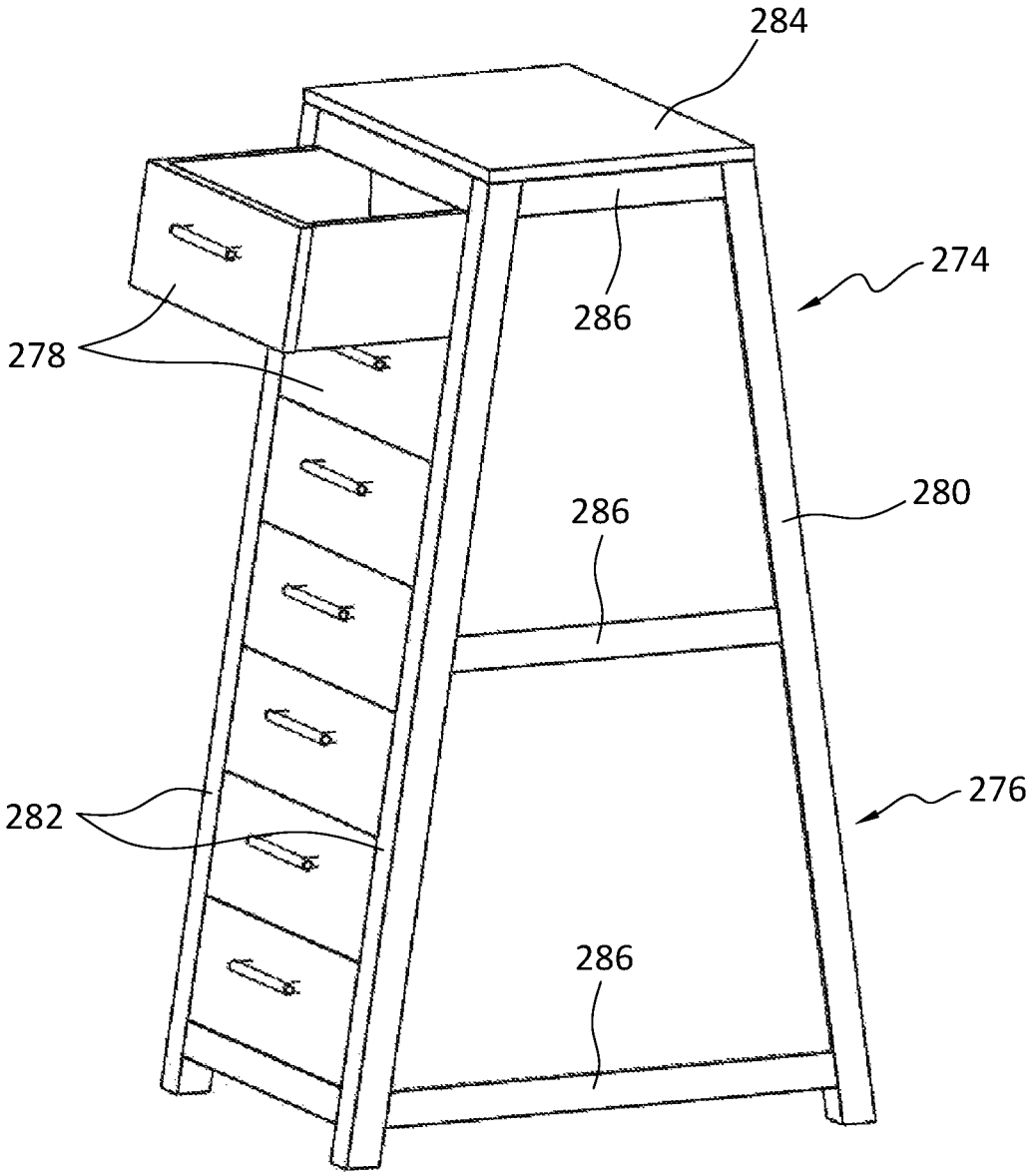
FIG. 41 is a perspective view of another embodiment of a dresser providing anti-tipping properties in accordance with the invention.

FIG. 41 shows another embodiment of a dresser 274 in accordance with the invention includes a frame 276, a plurality of drawers 278, and hardware (not shown) to enable the drawers 278 to slide into and out of the frame 276 while being secured therein. The hardware is well-known to those skilled in the art.

The frame 276 includes two rear vertical supports 280, one on each side of the dresser 274, and two front vertical supports 282, one on each side of the dresser 274 and aligning with a respective one of the rear vertical supports 280. Dresser 274 is similar to dresser 254 but has a significant difference.

Specifically, the rear vertical supports 280 are elongate and straight, preferably over their entire length, and oriented rearward and at an acute angle to a vertical axis of the dresser 274 that is perpendicular to the horizontal portions of the dresser 274, i.e., an upper board or panel 284 and bottoms of the drawers 278. Similarly, the front vertical supports 282 are elongate and straight, preferably over their entire length, and oriented forward and at an acute angle to the same vertical axis of the dresser 274. As such, the rear and front vertical supports 280, 282 are angled toward the vertical axis of the dresser 274 and also toward one another. Neither longitudinal axis defined by the rear and front vertical supports 280, 282 is parallel to the vertical axis of the dresser 274. A bottom front region of the lower section is more forward from a central vertical plane of the frame than a top front region.

These acute angles may be anywhere from about 5 degrees to about 60 degrees. An optimum angle or angular range can be determined by considering the objectives of the invention, e.g., tipping prevention, and different dressers 274 can be made with different angles between each of the rear and front vertical supports 280, 282 and the vertical axis of the dresser 274.

As a result of the angular orientation of rear and front vertical supports 280, 282 relative to the vertical axis of the dresser 274, the front-to-back dimension of the dresser 274 increases in the downward direction from the upper board or panel 284. As such, the drawers 278 have a gradually increasing depth when proceeding from the uppermost one of the drawers 278 to the lowermost one of the drawers 278. The front panel of each drawer 278 may be angled at an angle commensurate with the angular orientation of the supports 282.

Horizontal supports 286 include one support at the bottom of the dresser 274, one in a middle region of the dresser 274, and one at the top of the dresser 274. A different number and position of horizontal supports 286 may be provided. The lowermost horizontal support 286 may be a small distance above the lower edge of the rear and front vertical supports 280, 282 to enable a lower end region of the vertical supports 280, 282 to form legs for the dresser 274. The frame 276 may also include a lower board or panel to define a support for the lowermost one of the drawers 278.

When a child grabs the uppermost one of the drawers 278 when in an open state or stands on the lowermost one of the drawers 278 when in an open state, the child is unlikely to cause the dresser 274 to tip because of the lower center of gravity of the dresser 274 resulting from the larger drawers at the bottom.

Figure 41A:
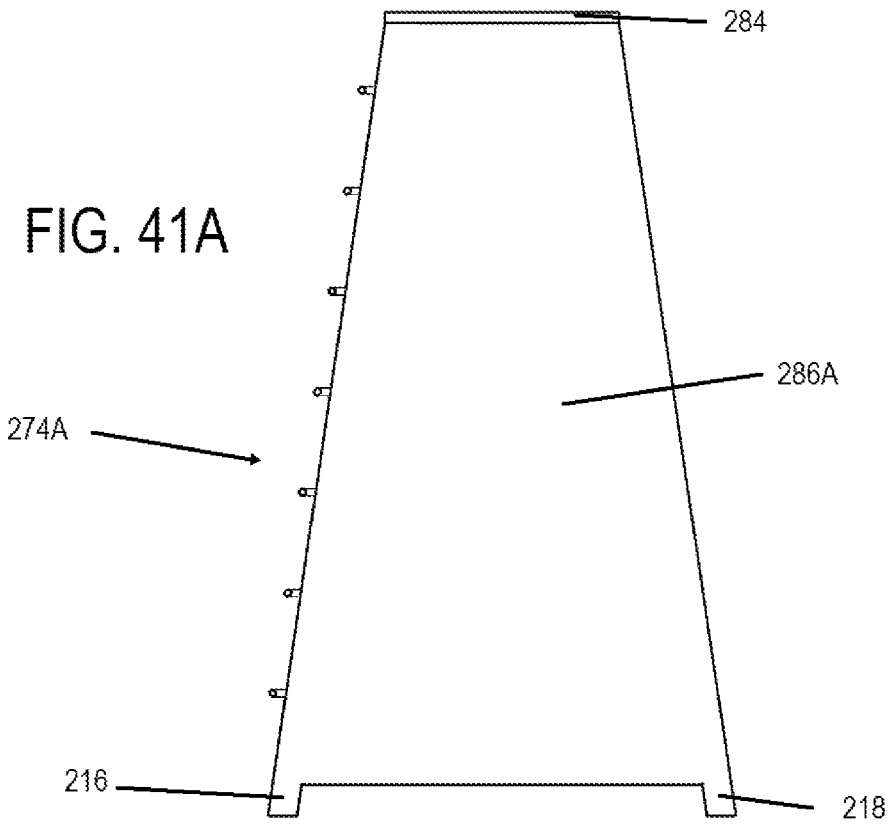
FIGS. 41A, 41B and 41C are side views of other embodiments of a dresser providing anti-tipping properties in accordance with the invention similar to the embodiment shown in FIG. 41 but with different side panels.

FIG. 41A shows a variant of the dresser 274, now designated 274A, wherein instead of three horizontal supports 286, there is a side panel 286A on each side of the dresser 274A. The side panels 286A extend from the upper panel 284 to the bottom of the dresser 274A and form and include front legs 216 and rear legs 218 spaced apart from the front legs 216. The side panels 286A perform the same function as the horizontal supports 286, e.g., provide front to back support for the frame of the dresser 274A.

Figure 41B:
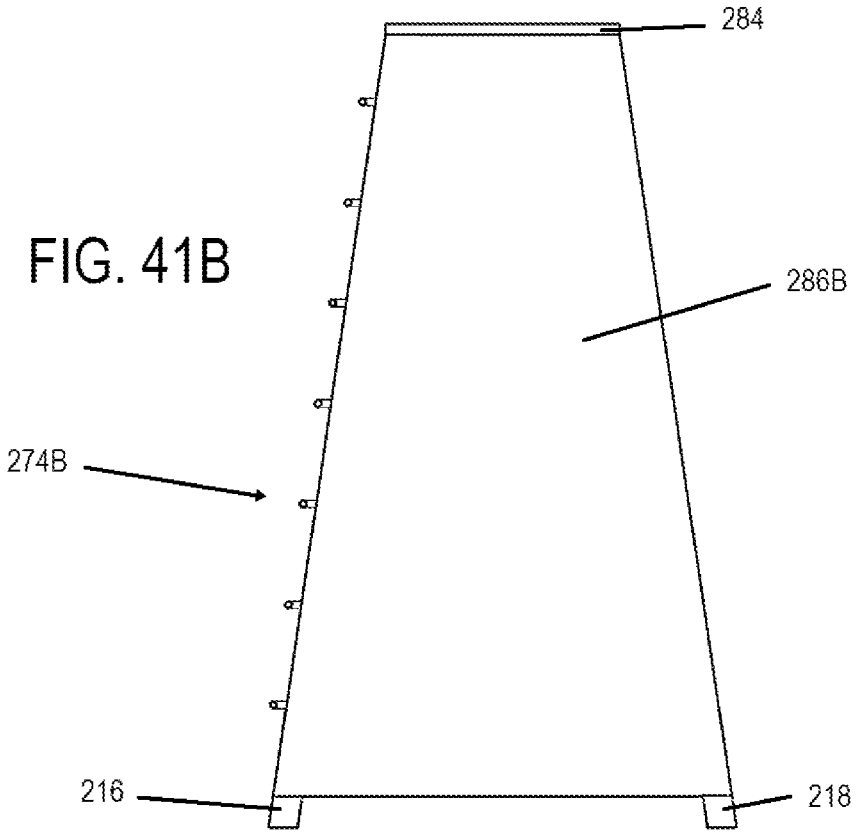

FIG. 41B shows another variant of the dresser 274, now designated 274B, wherein instead of three horizontal supports 286, there is a side panel 286B on each side of the dresser 274B. The side panels 286B extend from the upper panel 284 to the bottom of the dresser 274B but in contrast to side panels 286A in FIG. 41A, do not form front legs 216 and rear legs 218 spaced apart from the front legs 216. Rather, there are separate front and rear legs 216, 218. The side panels 286B perform the same function as the horizontal supports 286, e.g., provide front to back support for the frame of the dresser 274B.

Figure 41C:
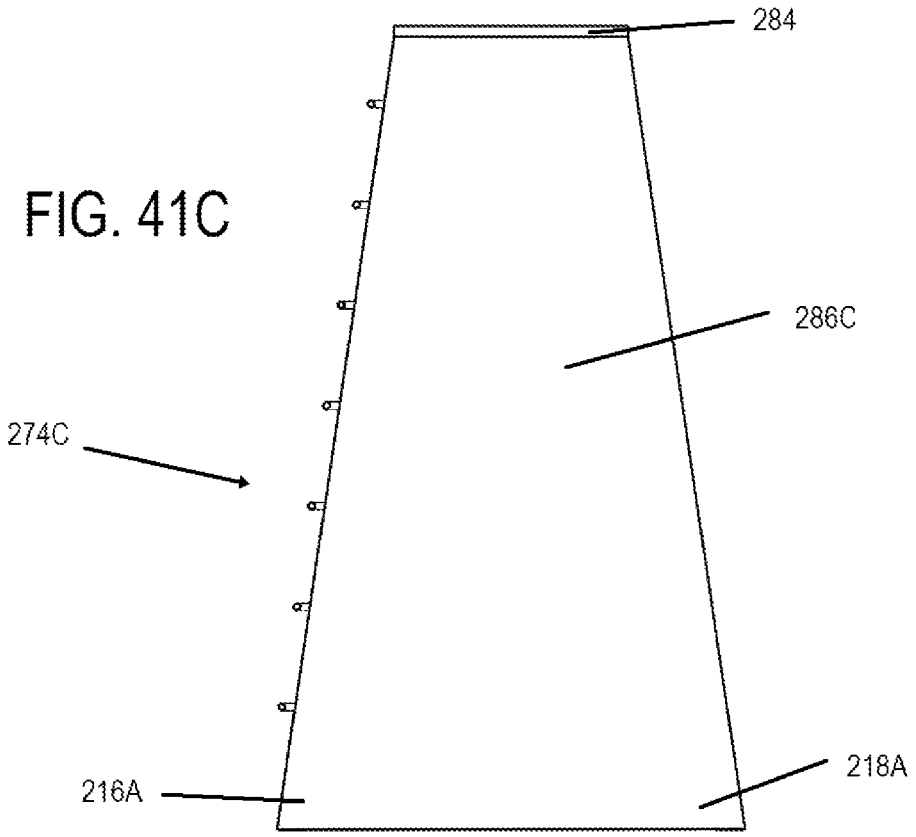

FIG. 41C shows another variant of the dresser 274, now designated 274C, wherein instead of three horizontal supports 286, there is a side panel 286C on each side of the dresser 274C. The side panels 286C extend from the upper panel 284 to the bottom of the dresser 274C and provide the lower/bottom surfaces of the frame that rest on and in contact with a horizontal surface. There are thus no separate legs in this variant. However, it may be considered that a front, lower portion of each of the side panels 286C forms a front support region 216A and a rear, lower portion of each of the side panels 286C forms a rear support region 218A. The side panels 286C perform the same function as the horizontal supports 286, e.g., provide front to back support for the frame of the dresser 274C, and also perform the function of legs to form a support surface for the frame of the dresser 274C on and in contact with a horizontal surface. The lower surface of the side panels 286C may be flat as shown so that it would ideally rest in its entirety on a similarly flat horizontal surface.

Accordingly, instead of horizontal supports 286, side panels 286A, 286B or 286C, other comparable or equivalent support structure may be used for a dresser like dressers 274, 274A, 274B, 274C.

A general feature of the embodiments of FIGS. 41-41C is that there are two side, front facing parts of the frame of the dresser that each has a single elongate section extending from the upper panel of the frame to the bottom of the frame and that is at an angle to a vertical plane through the dresser and also two side, rear facing parts of the frame of the dresser that each has a single elongate section extending from the upper panel of the frame to the bottom of the frame and that is also at an angle to the vertical plane of the dresser. Each of the front and rear facing parts may be formed or defined by specific vertical supports which have a single elongate sections, like vertical supports 280, 282 described above, or provided integral with or as a portion of a side panel, like in side panels 286A, 286B and 286C. The manner in which the front and rear facing parts on the sides of the frame are provided with a single elongate section is dependent on, for example, the designer of the furniture and the design sought. It does not affect the anti-tipping properties of the furniture. If a side panel is sought, then the single elongate section would be incorporated into a side panel, i.e., the side panels may be considered to include an elongate section at the front and rear. If the appearance of discrete frame sections is sought, then the front vertical supports 280 and rear vertical supports 282 would be formed.

A similar variability is present with respect to the legs. The legs may be provided as separate components attached to the frame, e.g., to the lower panel, or formed integral with the side panels. Alternatively, separate legs may be eliminated and the function of the legs incorporated into the side panels (see FIG. 41C). Other support structure to support the furniture instead of legs or side panels may also be provided without deviating from the scope and spirit of the invention.

Figure 42:
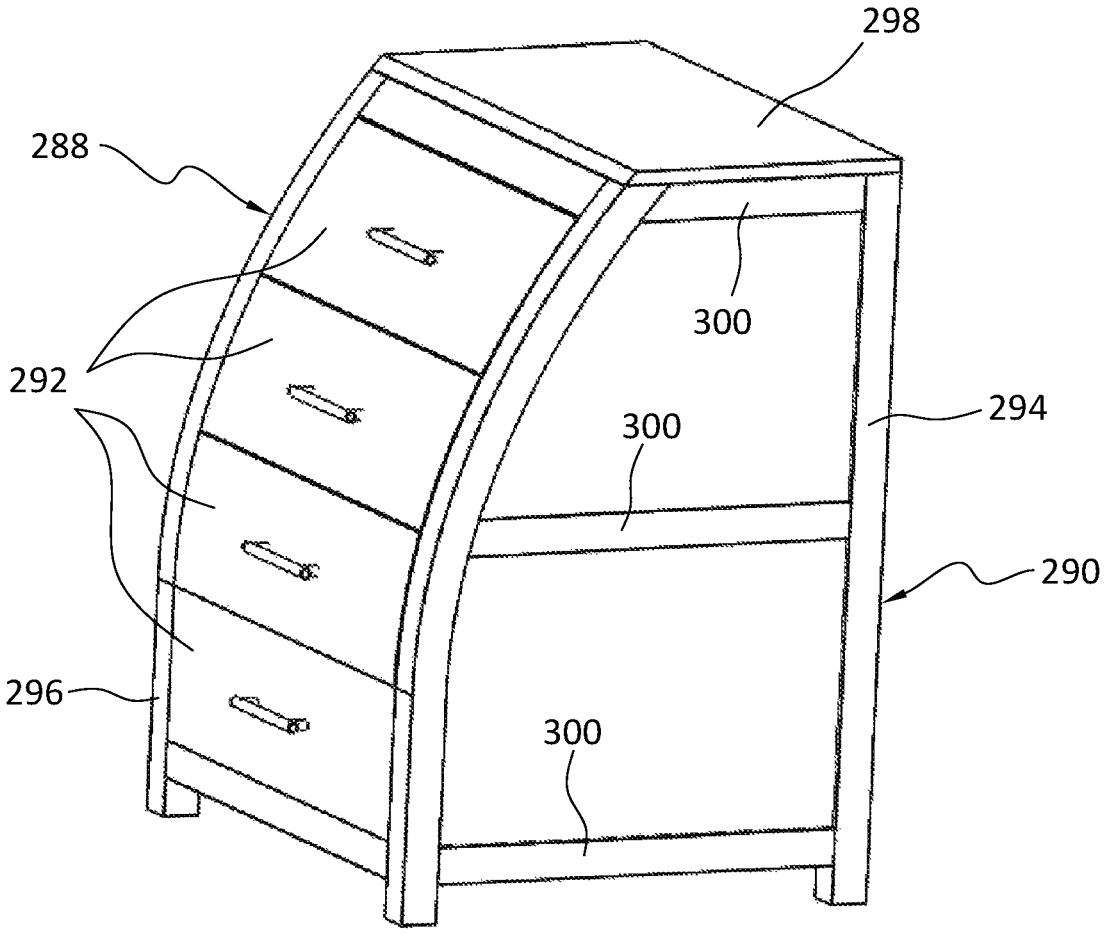
FIG. 42 is a perspective view of another embodiment of a dresser providing anti-tipping properties in accordance with the invention.

FIG. 42 shows an embodiment of a dresser 288 including a frame 290, a plurality of drawers 292, and hardware (not shown) to enable the drawers 292 to slide into and out of the frame 290 while being secured therein. The hardware is well-known to those skilled in the art.

The frame 290 includes two rear vertical supports 294, one on each side of the dresser 292, and two front vertical supports 296, one on each side of the dresser 292 and aligning with a respective one of the rear vertical supports 294. The rear vertical supports 294 are elongate and straight in the vertical direction, i.e., parallel to the vertical axis of the dresser 288, preferably along their entire length. The front vertical supports 296 are curved outward, i.e., they have a forwardly curved portion in the upper section of the dresser 288. An optimum forward curvature can be determined by considering the objectives of the invention, e.g., tipping prevention, and different dressers 288 can be made with different curvatures of the front vertical supports 296. As a result of the curvature of at least a portion of the front vertical supports 296 relative to rear vertical supports 294, the front-to-back dimension of the dresser 288 increases in the downward direction from an upper board or panel 298. Also, a bottom front region of the lower section is more forward from a central vertical plane of the frame than a top front region. A portion of the front vertical supports 296 may be elongate and straight, e.g., in the lower section as shown. With this configuration, the drawers 292 can have a gradually increasing depth when proceeding from the uppermost drawer 292 to the lowermost drawer 292. The front panel of each drawer 292 may be curved or angled at an angle commensurate with the angular or curvature orientation of the front vertical supports 296.

As shown, a lower part of the front vertical supports 296 may be straight and elongate while the remaining upper part is curved. Alternatively, the entire front vertical support 296 may be curved. The straight and elongate part, when present, may be the height of one drawer 292 as shown, or any number of drawers.

Horizontal supports 300 include one support at the bottom of the dresser 288, one in a middle region of the dresser 288, and one at the top of the dresser 288. A different number and position of horizontal supports 300 may be provided. The lowermost horizontal support 300 may be a small distance above the lower edge of the rear and front vertical supports 294, 296 to enable a lower end region of the rear and front vertical supports 294, 296 to form legs for the dresser 288.

The frame 290 may also include a lower board or panel to define a support for the lowermost one of the drawers 292.

Dresser 288 therefore includes a protruding bulged curved front with drawers 292 protruding forward with the deep base footprint sweeping to the substantially less deep top which often is the key part that causes forward tipping by a toddler or a child 302. The bulge in the drawers 292 coupled with the difficult to reach top board or panel 300 provides significant tip prevention.

The curved bulge arising from the curved vertical supports 296 serves to push the toddler forward somewhat thus making it more difficult to engage securely grasping the top. Furthermore, such imbalance and weaker footing by the toddler provides significantly improved anti tipping conditions. This is in-line with the overall embodiments where the base footprint is deeper than the top footprint thus providing a significantly positive secure stance and making tipping exceedingly difficult for the toddler (as well as their parent)

Figure 42A:
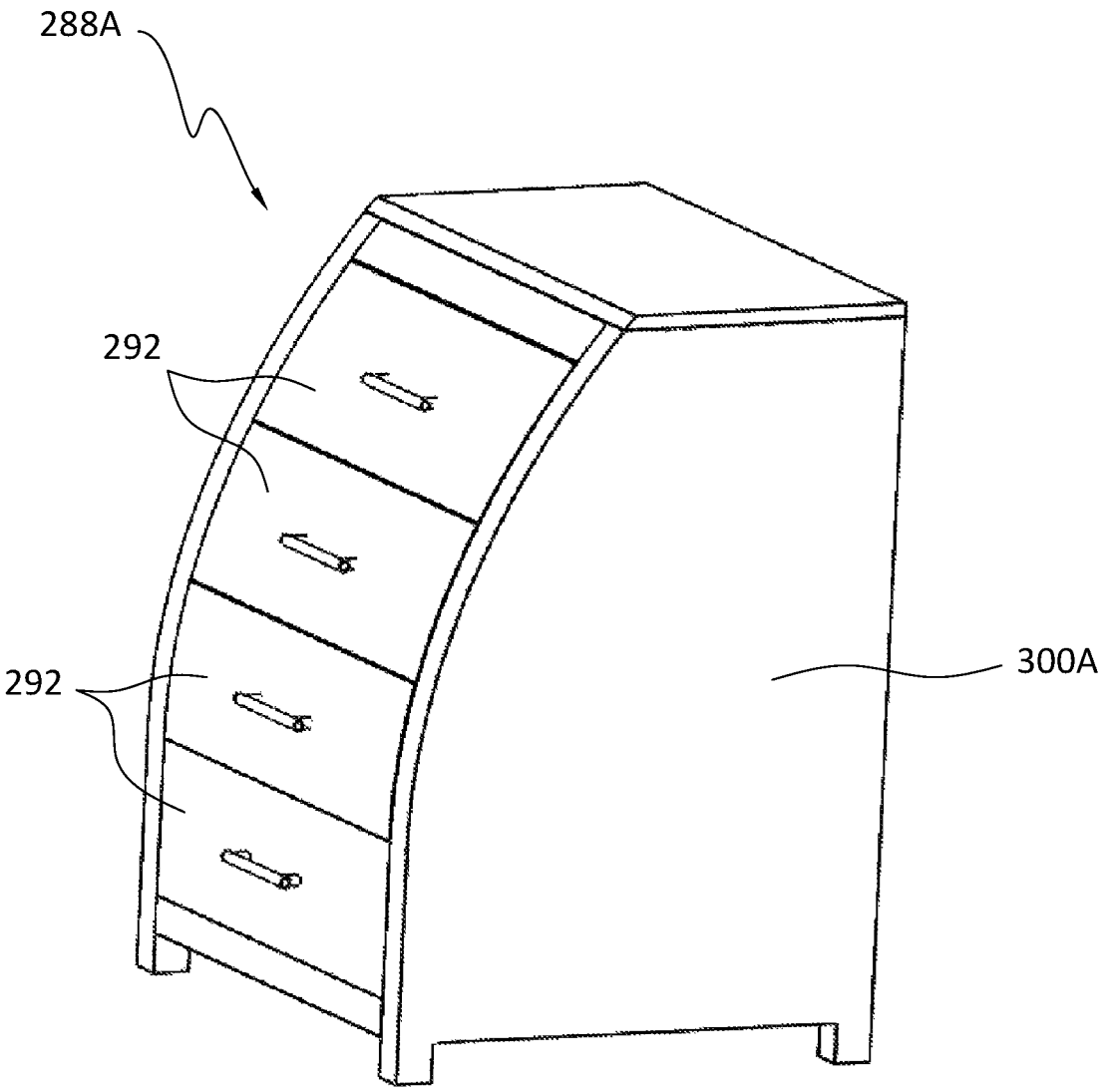
FIG. 42A is a perspective view of yet another embodiment of a dresser providing anti-tipping properties in accordance with the invention similar to the embodiment shown in FIG. 42 but with a different side panel.

In a variant shown in FIG. 42A, a dresser 288A can be designed with full panels on both sides, one such panel 300A being shown on the right side, and may not have vertical supports 294, 296 such as in dresser 288. The side panels 300A extend from the upper panel 298 to the bottom of the dresser 288A and form and include front legs and rear legs spaced apart from the front legs. Such a design construction will function substantially the same as other dressers disclosed herein.

Figure 42B:
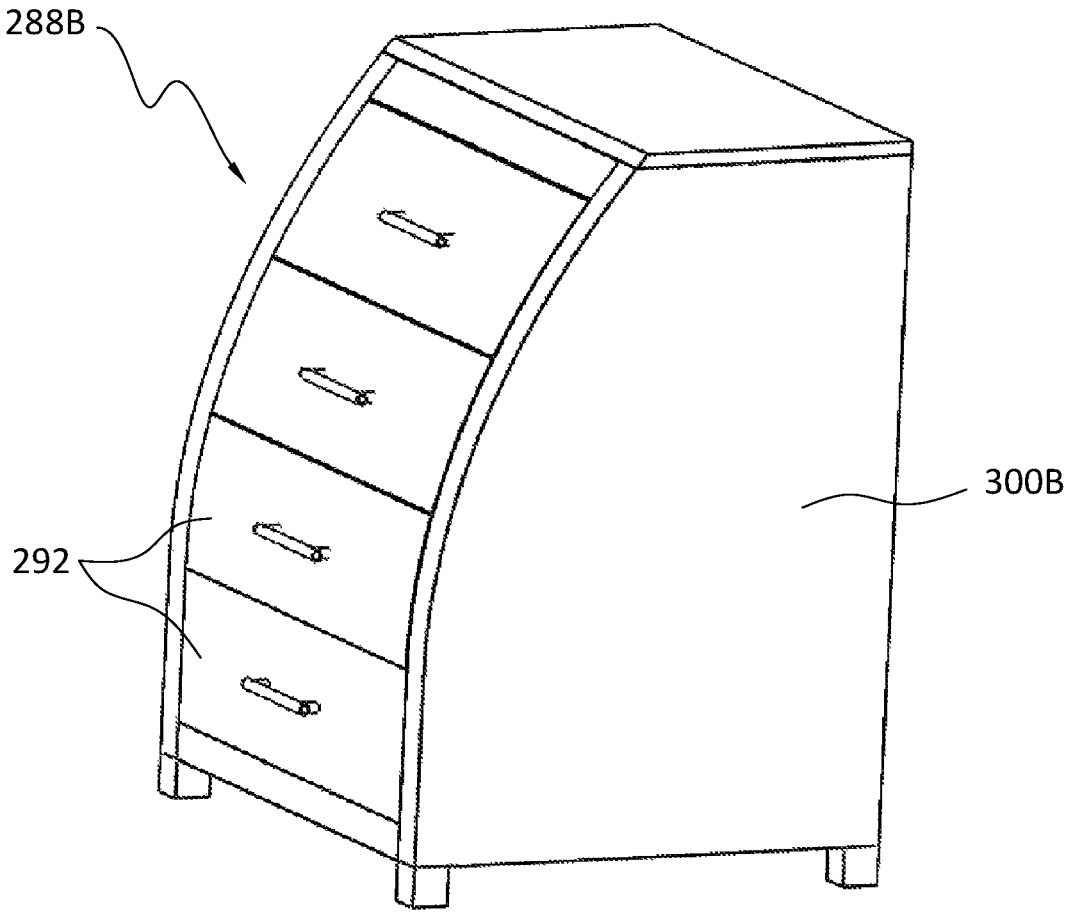
FIG. 42B is a perspective view of still another embodiment of a dresser providing anti-tipping properties in accordance with the invention similar to the embodiment shown in FIG. 42 but with a different side panel.

Similarly, in a variant shown in FIG. 42B, a dresser 288B can be designed with almost full panels on both sides, one such panel 300B being shown on the right side. The legs are not covered by or formed integral with the side panels. The side panels 300B extend from the upper panel 298 to the bottom of the dresser 288B but in contrast to side panels 300A in FIG. 42A, do not form front legs and rear legs spaced apart from the front legs 216. Rather, there are separate front and rear legs. The legs are not covered by or formed integral with the side panels 300A. The side panels 300B perform the same function as the horizontal supports 300, e.g., provide front to back support for the frame of the dresser 288B. Vertical supports 294, 296, such as in dresser 288, may be eliminated. Such a design construction will function substantially the same as other dressers disclosed herein.

Figure 42C:
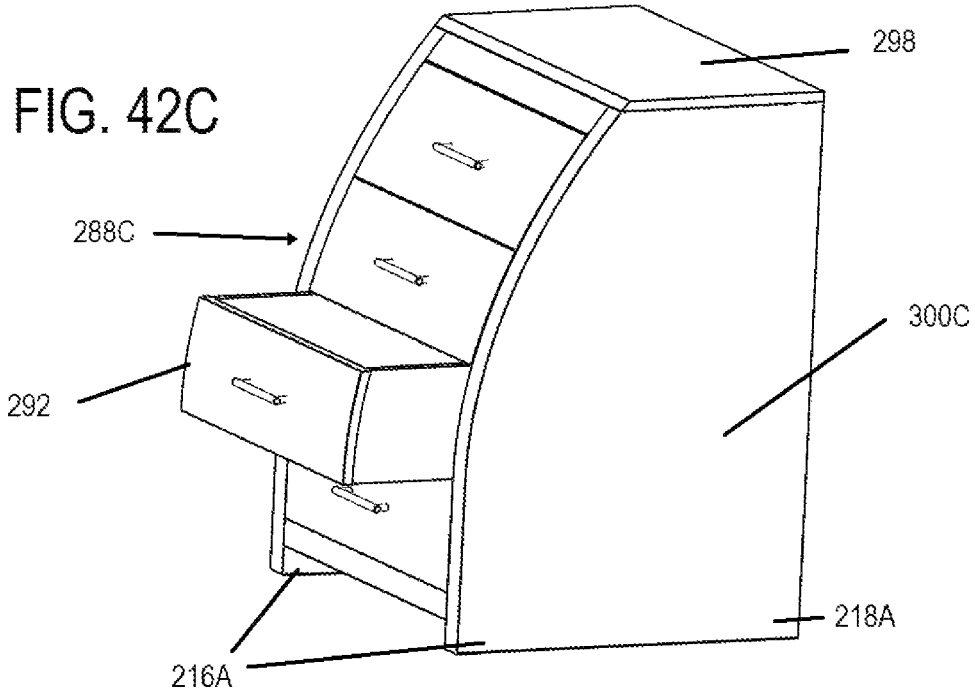
FIG. 42C is a perspective view of still another embodiment of a dresser providing anti-tipping properties in accordance with the invention similar to the embodiment shown in FIG. 42 but with a different side panel.

In another variant shown in FIG. 42C, a dresser 288C can be designed with full panels on both sides, one such panel 300C being shown on the right side, and lacks vertical supports 294, 296. The side panels 300C extend from the upper panel 298 to the bottom of the dresser 288C and provide the lower/bottom surfaces of the frame that rest on and in contact with a horizontal surface. There are thus no separate legs in this variant. However, it may be considered that a front, lower portion of each of the side panels 300C forms a front support region 216A and a rear, lower portion of each of the side panels 300C forms a rear support region 218A. The side panels 300C perform the same function as the horizontal supports 300, e.g., provide front to back support for the frame of the dresser 288C, and also perform the function of legs to form a support surface for the frame of the dresser 288C on and in contact with a horizontal surface. The lower surface of the side panels 300C may be flat as shown so that it would ideally rest in its entirety on a similarly flat horizontal surface.

A general feature of the embodiments of FIGS. 42-42C is that there are two side, front facing parts of the frame of the dresser that each has two discrete sections, namely an upper curved section adjacent and/or adjoining the upper panel of the frame and a lower straight and elongate, vertical section adjacent and/or adjoining a lower panel of the frame and that is contiguous with the upper section. The lower vertical section may be perpendicular to the horizontal axis or plane through the dresser. The front facing parts may be formed or defined by specific vertical supports, like vertical supports 296 described above, or provided integral with or as a portion of a side panel, like in side panels 300A, 300B and 300C. The manner in which the front facing parts on the sides of the frame are provided with the curved and vertical sections is dependent on, for example, the designer of the furniture and the design sought. It does not affect the anti-tipping properties of the furniture. If a side panel is sought, then the curved and vertical sections would be incorporated into side panels, i.e., the side panels may be considered to include an upper front curved vertical support section and a lower front straight support section. If the appearance of discrete frame sections is sought, then the front vertical supports 296 would be formed and provided with curved and straight sections.

A similar variability is present with respect to the legs. The legs may be provided as separate components attached to the frame, e.g., to the lower panel, or formed integral with the side panels. Alternatively, separate legs may be eliminated and the function of the legs incorporated into the side panels (see FIG. 42C). Other support structure to support the furniture instead of legs or side panels may also be provided without deviating from the scope and spirit of the invention.

In all of the embodiments wherein side panels are provided, and in other embodiments to the extent possible, it is considered other embodiments of the invention wherein separate side panels are provided and attached to the sides of the piece of furniture. These side panels would be dimensioned so that when attached to the sides of the piece of furniture, the piece of furniture with the side panels has an upper section and a lower section having a greater front to back distance than the upper section. Also, a bottom front region of the lower section is more forward from a central vertical plane of the frame than the top front region. The side panels may have legs or a flat lower surface extending from the rear facing surface to the front facing surface as disclosed above. Attachment of the side panels to the side of the piece of furniture may be by any attachment means known to those in the furniture art, whether screws, adhesive or otherwise.

The dressers shown in FIGS. 35-42C may also include other anti-tipping mechanisms disclosed herein. For example, it is possible to put a post 62 as in the embodiments of FIGS. 12-15 on any of the dressers disclosed in FIG. 35-42C to improve the anti-tipping resistance.

It is important to note that the frame may have a lower surface configured to be in contact with the horizontal surface on which the piece of furniture is placed. Wheels below the frame are not preferred as the piece of furniture is designed to be placed in one position for use.

In the embodiments of FIGS. 35-42C, generally the frame includes an upper section and a lower section having a greater front to back distance than the upper section. However, it is also possible to achieve the objective of the invention when this condition is not satisfied by adjusting the rear vertical supports or rear facing parts, which may be incorporated into side panels, to slant rearward from the bottom to the top of the frame. For example, in the embodiment of FIG. 38, it is possible to provide the rear vertical supports with a slant, instead of being vertical (perpendicular to the horizontal plane of the dresser 254), with the slant being a rearward slant so that the top region is more rearward relative to the front of the 254 than the bottom region. This rearward slant may result in the rear vertical supports being parallel to the front vertical supports to provide the dresser with a parallelogram shape when viewed from the side. The drawers 258 and the upper panel 264 are level with one another. The angle of the rearward slant is adjustable to ensure sufficient anti-tipping properties are provided by the dresser 254.

Figure 43:
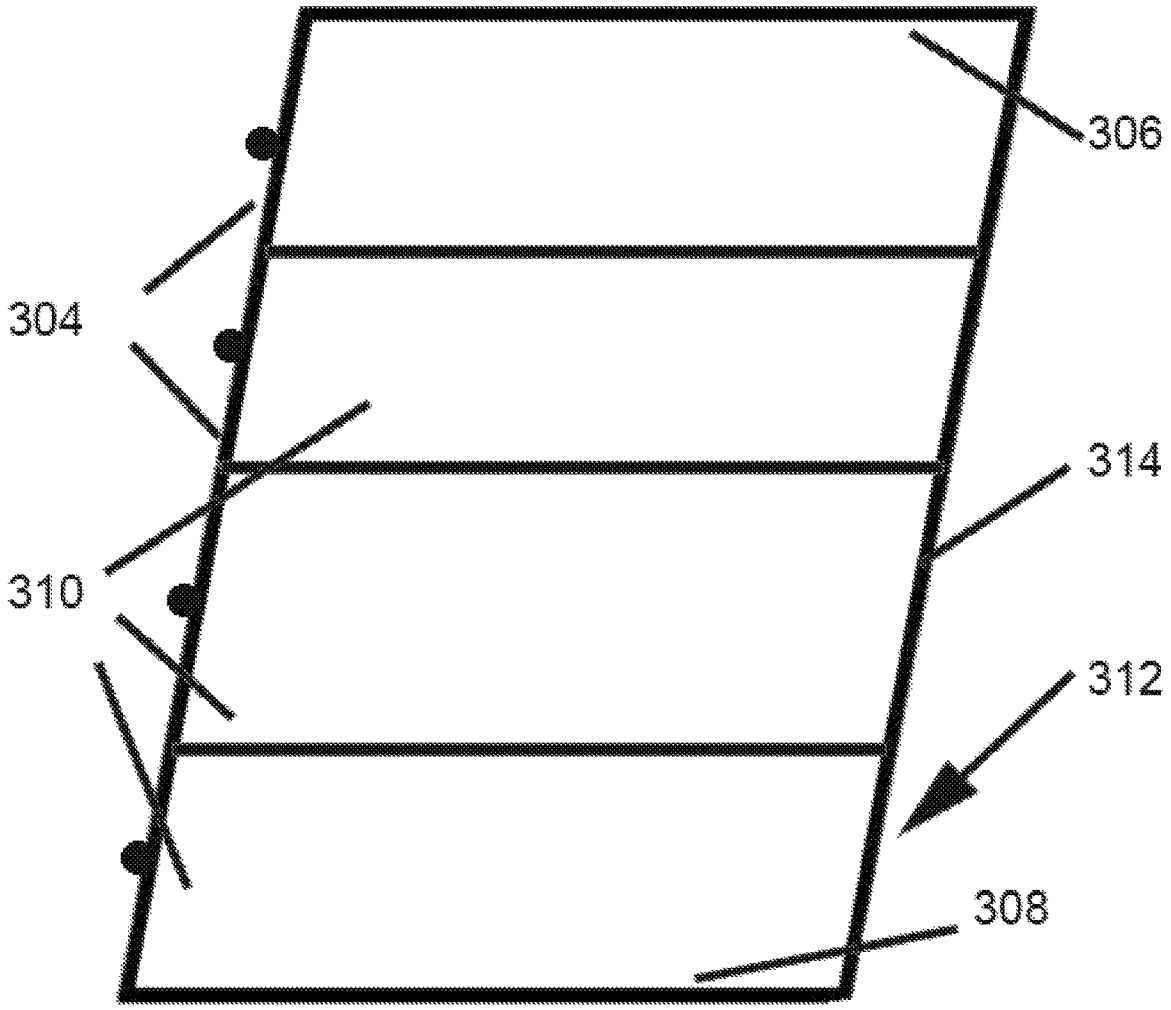
FIG. 43 is a schematic of another embodiment of addresser in accordance with the invention that provides anti-tipping properties.

This configuration is shown in FIG. 43 wherein the dresser 312 includes drawers 310 each including a slant front panel 304, and the frame of the dresser 312 includes an upper panel 306 and a lower panel 308. The rear facing surface 314 of the frame of the dresser 312 has a rearward slant and thus surface may be one or more of the surface of each of two rear vertical supports on the opposed lateral sides of the frame if present, a panel or board at the rear of the frame that forms the rear of the dresser 312, the rear facing parts of side panels along the sides of the frame of the dresser 312. The same rearward slant can easily be adapted to the other embodiments of dressers and piece of furniture disclosed herein.

The same modification may be made to all of the other embodiments in FIGS. 35A-42C wherein the rear vertical supports or rear facing parts of the side panels are provided with a rearward slant instead of being vertical (as in the embodiments of FIGS. 35A-40C and 42-42C) or having a forward slant (as in the embodiments of FIGS. 41-41C).

Thus, the common feature of the embodiments of FIGS. 35-42C may be considered that the bottom front region of the piece of furniture is more forward from a central vertical plane of the piece of furniture than a top front region.

Figure 44:
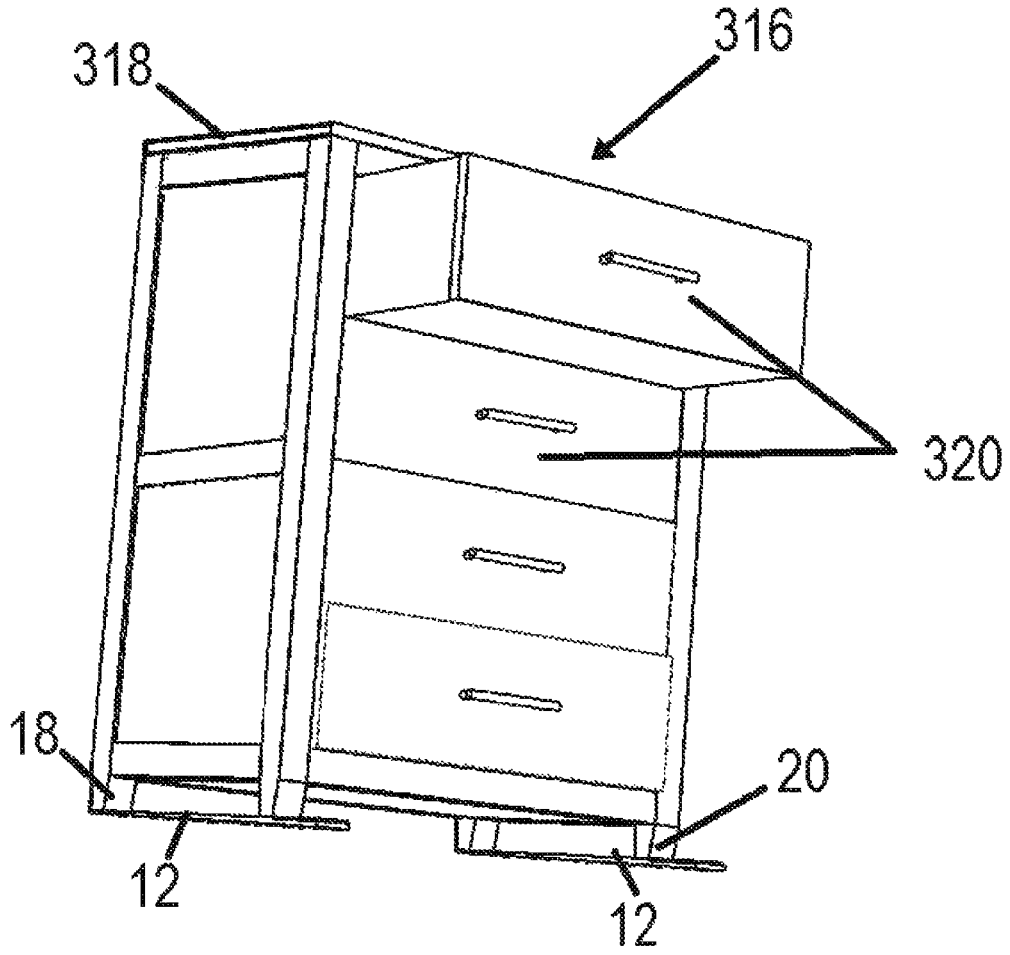
FIG. 44 is a front perspective view of another embodiment of a dresser providing anti-tipping properties in accordance with the invention.
Figure 45:
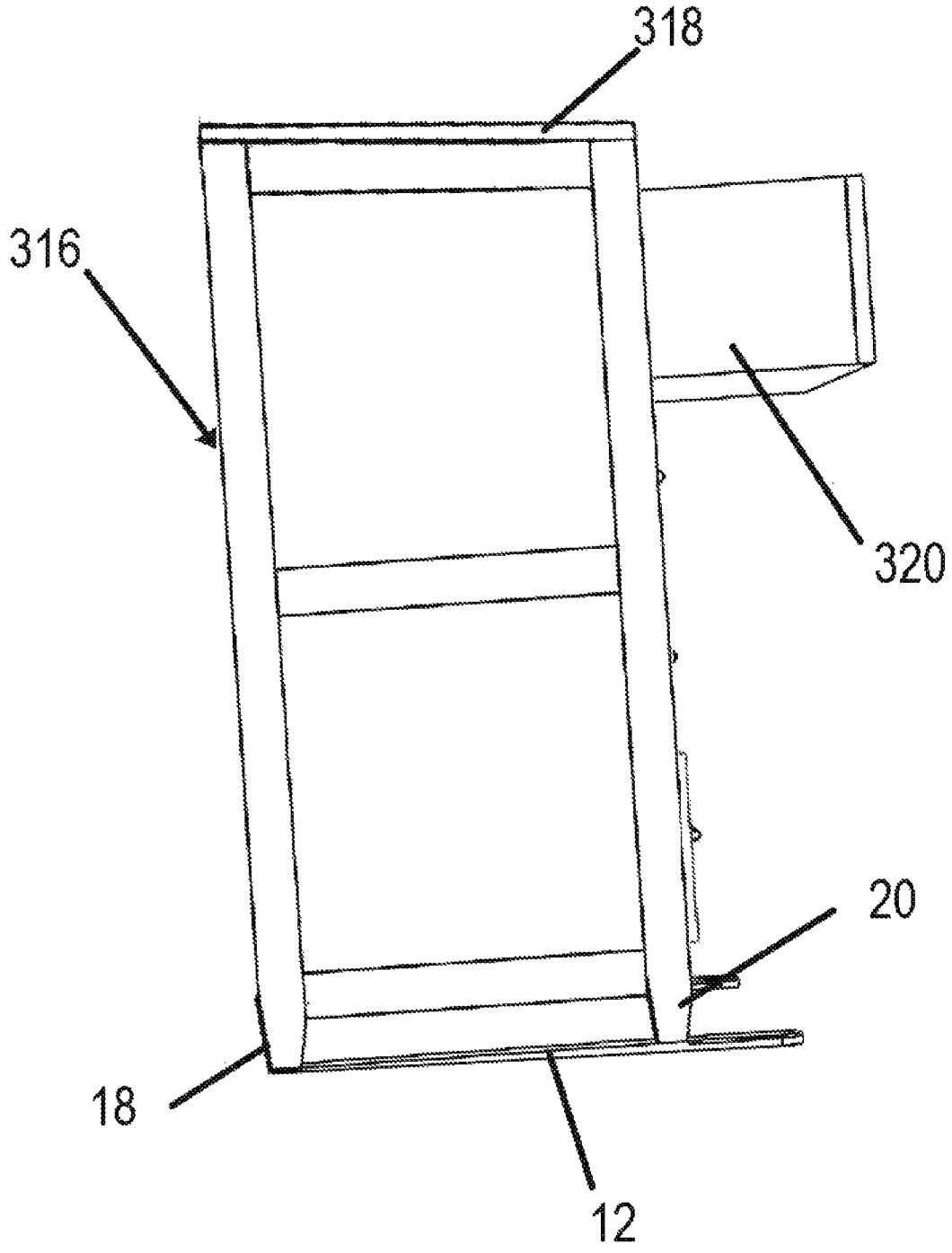
FIG. 45 is a side perspective view of the embodiment of the dresser providing anti-tipping properties in accordance with the invention shown in FIG. 44.

Referring now to FIGS. 44 and 45, in this embodiment, a dresser 316 is modified for use with a boot as disclosed herein, e.g., boot 12 but all of the boots and other similar structures disclosed herein can be used with this dresser 316. The dresser 316 is provided with an upper panel or board 318 that provides the uppermost, exposed surface of the dresser 316. The board 318 is not parallel to the horizontal surface on which the dresser 316 is situated when the boot 12 is not present. Rather, the board 318 is angled such that it slopes downward in a direction from the back to the front of the dresser 316. That is, when the dresser 316 is installed such that its lowermost surface, e.g., the lower surface of the legs 18, 20, is in contact with the horizontal support surface, the top front of the dresser 316 is lower than the top, rear of the dresser 316. This angle may be as small as 0.5 degrees to a few degrees, e.g., about 5 degrees.

However, the angular configuration of the board 318 is such that when the boot 12 is underneath the dresser 316 as shown, the board 318 is parallel to the horizontal surface on which the dresser 316 is situated. Thus, the dresser 316 presents a level surface when the boot 12 is in place, a level surface being a surface parallel to the horizontal surface that supports the dresser 316. The angled pitched top of the dresser 316 is thus brought into a parallel relationship with the horizontal surface that supports the dresser 316, its slant being compensated for by the presence of the boot 12. The angle of the boot 12 is therefore preferably the same angle as the upper board 318.

Also, the drawers 320 will not open and close in directions parallel to the horizontal surface that supports the dresser 316. Rather, the drawers 320 will be slightly angled upward at their front (with the same angular orientation as the boot 12 and upper board 318), when the boot 12 is in place. This further provides tipping resistance.

While these embodiments are directed to the serious, often fatal, accidents involving toddlers, they address all anti-tipping furniture issues that may arise, involving both toddlers and adults.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. In combination, a piece of furniture and an anti-tipping mechanism, comprising:

a frame having a front and a rear;

at least one drawer slidable through the front of said frame into and partly out of said frame;

a first L-shaped boot having a first elongate planar portion and a second planar portion shorter than said first planar portion, said second planar portion having a position at an angle to said first planar portion; and first attachment means for attaching said second planar portion to a rear surface of said frame such that said second planar portion is alongside and in contact with the rear surface of said frame, said first planar portion being situated below the front and rear of said frame and having a size to extend forward of the front of said frame when said second planar portion is attached by said first attachment means to the rear surface of said frame to aid in preventing tipping of the piece of furniture.

2. The combination of claim 1, wherein said second planar portion is fixed at an angle to said first planar portion, and said first attachment means comprise at least one screw or bolt which fits through a respective one of at least one aperture in said second planar portion.

3. The combination of claim 1, wherein a part of said first planar portion that extends forward of the front of said frame has contoured edges or is straight.

4. The combination of claim 1, wherein said frame includes a front leg at the front of said frame and a rear leg at a rear of said frame spaced apart from one another to provide a space between a front surface of said rear leg and a rear surface of said front leg, said first planar portion being below said front leg and said rear leg.

5. The combination of claim 1, wherein said frame includes a front left leg and a front right leg at the front of said frame spaced apart from one another and a rear left leg and a rear right leg at the rear of said frame spaced apart from one another, said front left leg being spaced apart from said rear left leg to provide a space between a front surface of said rear left leg and a rear surface of said front left leg, said front right leg being spaced apart from said rear right leg to provide a space between a front surface of said rear right leg and a rear surface of said front right leg, said first planar portion being below said front left leg, said front right leg, said rear left leg and said rear right leg, the rear surface of said frame to which said first attachment means attach said second planar portion comprising a rear surface of said rear left leg and a rear surface of said rear right leg.

6. The combination of claim 1, further comprising:

a second L-shaped boot having a first elongate planar portion and a second planar portion shorter than said first planar portion of said second boot, said second planar portion of said second boot having a position at an angle to said first planar portion of said second boot; and second attachment means for attaching said second planar portion of said second boot to an additional rear surface of said frame such that said second planar portion of said second boot is alongside and in contact with the additional rear surface of said frame, said first planar portion of said second boot being situated below the front and rear of said frame and having a size to extend forward of the front of said frame when said second planar portion of said second boot is attached by said second attachment means to the additional rear surface of said frame to further aid in preventing tipping of the piece of furniture.

7. The combination of claim 1, further comprising a hinge mechanism connecting said first and second planar portions to enable said second planar portion to be moved to different angles relative to said first planar portion.

8. The combination of claim 1, wherein said first planar portion has a variable height from a largest height at a forward end and a smallest height at or proximate an edge adjacent said second planar portion.

9. The combination of claim 8, wherein said first planar portion has a uniformly varying height from the forward end and to the edge adjacent said second planar portion.

10. The combination of claim 9, wherein said frame comprises an upper board that provides an uppermost, exposed surface of the piece of furniture, said uppermost surface of said upper board sloping downward from the rear of said frame to the front of said frame at an angle which is the same as an angle of change in height of said first planar portion such that when said first boot is under said frame, said uppermost surface of said upper board is parallel to a bottom surface of said first planar portion, said at least one drawer being configured to open at the same angle.

11. The combination of claim 1, wherein said first planar portion includes elongate, straight side ribs and a front rib connecting front ends of said side ribs to provide a horizontal support surface at a lower edge of said first planar portion, said first planar portion overlying a hollow cavity defined by a lower surface of said first planar portion at a top, an inner surface of said side ribs on lateral sides, and an inner surface of said front rib at a front.

12. In combination, a piece of furniture and an anti-tipping mechanism, comprising:

a frame having a front and a rear;

at least one drawer slidable through the front of said frame into and partly out of said frame;

a first L-shaped boot having a first elongate planar portion and a second planar portion shorter than said first planar portion, said second planar portion having a position at an angle to said first planar portion;

a second L-shaped boot having a first elongate planar portion and a second planar portion shorter than said first planar portion, said second planar portion having a position at an angle to said first planar portion;

first attachment means for attaching said second planar portion of said first L-shaped boot to a rear surface of said frame such that said second planar portion of said first L-shaped boot is alongside and in contact with the rear surface of said frame; and second attachment means for attaching said second planar portion of said second L-shaped boot to an additional rear surface of said frame such that said second planar portion of said second L-shaped boot is alongside and in contact with the additional rear surface of said frame, said first planar portion of said first L-shaped boot being situated below the front and rear of said frame and having a size to extend forward of the front of said frame when said second planar portion of said first L-shaped boot is attached by said first attachment means to the rear surface of said frame, and said first planar portion of said second L-shaped boot being situated below the front and rear of said frame and having a size to extend forward of the front of said frame when said second planar portion of said second L-shaped boot is attached by said second attachment means to the additional rear surface of said frame.

13. The combination of claim 12, wherein said frame includes a front leg at the front of said frame and a rear leg at a rear of said frame spaced apart from one another to provide a space between a front surface of said rear leg and a rear surface of said front leg, said first planar portion of said first L-shaped boot being below said front leg and said rear leg.

14. The combination of claim 12, wherein said frame includes a front left leg and a front right leg at the front of said frame spaced apart from one another and a rear left leg and a rear right leg at the rear of said frame spaced apart from one another, said front left leg being spaced apart from said rear left leg to provide a space between a front surface of said rear left leg and a rear surface of said front left leg, said front right leg being spaced apart from said rear right leg to provide a space between a front surface of said rear right leg and a rear surface of said front right leg, said first planar portion of said first L-shaped boot being below said front left leg and said rear left leg, said first planar portion of said second L-shaped boot being below said front right leg and said rear right leg, the rear surface of said frame to which said second planar portion of said first L-shaped boot is attached by said first attachment means comprising a rear surface of said rear left leg, and the rear surface of said frame to which said second planar portion of said second L-shaped boot is attached by said second attachment means comprising a rear surface of said rear right leg.

15. The combination of claim 12, wherein said first planar portion of each of said first and second L-shaped boots has a uniformly variable height from a largest height at a forward end and a smallest height at or proximate an edge adjacent said second planar portion of a respective one of said first and second L-shaped boots, said frame comprising an upper board that provides an uppermost, exposed surface of the piece of furniture, said uppermost surface of said upper board sloping downward from the rear of said frame to the front of said frame at an angle which is the same as an angle of change in height of said first planar portion of said first and second L-shaped boots such that when said first and second L-shaped boots are under said frame, said uppermost surface of said upper board is parallel to a bottom surface of said first planar portion of said first and second L-shaped boots, said at least one drawer being configured to open at the same angle.

16. A method for preventing tipping of a piece of furniture having at least one drawer slidable into and partly out of a frame of the piece of furniture, comprising:

placing a first L-shaped boot having a first elongate planar portion and a second planar portion shorter than the first planar portion under the frame such that the first planar portion is below both a front and rear of the frame and a portion of the first planar portion extends forward of the front of the frame; and attaching the second planar portion to a rear surface of the frame such that the second planar portion is at an angle to the first planar portion and is alongside and in contact with the rear surface of the frame, whereby tipping of the piece of furniture arising from pressure exerted on the at least one drawer when partly out of the frame is hindered.

17. The method of claim 16, wherein the step of attaching the second planar portion to a rear surface of the frame comprises inserting screws through respective apertures in the second planar portion into the frame.

18. The method of claim 16, wherein the step of placing the first L-shaped boot under the frame comprises placing the first L-shaped boot under a front leg at a front of the frame and a rear leg at a rear of the frame spaced apart from one another.

19. The method of claim 16, wherein the step of placing the first L-shaped boot under the frame comprises placing the first L-shaped boot under a front left leg and a front right leg at a front of the frame spaced apart from one another and a rear left leg and a rear right leg at a rear of the frame spaced apart from one another.

20. The method of claim 16, further comprising:

placing a second L-shaped boot having a first elongate planar portion and a second planar portion shorter than the first planar portion of the second L-shaped boot under the frame at a different location than the first L-shaped boot is placed such that the first planar portion of the second L-shaped boot is below both the front and rear of the frame and a portion of the first planar portion of the second L-shaped boot extends forward of the front of the frame; and attaching the second planar portion of the second L-shaped boot to a different rear surface of the frame at a different location than the second planar portion of the first L-shaped boot is attached to the rear surface of the frame such that the second planar portion of the second L-shaped boot is at an angle to the first planar portion of the second L-shaped boot and is alongside and in contact with the different rear surface of the frame.

* * * * *